US010791607B1

(12) United States Patent
Modestine et al.

(10) Patent No.: US 10,791,607 B1
(45) Date of Patent: Sep. 29, 2020

(54) CONFIGURING AND CONTROLLING LIGHT EMITTERS

(71) Applicant: Amazon Technologies, Inc., Seattle, WA (US)

(72) Inventors: John Modestine, Los Angeles, CA (US); Ryan David Hruska, North Royalton, OH (US); Elliott Lemberger, Santa Monica, CA (US); Sang Min Park, Los Angeles, CA (US); Michael V. Recker, Santa Monica, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/104,401

(22) Filed: Aug. 17, 2018

(51) Int. Cl.
*H05B 47/105* (2020.01)

(52) U.S. Cl.
CPC ..... *H05B 47/105* (2020.01)

(58) Field of Classification Search
CPC ..... H05B 37/0218; H05B 37/0245; H05B 37/0254; H05B 37/0281; H05B 37/0272; H05B 37/0227; H05B 45/14; H05B 45/24; H05B 45/325; H05B 47/10; H05B 47/14; H05B 47/17; H05B 47/165; H05B 47/135; H05B 45/125
USPC ..... 348/143; 362/11, 97.1, 97.2, 97.3
See application file for complete search history.

(56) References Cited

U.S. PATENT DOCUMENTS 4,764,953 A 8/1988 Chern et al.
5,428,388 A 6/1995 von Bauer et al.
5,760,848 A 6/1998 Cho
6,072,402 A 6/2000 Kniffin et al.
6,192,257 B1 2/2001 Ray
6,271,752 B1 8/2001 Vaios
6,429,893 B1 8/2002 Xin
6,456,322 B1 9/2002 Marinacci
6,476,858 B1 11/2002 Ramirez Diaz et al.
6,633,231 B1 10/2003 Okamoto et al.
6,658,091 B1 12/2003 Naidoo et al.
6,753,774 B2 6/2004 Pan et al.
(Continued)

FOREIGN PATENT DOCUMENTS

CN 2585521 11/2003
CN 2792061 6/2006
(Continued)

*Primary Examiner* — Amy Cohen Johnson
*Assistant Examiner* — Syed M Kaiser
(74) *Attorney, Agent, or Firm* — Lee & Hayes, P.C.

(57) ABSTRACT

This application is directed to techniques and processes for configuring light emitters, and techniques and processes for controlling the light emitters. For example, network device(s) may transmit, to a client device, first image data generated by an electronic device. The client device may then receive input indicating portion of a field of view (FOV) of the electronic device that represent light emitters. The network device(s) may then generate associations between the portions of the FOV and the light emitters. Later, the network device(s) may transmit, to the client device, second image data generated by the electronic device. The client device may then receive input selecting portions of the FOV that are associated with the light emitters. Based on the input, the network device(s) may control the light emitters, such as by causing the light emitters to activate or deactivate.

20 Claims, 28 Drawing Sheets

(56) References Cited

U.S. PATENT DOCUMENTS 6,970,183 B1 11/2005 Monroe
7,062,291 B2 6/2006 Ryley et al.
7,065,196 B2 6/2006 Lee
7,085,361 B2 8/2006 Thomas
7,109,860 B2 9/2006 Wang
7,193,644 B2 3/2007 Carter
7,304,572 B2 12/2007 Sheynman et al.
7,382,249 B2 6/2008 Fancella
7,450,638 B2 11/2008 Iwamura
7,643,056 B2 1/2010 Silsby
7,683,924 B2 3/2010 Oh et al.
7,683,929 B2 3/2010 Elazar et al.
7,738,917 B2 6/2010 Ryley et al.
8,139,098 B2 3/2012 Carter
8,144,183 B2 3/2012 Carter
8,154,581 B2 4/2012 Carter
8,619,136 B2 12/2013 Howarter et al.
8,780,201 B1 7/2014 Scalisi et al.
8,823,795 B1 9/2014 Scalisi et al.
8,842,180 B1 9/2014 Kasmir et al.
8,872,915 B1 10/2014 Scalisi et al.
8,937,659 B1 1/2015 Scalisi et al.
8,941,736 B1 1/2015 Scalisi
8,947,530 B1 2/2015 Scalisi
8,953,040 B1 2/2015 Scalisi et al.
9,013,575 B2 4/2015 Scalisi
9,049,352 B2 6/2015 Scalisi et al.
9,053,622 B2 6/2015 Scalisi
9,058,738 B1 6/2015 Scalisi
9,060,103 B2 6/2015 Scalisi
9,060,104 B2 6/2015 Scalisi
9,065,987 B2 6/2015 Kasmir et al.
9,094,584 B2 7/2015 Scalisi et al.
9,113,051 B1 8/2015 Scalisi
9,113,052 B1 8/2015 Scalisi et al.
9,118,819 B1 8/2015 Scalisi et al.
9,142,214 B2 9/2015 Scalisi
9,160,987 B1 10/2015 Kasmir et al.
9,165,444 B2 10/2015 Scalisi
9,172,920 B1 10/2015 Kasmir et al.
9,172,921 B1 10/2015 Scalisi et al.
9,172,922 B1 10/2015 Kasmir et al.
9,179,107 B1 11/2015 Scalisi et al.
9,179,108 B1 11/2015 Scalisi et al.
9,179,109 B1 11/2015 Kasmir et al.
9,196,133 B2 11/2015 Scalisi et al.
9,197,867 B1 11/2015 Scalisi et al.
9,230,424 B1 1/2016 Scalisi et al.
9,237,318 B2 1/2016 Kasmir et al.
9,247,219 B2 1/2016 Kasmir et al.
9,253,455 B1 2/2016 Harrison et al.
9,342,936 B2 5/2016 Scalisi
9,508,239 B1 11/2016 Harrison et al.
9,723,676 B2 * 8/2017 Ganick ..... G01S 1/70
9,736,284 B2 8/2017 Scalisi et al.
9,743,049 B2 8/2017 Scalisi et al.
9,769,435 B2 9/2017 Scalisi et al.
9,786,133 B2 10/2017 Harrison et al.
9,799,183 B2 10/2017 Harrison et al.
2002/0094111 A1 7/2002 Puchek et al.
2002/0147982 A1 10/2002 Naidoo et al.
2003/0043047 A1 3/2003 Braun
2004/0085205 A1 5/2004 Yeh
2004/0085450 A1 5/2004 Stuart
2004/0086093 A1 5/2004 Schranz
2004/0095254 A1 5/2004 Maruszczak
2004/0135686 A1 7/2004 Parker
2005/0111660 A1 5/2005 Hosoda
2005/0275626 A1 * 12/2005 Mueller ..... H05B 37/0245 345/156
2006/0010199 A1 1/2006 Brailean et al.
2006/0022816 A1 2/2006 Yukawa
2006/0139449 A1 6/2006 Cheng et al.
2006/0156361 A1 7/2006 Wang et al.
2007/0008081 A1 1/2007 Tylicki et al.
2007/0222865 A1 * 9/2007 Levien ..... H04N 5/765 348/222.1
2010/0225455 A1 9/2010 Claiborne et al.
2013/0057695 A1 3/2013 Huisking
2013/0335446 A1 * 12/2013 Piippo ..... G06F 3/04815 345/633
2014/0266639 A1 * 9/2014 Zises ..... G08C 17/02 340/12.28
2014/0267716 A1 9/2014 Child et al.
2014/0320021 A1 * 10/2014 Conwell ..... H04W 4/50 315/152
2014/0325408 A1 * 10/2014 Leppanen ..... G06F 3/0481 715/765
2015/0035987 A1 2/2015 Fernandez
2015/0062288 A1 * 3/2015 Lee ..... H04N 5/44504 348/36
2015/0163463 A1 6/2015 Hwang et al.
2016/0012574 A1 * 1/2016 Li ..... G06T 7/11 345/419
2017/0124883 A1 * 5/2017 Modica ..... G08G 5/025
2018/0012082 A1 * 1/2018 Satazoda ..... G06K 9/00805
2018/0095175 A1 * 4/2018 O'Keeffe ..... G01S 17/66
2018/0247134 A1 * 8/2018 Bulzacki ..... G06K 9/00771
2019/0066381 A1 * 2/2019 Estable ..... G06T 19/006

FOREIGN PATENT DOCUMENTS

EP 0944883 9/1999
EP 1480462 11/2004
GB 2286283 8/1995
GB 2354394 3/2001
GB 2357387 6/2001
GB 2400958 10/2004
JP 2001103463 4/2001
JP 2002033839 1/2002
JP 2002125059 4/2002
JP 2002342863 11/2002
JP 2002344640 11/2002
JP 2002354137 12/2002
JP 2002368890 12/2002
JP 2003283696 10/2003
JP 2004128835 4/2004
JP 2005341040 12/2005
JP 2006147650 6/2006
JP 2006262342 9/2006
JP 2009008925 1/2009
WO WO9839894 9/1998
WO WO0113638 2/2001
WO WO0193220 12/2001
WO WO02085019 10/2002
WO WO03028375 4/2003
WO WO03096696 11/2003
WO WO2006038760 4/2006
WO WO2006067782 6/2006
WO WO2007125143 11/2007

* cited by examiner

CONFIGURING AND CONTROLLING LIGHT EMITTERS

TECHNICAL FIELD

The present embodiments relate to audio/video (A/V) devices, including A/V doorbells, A/V security cameras, A/V floodlight cameras, and A/V spotlight cameras. In particular, the present embodiments relate to improvements in the functionality of A/V devices and electronic devices associated with the A/V devices.

BACKGROUND

Home security is a concern for many homeowners and renters. Those seeking to protect or monitor their homes often wish to have video and audio communications with visitors, for example, those visiting an external door or entryway. A/V devices, such as doorbells, security cameras, and the like, provide this functionality, and can also aid in crime detection and prevention. For example, audio and/or video captured by an A/V device can be uploaded to the cloud and recorded on a remote server. Subsequent review of the audio and/or video footage can aid law enforcement in capturing perpetrators of home burglaries and other crimes. Additionally, the presence of one or more A/V devices on the exterior of a home, such as a doorbell unit at the entrance to the home, acts as a powerful deterrent against would-be burglars. Furthermore, the homeowner or renter of the home may use a client device to view images that are represented by image data generated by the A/V devices. The images may represent fields of view of the A/V devices, including objects, such as visitors and would-be burglars.

BRIEF DESCRIPTION OF THE DRAWINGS

The various embodiments of the present disclosure are directed to configuring and controlling light emitters, which will now be discussed in detail with an emphasis on highlighting the advantageous features. These embodiments depict the novel and non-obvious embodiments of configuring and controlling light emitters, as shown in the accompanying drawings, which are for illustrative purposes only. These drawings include the following figures, in which like numerals indicate like parts.

DETAILED DESCRIPTION

Figure 1A:
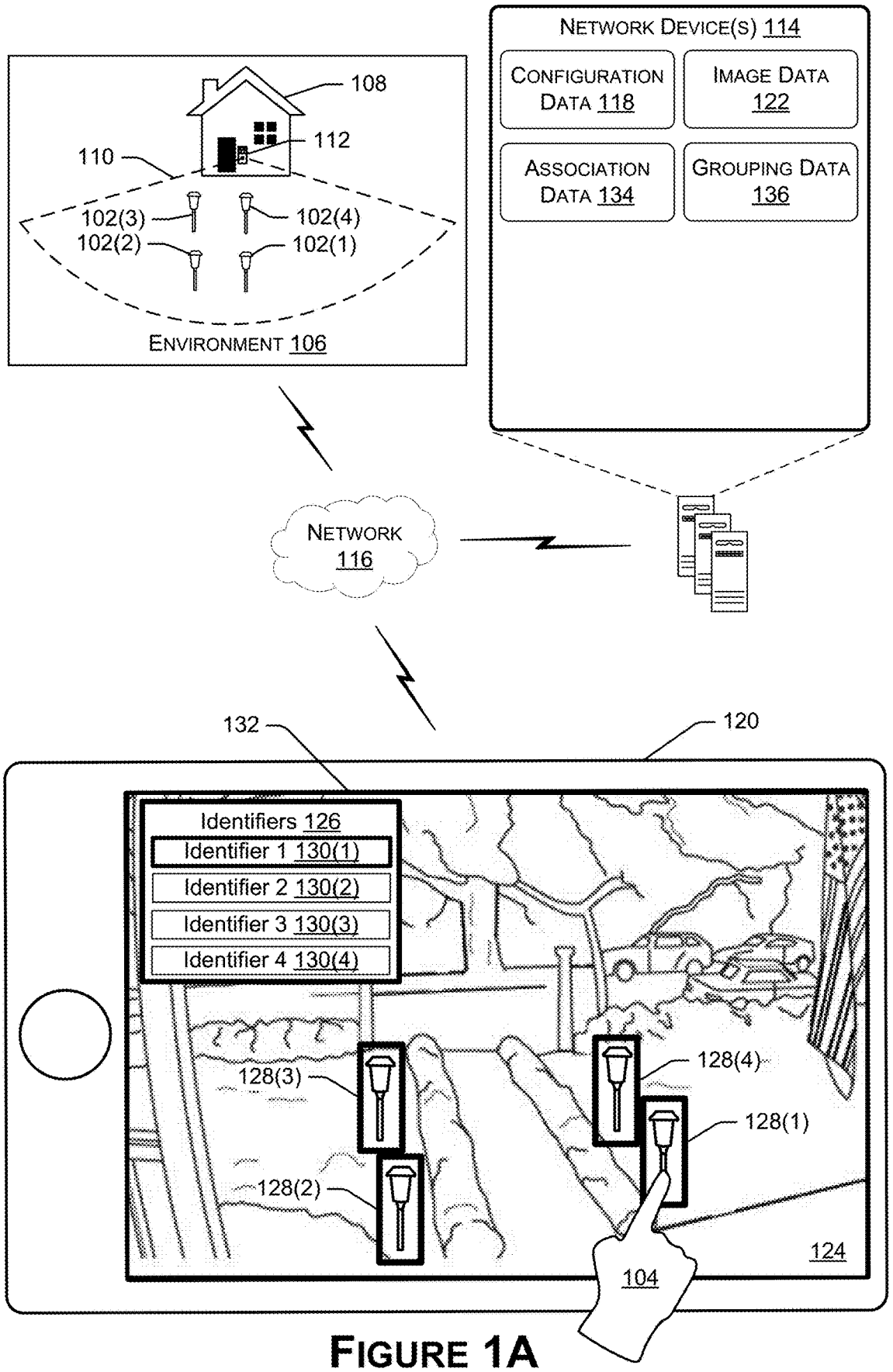
FIGS. 1A-1B are schematic diagrams of examples of configuring light emitters and then using a graphical user interface to control the light emitters, according to various aspects of the present disclosure.

The present disclosure describes, in part, both techniques and processes for configuring light emitters, and techniques and processes for controlling the light emitters. For example, a user may install light emitters around an environment, such as around the property surrounding his or her home. A light emitter may include any device that includes a light source that is capable of emitting light. For example, a light source may include, but is not limited to, a light bulb, a lamp, a laser, a light emitting diode (LED), and/or any other source that is capable of emitting light. As described herein, activating a light emitter may include changing a state of the light source from an off state to an on state. For example, activating the light emitter may include providing power to the light source in order to cause the light source to emit light. Furthermore, deactivating a light emitter may include changing a state of the light emitter from an on state to an off state. For example, deactivating the light emitter may include ceasing from providing power to the light source in order to cause the light source to stop emitting light. Moreover, changing an activation state of a light emitter may include changing the type of light that is output by the light emitter. For example, changing the activation state of the light emitter may include causing the light emitter, which is operating using a first activation type, where the light source is powered on to emit light at a first intensity, first color, first brightness, first pattern (e.g., constant light, flickering, pulsating, chirping, etc.), and/or the like, to operate using a second activation type, where the light source is powered on to emit light at a second intensity, second color, second brightness, second pattern, and/or the like.

After installing the light emitters, the user may use a client device to configure the light emitters during a configuration process. For a first example of configuration of the light emitters, the client device may receive, from at least one network device(s), first image data generated by an A/V device, where the first image data represents a field of view (FOV) of the A/V device. The client device may then display at least one first image(s) represented by the first image data, where the first image(s) represent the light emitters located in the FOV of the A/V device. While displaying the first image(s), the client device may receive, for one or more of the light emitters, an input indicating a portion of the first image(s) that represents the light emitter, where the portion of the first image(s) corresponds to a portion of the FOV of the A/V device. Additionally, the client device may receive an input indicating an identifier of the light emitter. The client device may then store data (referred to, in this example, as "association data") that associates the portion of the FOV of the A/V device (and/or the portion of the first image(s), and/or the portion of the display) that represents the light emitter with the identifier of the light emitter. Additionally, the client device may transmit the association data to the network device(s). The client device may then perform a similar process for one or more of the other light emitters.

In some examples, when configurating the light emitters using such a process, the client device may further receive, from the network device(s), data (referred to, in this example, as "indication data") indicating portions of the first image(s) that represent potential light emitters, where each of the portions of the first image(s) corresponds to a respective portion of the FOV of the A/V device. The network device(s) may have determined the portions by analyzing the first image(s) using one or more computer vision and/or image processing techniques. The client device may then display interface elements located at the portions of the first image(s) that represent the potential light emitters. While displaying the first image(s), the client device may receive, for one or more of the light emitters, an input selecting an interface element and an input indicating an identifier of the light emitter. The client device may then store association data that associates the portion of the FOV of the A/V device (and/or the portion of the first image(s), and/or the portion of the display) that represents the light emitter with the identifier of the light emitter. Additionally, the client device may transmit the association data to the network device(s). The client device may then perform a similar process for one or more of the other light emitters.

For a second example of configurating the light emitters, and for one or more of the light emitters, the client device may display a message instructing the user to place the client device within a threshold distance to the light emitter. The threshold distance may include, but is not limited to, six inches, one foot, two feet, five feet, and/or any other distance. While the client device is located within the threshold distance, the network device(s) may receive, from the client device, data (referred to, in this example, as "location data") indicating a geographic location of the client device. The geographic location may include, but is not limited to, global navigation satellite system (GNSS) coordinates, global positioning systems (GPS) coordinates, and/or the like. The network device(s) may then store data that associates the identifier of the light emitter with the geographic location. Additionally, the network device(s) may perform a similar process for each of the other light emitters.

In some examples, the network device(s) and/or the client device may further group the light emitters. For a first example, the network device(s) and/or the client device may group each of the light emitters that are located within the FOV of the A/V device into a group. For a second example, the client device may display a message instructing the user to move past the light emitters that the user wants included in a group. The network device(s) and/or the client device may then receive data (referred to, in this example, as "motion data") generated by one or more of the light emitters, where the motion data indicates that the light emitters detected an object (and/or motion). Based on the motion data, the network device(s) and/or the client device may group the light emitters together. In some examples, when grouping light emitters based on motion data, the network device(s) and/or the client device may further receive motion data and/or image data generated by another electronic device, such as an A/V device, where the motion data and/or the image data indicates that the electronic device detected the object (and/or the motion). The network device(s) and/or the client device may then group the electronic device with the light emitters.

After configurating the light emitters, the client device may provide a GUI for controlling the operation of the light emitters. For a first example of controlling the light emitters, the client device may receive second image data generated by the A/V device. The client device may then display at least one second image(s) represented by the second image data, where the second image(s) represent the light emitters located within the FOV of the A/V device. In some examples, the client device may cause, using the association data, interface elements to be located over portions of the second image(s), where each interface element is associated with a respective light emitter. In some examples, the client device retrieves the association data from a local memory. Additionally, or alternatively, in some examples, the client device receives the association data from the network device(s).

The client device may then receive an input selecting a portion of the second image(s) that represents a light emitter (and/or an interface element associated with the light emitter). Based on the input, the client device may transmit, to the network device(s), data (referred to, in this example, as "command data") indicating the identifier of the light emitter and a command to activate the light emitter. The network device(s) may receive the command data and, in response, transmit a control signal (e.g., a data packet) to the light emitter, where the control signal causes the light emitter to activate. In some examples, the client device may then receive third image data generated by the A/V device. The client device may then display third image(s) represented by the third image data, where the third image(s) represent the light emitter in the on state. As such, the user is able to use the client device to determine that the light emitter has been activated. In some examples, if a light emitter is already activated, the client device may perform a similar process to deactivate the light emitter.

For instance, the client device may receive fourth image data generated by the A/V device. The client device may then display fourth image(s) represented by the fourth image data, where the fourth image(s) represent the light emitters located within the FOV of the A/V device. In some examples, the client device may cause, using the association data, interface elements to be located over portions of the fourth image(s), where each interface element is associated with a respective light emitter. The client device may then receive an input selecting a portion of the fourth image(s) that represents a light emitter (and/or an interface element associated with the light emitter). Based on the input, the client device may transmit, to the network device(s), control data indicating the identifier of the light emitter and a command to deactivate the light emitter. The network device(s) may receive the control data and, in response, transmit a control signal (e.g., a data packet) to the light emitter, where the control signal causes the light emitter to deactivate.

For a second example of controlling the light emitters, the client device may receive data representing a schematic representation of the environment, where the schematic representation of the environment includes interface elements located at the geographic locations of the light emitters. The client device may then display the schematic representation. While displaying the schematic representation, the client device may receive an input selecting an interface element located at a geographic location of a light emitter. Based on the input, the client device may transmit, to the network device(s), control data indicating the selection of the interface element (and/or indicating the identifier of the light emitter and a command to activate the light emitter). The network device(s) may receive the control data and, in response, transmit a control signal (e.g., a data packet) to the light emitter, where the control signal causes the light emitter to activate.

In some examples, the network device(s) may further use the groupings when activating light emitters. For a first example, based on receiving control data associated with activating a first light emitter, the network device(s) may determine that the first light emitter is associated with (e.g., grouped with) at least a second light emitter. The network device(s) may then transmit a control signal (e.g., data packet) to the second light emitter that causes the second light emitter to activate. For a second example, the network device(s) may receive motion data generated by a first light emitter, where the motion data indicates that the first light emitter detected an object (and/or motion). Based on the motion data, the network device(s) may determine that the first light emitter is associated with (e.g., grouped with) at least a second light emitter. The network device(s) may then transmit a control signal (e.g., a data packet) to the second light emitter that causes the second light emitter to activate.

Additionally, in some examples, the network device(s) may use the groupings of the light emitters to activate the A/V device. For example, the network device(s) may receive motion data from a light emitter, where the motion data indicates that the light emitter detected an object (and/or motion). Based on the motion data, the network device(s) may determine that the light emitter is associated with (e.g., grouped with) the A/V device. The network device(s) may then transmit a control signal (e.g., a data packet) to the A/V device that causes the A/V device to begin generating and/or transmitting image data. In some examples, when determining to activate the A/V device based on an object being detected by the light emitters that are grouped with the A/V device, the network device(s) may activate the A/V device based on at least one given light emitter(s) detecting the object. For example, the network device(s) may determine to activate the A/V device when receiving motion data that is generated by a first light emitter, but determine to refrain from activating the A/V device when receiving motion data generated by a second light emitter.

In some examples, in addition to, or alternatively from, associating portions of the FOV of the A/V device with light emitters and then controlling the light emitters using image data, the network device(s) and/or the client device may associate a portion of the FOV with an electronic device (e.g., a transformer, a light switch, etc.) that controls the light emitters, using similar processes as described above. The client device may then display image(s) represented by image data that is generated by the A/V device, where the image(s) represent the electronic device. While displaying the image(s), the client device may receive an input selecting the portion of the FOV (and/or an interface element associated with the electronic device) and, in response, transmit control data indicating the selection to the network device(s). The network device(s) may then cause one or more light emitters that are controlled by the electronic device to activate/deactivate.

In some examples, one or more of the light emitters may include a respective camera. In such examples, while displaying image(s) represented by the image data that is generated by the A/V device, the client device may receive an input selecting a portion of the FOV of the A/V device that represents a light emitter that includes a camera. The network device(s) may then cause the light emitter to active the camera to generate additional image data and/or cause the light emitter to transmit the additional image data to the network device(s). For example, the network device(s) may transmit, to the light emitter, data that represents an identifier of the light emitter and a command to activate the camera and/or a command to transmit the additional image data. Additionally, based on receiving another input selecting the portion of the FOV that represents the light emitter, the network device(s) may cause the light emitter to deactivate the camera and/or cease from transmitting the additional image data to the network device(s). For example, the network device(s) may transmit, to the light emitter, data that represents the identifier of the light emitter and a command to deactivate the camera and/or a command to cease from transmitting the additional image data.

In some examples, the processes and/or techniques described above may be used for controlling other types of devices. For example, the network device(s) and/or the client device may associate a portion of the FOV with an automation device, such as a (smart) door lock. The client device may then display image(s) represented by image data that is generated by the A/V device, where the image(s) represent the door lock. While displaying the image(s), the client device may receive an input selecting the portion of the FOV (and/or an interface element associated with the door lock) and, in response, transmit control data indicating the selection to the network device(s). The network device(s) may then cause the door lock to unlock an entrance (e.g., if the door lock is currently in a locked position) or cause the door lock to lock the entrance (e.g., if the door lock is currently in an unlocked position).

The remaining detailed description describes the present embodiments with reference to the drawings. In the drawings, reference numbers label elements of the present embodiments. These reference numbers are reproduced below in connection with the discussion of the corresponding drawing features.

Figure 1B:
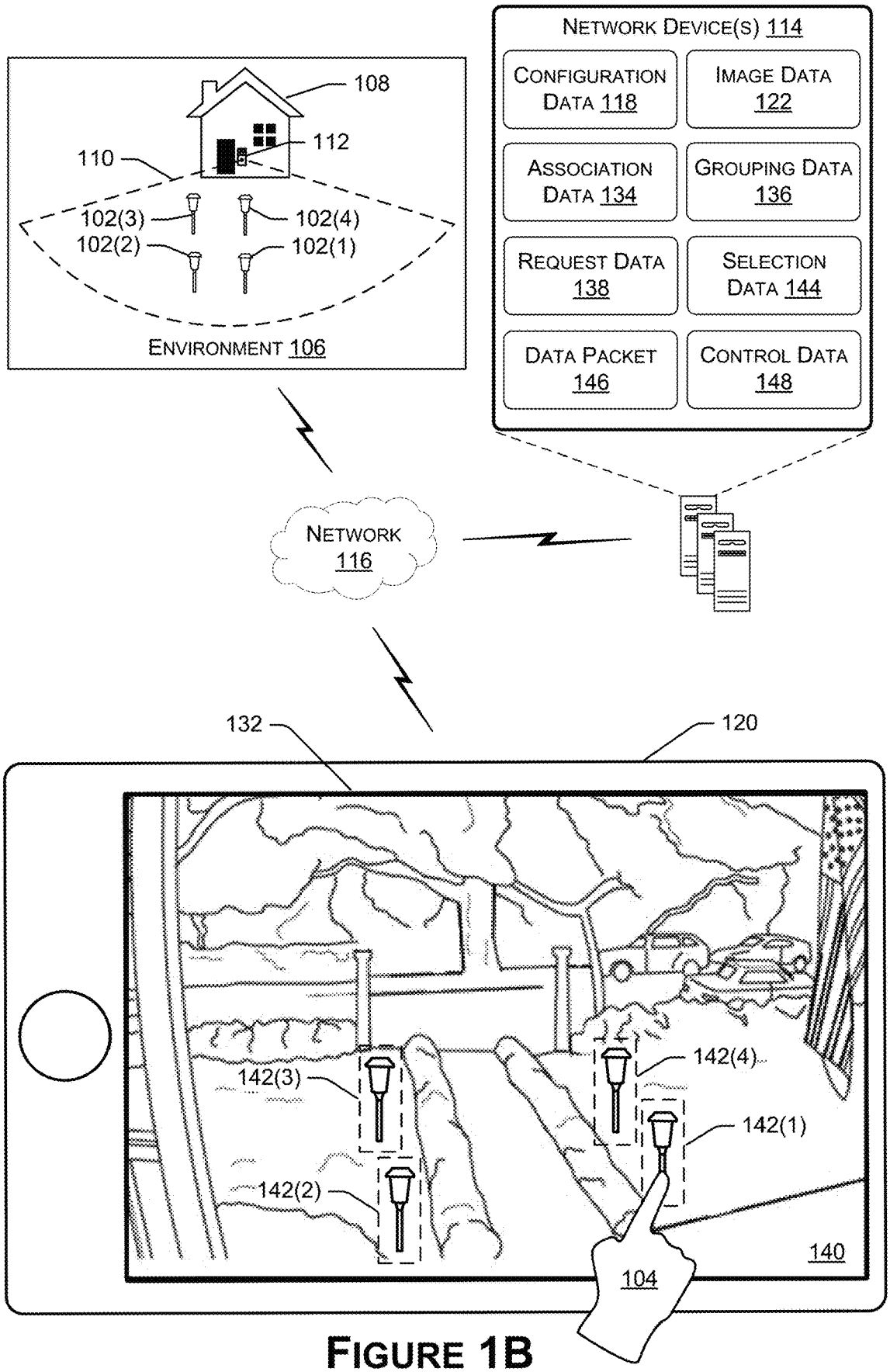

FIGS. 1A-1B are schematic diagrams illustrating examples of configuring light emitters 102(1)-(4) and then using a graphical user interface to control the light emitters 102(1)-(4), according to various aspects of the present disclosure. For example, a user 104 may have installed the light emitters 102(1)-(4) at an environment 106 (e.g., around the property surrounding the user's home 108). As shown, each of the light emitters 102(1)-(4) is located within a field of view (FOV) 110 of an A/V device 112. After installing the light emitters 102(1)-(4), at least one network device(s) 114 may receive, over a network 116, data (e.g., configuration data 118) from a client device 120, where the configuration data 118 indicates a request to configure the light emitters 102(1)-(4). Based on the configuration data 118, the network device(s) 114 may transmit, over the network 116 and to the client device 120, image data 122 (referred to, in these examples, as "first image data 122") generated by the A/V device 112.

The client device 120 may receive the first image data 122 from the network device(s) 114. The client device 120 may then display a GUI that includes image(s) 124 represented by the first image data 122, where the image(s) 124 represent the light emitters 102(1)-(4). Additionally, the GUI may include a list of identifiers 126 associated with the light emitters 102(1)-(4) that are to be configured by the user 104. While displaying the image(s) 124, and for one or more of the light emitters 102(1)-(4), the client device 120 may receive an input selecting a respective portion 128(1)-(4) of the image(s) 124 that represents the respective light emitter 102(1)-(4). For example, and as illustrated in FIG. 1A, the client device 120 may receive an input from the user 104, where the input corresponds to a selection of a first portion 128(1) of the image(s) 124 that represent the first light emitter 102(1). In some examples, the input may correspond to the user 104 drawing a shape around the portion 128(1) of the image(s) 124 that represents the first light emitter 102(1). The shape may include, but is not limited to, a circle, a triangle, a square, a rectangle, a pentagon, and/or any other shape, including irregular polygons and open polygons.

Additionally, the client device 120 may receive an input selecting a first identifier 128(1) associated with the first light emitter 102(1) (which may be indicated by the graphical element around the first identifier 130(1) in the example of FIG. 1A). Each identifier 130(1)-(4) may include, but is not limited to, an Internet Protocol (IP) address, a media access control (MAC) address, a numerical identifier, an alphabetic identifier, a mixed numerical and alphabetic identifier, and/or any other type of identifier that may be used to identify the respective light emitter 102(1)-(4). In some examples, the client device 120 may then store data that associates a portion (which may be represented by the first portion 128(1)) of the FOV 110 of the A/V device 112 (and/or the first portion 128(1) of the image(s) 124, and/or a portion of the display of the client device 120) that represents the first light emitter 102(1) with the first identifier 130(1) of the first light emitter 102(1). Additionally, or alternatively, in some examples, the client device 120 may transmit, over the network 116 and to the network device(s) 114, data (e.g., association data 134) indicating that the portion of the FOV 110 of the A/V device 112 (and/or the first portion 128(1) of the image(s) 124, and/or the portion of the display 132) that represents the first light emitter 102(1) is associated with the first identifier 130(1) of the first light emitter 102(1). The client device 120 may then perform a similar process for one or more of the other light emitters 102(2)-(4).

In some examples, when configuring the light emitters 102(1)-(4) using such a process, the client device 120 may first receive, over the network 116 and from the network device(s) 114, data indicating the portions 128(1)-(4) of the image(s) 124 that represent potential light emitters. The network device(s) 114 may have determined the portions 128(1)-(4) by analyzing the image(s) 124 using one or more computer vision and/or image processing techniques. The client device 120 may then display interface elements (which may also be represented by the rectangles in FIG. 1A) over the portions 128(1)-(4) of the image(s) 124 that represent the potential light emitters. In such examples, while displaying the image(s) 124, the client device 120 may receive an input selecting an interface element and an input selecting the identifier 130(1) of the first light emitter 102(1). In some examples, the client device may then store data that associates the portion of the FOV 110 of the A/V device 112 (and/or the first portion 128(1) of the image(s) 124, and/or the portion of the display 132 of the client device 120) that represents the first light emitter 102(1) with the first identifier 130(1) of the first light emitter 102(1). Additionally, or alternatively, in some examples, the client device 120 may transmit, over the network 116 and to the network device(s) 114, the association data 134 indicating that the portion of the FOV 110 of the A/V device 112 (and/or the first portion 128(1) of the image(s) 124, and/or the portion of the display 132) that represents the first light emitter 102(1) is associated with the first identifier 130(1) of the first light emitter 102(1). The client device 120 may then perform a similar process for one or more of the other light emitters 102(2)-(4).

In some examples, such as after configuring the light emitters 102(1)-(4), the network device(s) 114 and/or the client device 120 may group the light emitters 102(1)-(4) located within the FOV 110 of the A/V device 112. For example, the network device(s) 114 and/or the client device 120 may determine that one or more of the light emitters 102(1)-(4) are located within the FOV 110 of the A/V device 112. The network device(s) 114 and/or the client device 120 may then store data (e.g., grouping data 136) indicating that one or more of the light emitters 102(1)-(4) is included in a group of light emitters (and/or one or more of the light emitters 102(1)-(4) is associated with the A/V device 112, and/or one or more of the light emitters 102(1)-(4) is located within the FOV 110 of the A/V device 112).

In some examples, the client device 120 and/or the network device(s) 114 may then use the association data 134 to control the light emitters 102(1)-(4). For example, and as illustrated in FIG. 1B, the network devices(s) 114 may transmit, over the network 116, image data 122 (referred to, in these examples, as "second image data 122") to the client device 120. In some examples, the network device(s) 114 may transmit the second image data 122 based at least in part on receiving, over the network 116, data (e.g., request data 138) from the client device 120, where the request data 138 indicates a request to operate the light emitters 102(1)-(4). In some examples, the network device(s) 114 may transmit the second image data 122 based at least in part on determining that the A/V device 112 detected an object (and/or motion). In some examples, the network device(s) 114 may transmit the second image data 122 based on a current time. For example, the current time may be associated with a sunset at a geographic location of the environment 106. Still, in some examples, the network device(s) 114 may transmit the second image data 122 based at least in part on receiving, over the network 116, data from the A/V device 112 (and/or one of the light emitters 102(1)-(4)), where the data indicates that an amount of ambient light is below a threshold amount of ambient light.

The client device 120 may receive the second image data 122 and display image(s) 140 represented by the second image data 122. In some examples, the client device 120 may then use the association data 134 (which the client device 120 may receive from the network device(s) 114 and/or retrieve from a local memory) to cause interface elements 142(1)-(4) to be located at the portions of the FOV of the A/V device 112 that represent the light emitters 102(1)-(4) (which, as discussed herein, may correspond to the portions 128(1)-(4) of the image(s) 124 and/or the portions of the display 132 that represent the light emitters 102(1)-(4)). The interface elements 142(1)-(4) may be associated with controlling the light emitters 102(1)-(4). For example, the first interface element 142(1) may be associated with activating/deactivating the first light emitter 102(1), the second interface element 142(2) may be associated with activating/deactivating the second light emitter 102(2), the third interface element 142(3) may be associated with activating/deactivating the third light emitter 102(3), and the fourth interface element 142(4) may be associated with activating/deactivating the fourth light emitter 102(4).

For example, and as illustrated in FIG. 1B, the client device 120 may receive an input selecting the first interface element 142(1). In some examples, based on the input, the client device 120 may transmit, over the network 116, data (e.g., selection data 144) to the network device(s) 114, where the selection data 144 indicates the selection of the first interface element 142(1). The network device(s) 114 may receive the selection data 144 and determine that the first interface element 142(1) is associated with the first light emitter 102(1). Based on the determination, the network device(s) 114 may generate a data packet 146 that includes data representing the first identifier 130(1) of the first light emitter 102(1) and data representing a command for the first light emitter 102(1) to activate (if the first light emitter 102(1) is deactivated) or data representing a command for the first light emitter 102(1) to deactivate (if the first light emitter 102(1) is activated). The network device(s) 114 may then transmit, over the network 116, the data packet 146 to the first light emitter 102(1) (which may be via another electronic device).

Additionally, or alternatively, in some examples, based on the input, the client device 120 may determine that the first interface element 142 is associated with the first light emitter 102(1). The client device 120 may then transmit, over the network 116, data (e.g., control data 148) to the network device(s) 114, where the control data 148 indicates the first identifier 130(1) of the first light emitter 102(1) and a command to activate (e.g., if the first light emitter 102(1) is deactivated) or a command to deactivate (e.g., if the first light emitter 102(1) is activated). The network device(s) 114 may receive the control data 148. Based on the control data 148, the network device(s) 114 may generate a data packet 146 that includes data representing the first identifier 130(1) of the first light emitter 102(1) and data representing a command for the first light emitter 102(1) to activate (if the first light emitter 102(1) is deactivated) or data representing a command for the first light emitter 102(1) to deactivate (if the first light emitter 102(1) is activated). The network device(s) 114 may then transmit, over the network 116, the data packet 146 to the first light emitter 102(1) (which may be via another electronic device).

In some examples, such as when the client device 120 does not cause the interface elements 142(1)-(4) to be located on the image(s) 140, the input from the user may include a selection of a portion of the image(s) 140. In some examples, based on the input, the client device 120 may transmit, over the network 116, data (e.g., selection data 144) to the network device(s) 114, where the selection data 144 indicates the portion of the image(s) 140 selected by the user. The network device(s) 114 may receive the selection data 144 and determine that the portion of the image(s) 140 is associated with the first light emitter 102(1). For a first example, and using the association data 134, the network device(s) 114 may determine that the portion of the image(s) 140 corresponds to the portion 128(1) of the image(s) 124. For a second example, and again using the association data 134, the network device(s) 114 may determine that the portion of the image(s) 140 corresponds to the portion of the FOV 110 of the A/V device 112 that is associated with the first light emitter 102(1). In either example, based on the determination, the network device(s) 114 may generate a data packet 146 that includes data representing the first identifier 130(1) of the first light emitter 102(1) and data representing a command for the first light emitter 102(1) to activate (if the first light emitter 102(1) is deactivated) or data representing a command for the first light emitter 102(1) to deactivate (if the first light emitter 102(1) is activated). The network device(s) 114 may then transmit, over the network 116, the data packet 146 to the first light emitter 102(1) (which may be via another electronic device).

Additionally, or alternatively, in some examples, based on the input, the client device 120 may determine that the portion of the image(s) 140 is associated with the first light emitter 102(1), using similar processes as discussed above with regard to the network device(s) 114. The client device 120 may then transmit, over the network 116, data (e.g., control data 148) to the network device(s) 114, where the control data 148 indicates the first identifier 130(1) of the first light emitter 102(1) and a command to activate (e.g., if the first light emitter 102(1) is deactivated) or a command to deactivate (e.g., if the first light emitter 102(1) is activated). The network device(s) 114 may receive the control data 148. Based on the control data 148, the network device(s) 114 may generate a data packet 146 that includes data representing the first identifier 130(1) of the first light emitter 102(1) and data representing a command for the first light emitter 102(1) to activate (if the first light emitter 102(1) is deactivated) or data representing a command for the first light emitter 102(1) to deactivate (if the first light emitter 102(1) is activated). The network device(s) 114 may then transmit, over the network 116, the data packet 146 to the first light emitter 102(1) (which may be via another electronic device).

The remaining detailed description describes the present embodiments with reference to the drawings. In the drawings, reference numbers label elements of the present embodiments. These reference numbers are reproduced below in connection with the discussion of the corresponding drawing features.

Figure 2:
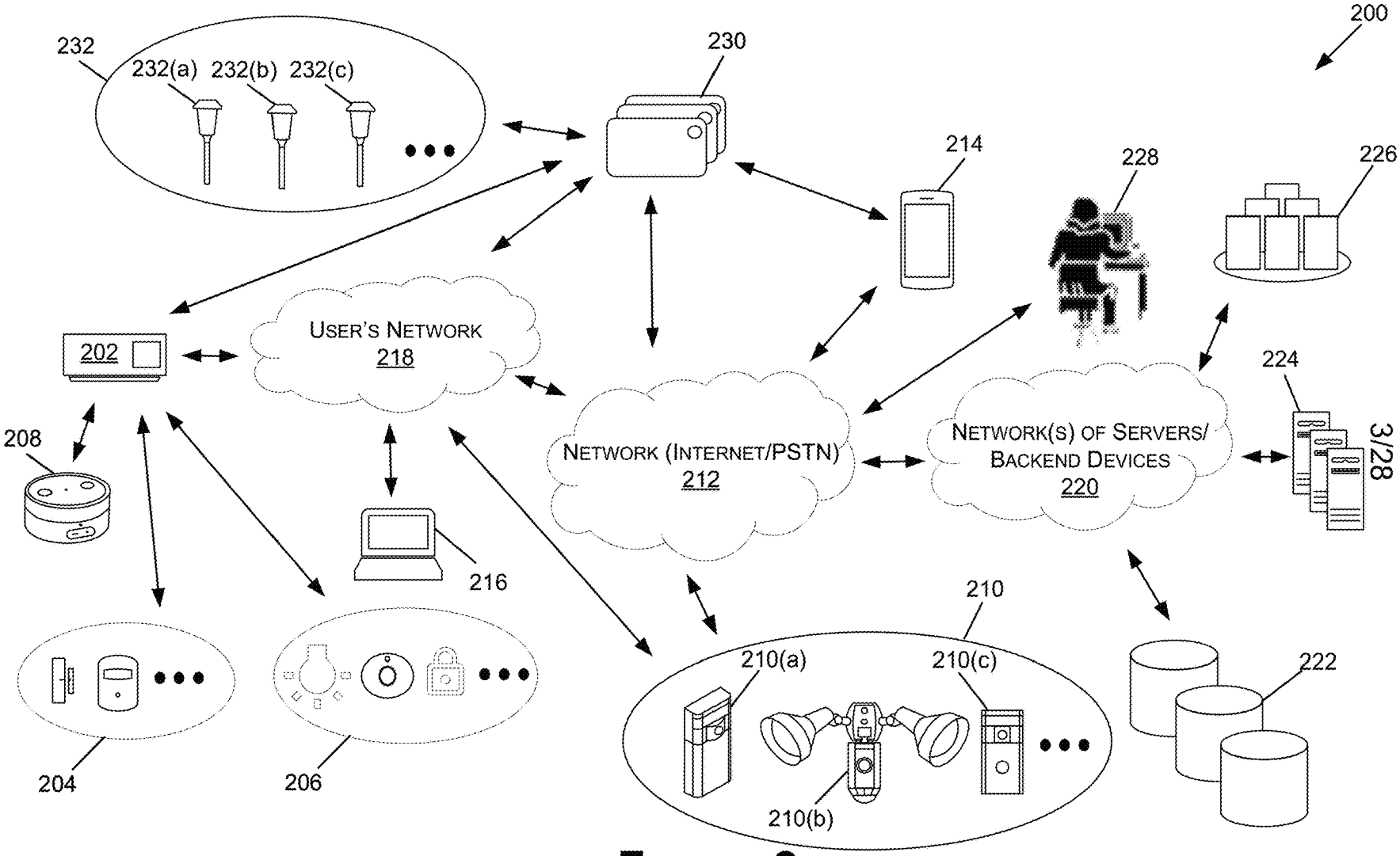
FIG. 2 is a functional block diagram illustrating a system for communicating in a network, according to various aspects of the present disclosure.

FIG. 2 is a functional block diagram illustrating a system 200 for communicating in a network according to various aspects of the present disclosure. Home automation, or smart home, is building automation for the home. Home automation enable users (e.g., homeowners and authorized individuals) to control and/or automate various devices and/or systems, such as lighting, heating (e.g., smart thermostats), ventilation, home entertainment, air conditioning (HVAC), blinds/shades, security devices (e.g., contact sensors, smoke/CO detectors, motion sensors, etc.), washers/dryers, ovens, refrigerators/freezers, and/or other network connected devices suitable for use in the home. In various embodiments, Wi-Fi is used for remote monitoring and control of such devices and/or systems. Smart home devices (e.g., hub devices 202, sensors 204, automation devices 206, a virtual assistant (VA) device 208, Audio/Video (A/V) recording and communication devices 210, electronic device(s) 230 (although only one is shown for clarity reasons), light emitters 232, when remotely monitored and controlled via a network (Internet/a public switched telephone network (PSTN)) 212, may be considered to be components of the "Internet of Things." Smart home systems may include switches and/or sensors (e.g., the sensors 204) connected to a central hub such as the smart-home hub device 202 and/or the VA device 208 (the hub device 202 and/or the VA device 208 may alternatively be referred to as a gateway, a controller, a home-automation hub, or an intelligent personal assistance device) from which the system 200 may be controlled through various user interfaces, such as voice commands and/or a touchscreen. Various examples, of user interfaces may include any or all of a wall-mounted terminal (e.g., a keypad, a touchscreen, etc.), software installed on the client devices 214, 216 (e.g., a mobile application), a tablet computer, or a web interface. Furthermore, these user interfaces are often but not always supported by Internet cloud services. In one example, the Internet cloud services are responsible for obtaining user input via the user interfaces (e.g., a user interface of the hub device 202 and/or the VA device 208) and causing the smart home devices (e.g., the sensors 204, the automation devices 206, etc.) to perform an operation in response to the user input.

The hub device 202, the VA device 208, the sensors 204, the automation devices 206, the A/V recording and communication devices 210, the electronic device(s) 230, the light emitters 232, and/or client devices 214, 216 may use one or more wired and/or wireless communication protocols to communicate, including, for example and without limitation, Wi-Fi (e.g., the user's network 218), X10, Ethernet, RS-485, 6LoWPAN, Bluetooth LE (BLE), ZigBee, Z-Wave, and/or a low power wide-area networks (LPWAN), such as a chirp spread spectrum (CSS) modulation technology network (e.g., LoRaWAN), an Ultra Narrow Band modulation technology network (e.g., Sigfox, Telensa, NB-IoT, etc.), RingNet, and/or the like.

The user's network 218 may be, for example, a wired and/or wireless network. If the user's network 218 is wireless, or includes a wireless component, the user's network 218 may be a Wi-Fi network compatible with the IEEE 802.11 standard and/or other wireless communication standard(s). Furthermore, the user's network 218 may be connected to other networks such as the network 212, which may comprise, for example, the Internet and/or PSTN.

The system 200 may include one or more A/V recording and communication devices 210 (alternatively be referred to herein as "A/V devices 210" or "A/V device 210") (which may represent, and/or be similar to, the A/V device 112). The A/V devices 210 may include security cameras 210(*a*), light cameras 210(*b*) (e.g., floodlight cameras, spotlight cameras, etc.), A/V doorbells 210(*c*) (e.g., wall powered and/or battery powered A/V doorbells), and/or other devices capable of recording audio data and/or image data. The A/V devices 210 may be configured to access a user's network 218 to connect to a network (Internet/PSTN) 212 and/or may be configured to access a cellular network to connect to the network (Internet/PSTN) 212.

The system 200 may further include a smart-home hub device 202 connected to the user's network 218 and/or the network (Internet/PSTN) 212. The smart-home hub device 202 (also known as a home automation hub, gateway device, or network device(s)), may comprise any device that facilitates communication with and control of the sensors 204, automation devices 206, the VA device 208, the electronic device(s) 230, the light emitters 232, and/or the one or more A/V devices 210. For example, the smart-home hub device 202 may be a component of a security system and/or a home automation system installed at a location (e.g., a property, a premise, a home, a business, etc.). In some embodiments, the A/V devices 210, the VA device 208, the sensors 204, the electronic device(s) 230, the light emitters 232, and/or the automation devices 206 communicate with the smart-home hub device 202 directly and/or indirectly using one or more wireless and/or wired communication protocols (e.g., BLE, Zigbee, Z-Wave, etc.), the user's network 218 (e.g., Wi-Fi, Ethernet, etc.), and/or the network (Internet/PSTN) 212. In some of the present embodiments, the A/V devices 210, the VA device 208, the sensors 204, the electronic device(s) 230, the light emitters 232, and/or the automation devices 206 may, in addition to or in lieu of communicating with the smart-home hub device 202, communicate with the client devices 214, 216, the VA device 208, and/or one or more of components of the network of servers/backend devices 220 directly and/or indirectly via the user's network 218 and/or the network (Internet/PSTN) 212.

As illustrated in FIG. 2, the system 200 includes the VA device 208. The VA device 208 may be connected to the user's network 218 and/or the network (Internet/PSTN) 212. The VA device 208 may include an intelligent personal assistant, such as, without limitation, Amazon Alexa® and/or Apple Siri®. For example, the VA device 208 may be configured to receive voice commands, process the voice commands to determine one or more actions and/or responses (e.g., transmit the voice commands to the one or more components of the network of servers/backend devices 220 for processing), and perform the one or more actions and/or responses, such as to activate and/or change the status of one or more of the sensors 204, automation devices 206, the electronic device(s) 230, the light emitters 232, or the A/V devices 210. In some embodiments, the VA device 208 is configured to process user inputs (e.g., voice commands) without transmitting information to the network of servers/backend devices 220 for processing. The VA device 208 may include at least one speaker (e.g., for playing music, for outputting the audio data generated by the A/V devices 210, for outputting the voice of a digital assistant, etc.), at least one a microphone (e.g., for receiving commands, for recording audio data, etc.), and a display (e.g., for displaying a user interface, for displaying the image data generated by the A/V devices 210, etc.). In various embodiments, the VA device 208 may include an array of speakers that are able to produce beams of sound.

Although illustrated as a separate component in FIG. 2, in some embodiments the VA device 208 may not be a separate component from the hub device 202. In such embodiments, the hub device 202 may include the functionality of the VA device 208 or the VA device 208 may include the functionality of the hub device 202.

The VA device 208, the hub device 202, and/or the combination thereof may be configured to communicate with the A/V devices 210 in response to inputs (e.g., voice inputs, touch inputs, etc.) from users. For example, the VA device 208, the hub device 202, and/or the combination thereof may receive an input indicating a request to turn on the exterior lights (e.g., the light emitter(s) 232). The VA device 208, the hub device 202, and/or the combination thereof may then generate and transmit data representative of the input to the A/V device(s) 210 over the first network. In some examples, the data representative of the input is transmitted to the A/V device(s) 210 over the first network and/or the network (Internet/PSTN) 212 via the backend server(s) 224. In other examples, the data representative of the input is transmitted directly to the A/V device(s) 210 over the first network.

The one or more sensors 204 may include, for example, at least one of a door sensor, a window sensor, a contact sensor, a tilt sensor, a temperature sensor, a carbon monoxide sensor, a smoke detector, a light sensor, a glass break sensor, a freeze sensor, a flood sensor, a moisture sensor, a motion sensor, and/or other sensors that may provide the user/owner of the security system a notification of a security event at his or her property.

The one or more automation devices 206 may include, for example, at least one of an outdoor lighting system, an indoor lighting system, and indoor/outdoor lighting system, a temperature control system (e.g., a thermostat), a shade/blind control system, a locking control system (e.g., door lock, window lock, etc.), a home entertainment automation system (e.g., TV control, sound system control, etc.), an irrigation control system, a wireless signal range extender (e.g., a Wi-Fi range extender, a Z-Wave range extender, etc.) a doorbell chime, a barrier control device (e.g., an automated door hinge), a smart doormat, and/or other automation devices. In some examples, the electronic device(s) 230 and/or the light emitters 232 may be considered automation devices and/or may be considered part of an automation device or system (e.g., an outdoor lighting system, an indoor lighting system, and indoor/outdoor lighting system, etc.).

As described herein, in some of the present embodiments, some or all of the client devices 214, 216, the A/V device(s) 210, the smart-home hub device 202, the VA device 208, the sensors 204, the automation devices 206, the electronic device(s) 230, and the light emitters 232, may be referred to as a security system and/or a home-automation system. The security system and/or home-automation system may be installed at location, such as a property, home, business, or premises for the purpose of securing and/or automating all or a portion of the location.

The system 200 may further include one or more client devices 214, 216 (which may represent, and/or be similar to, the client device 120). The client devices 214, 216 may communicate with and/or be associated with (e.g., capable of access to and control of) the A/V devices 210, a smart-home hub device 202, the VA device 208, sensors 204, automation devices 206, the electronic device(s) 230, and/or the light emitters 232. In various embodiments, the client devices 214, 216 communicate with other devices using one or more wireless and/or wired communication protocols, the user's network, and/or the network (Internet/PSTN) 212, as described herein. The client devices 214, 216 may comprise, for example, a mobile device such as a smartphone or a personal digital assistant (PDA), or a computing device such as a tablet computer, a laptop computer, a desktop computer, etc. In some embodiments, the client devices 214, 216 includes a connected device, such as a smart watch, Bluetooth headphones, another wearable device, or the like. In such embodiments, the client devices 214, 216 may include a combination of the smartphone or other device and a connected device (e.g., a wearable device), such that alerts, data, and/or information received by the smartphone or other device are provided to the connected device, and one or more controls of the smartphone or other device may be input using the connected device (e.g., by touch, voice, etc.).

The A/V devices 210, the hub device 202, the VA device 208, the automation devices 206, the sensors 204, the electronic device(s) 230, the light emitters 232, and/or the client devices 214, 216 may also communicate, via the user's network 218 and/or the network (Internet/PSTN) 212, with network(s) of servers and/or backend devices 220, such as (but not limited to) one or more remote storage devices 222 (may be referred to interchangeably as "cloud storage device(s)"), one or more backend server(s)s 224, and one or more backend application programming interfaces (APIs) 226. While FIG. 2 illustrates the storage device 222, the backend server(s) 224, and the backend API 226 as components separate from the network 220, it is to be understood that the storage device 222, the backend server(s) 224, and/or the backend API 226 may be considered to be components of the network 220. For example, the network 220 may include a data center with a plurality of computing resources used to implement the storage device 222, the backend server(s) 224, and the backend API 226.

The backend server(s) 224 may comprise a computer program or other computer executable code that, when executed by processor(s) of the backend server(s) 224, causes the backend server(s) 224 to wait for requests from other computer systems or software (clients) and provide responses. In an embodiment, the backend server(s) 224 shares data and/or hardware and/or software resources among the client devices 214, 216. This architecture is called the client-server model. The client devices 214, 216 may run on the same computer or may connect to the backend server(s) 224 over the network (Internet/PSTN) 212 and/or the network 220. Examples of computing servers include database servers, file servers, mail servers, print servers, web servers, game servers, and application servers. The term server may be construed broadly to include any computerized process that shares a resource to one or more client processes.

The backend API 226 may comprise, for example, a server (e.g. a real server, or a virtual machine, or a machine running in a cloud infrastructure as a service), or multiple servers networked together, exposing at least one API to clients. In various embodiments, the backend API 226 is provided by servers including various components such as an application server (e.g. software servers), a caching layer, a database layer, or other components suitable for implementing one or more APIs. The backend API 226 may, for example, comprise a plurality of applications, each of which communicate with one another using one or more public APIs. In some embodiments, the backend API 226 maintains user data and provides user management capabilities, thereby reducing the load (e.g., memory and processor consumption) of the client devices 214, 216.

In various embodiments, an API is a set of routines, protocols, and tools for building software and applications. Furthermore, the API may describe a software component in terms of its operations, inputs, outputs, and underlying types, defining functionalities that are independent of their respective implementations, which allows definitions and implementations to vary without compromising the interface. As such, the API may provide a programmer with access to a particular application's functionality without the need to modify the particular application.

The backend API 226 illustrated in FIG. 2 may further include one or more services (also referred to as network services). A network service is an application that provides data storage, manipulation, presentation, communication, and/or other capability. Network services are often implemented using a client-server architecture based on application-layer network protocols. Each service may be provided by a server component (e.g., the backend server(s) 224) running on one or more computers (such as a dedicated server computer offering multiple services) and accessed via a network by client components running on other devices (e.g., client devices 214, 216). However, the client and server components can both be run on the same machine. Clients and servers may have a user interface, and sometimes other hardware associated with them.

The network 220 may be any wireless network, any wired network, or a combination thereof, configured to operatively couple the above-mentioned modules, devices, components, and/or systems as illustrated in FIG. 2. For example, the network 220, the user's network 218, and/or the network (Internet PSTN) 212 may include one or more of the following: a PSTN (public switched telephone network), the Internet, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, a Digital Data Service (DDS) connection, a DSL (Digital Subscriber Line) connection, an Ethernet connection, an ISDN (Integrated Services Digital Network) line, a dial-up port such as a V.90, V.34, or V.34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), LTE, VoLTE, LoRaWAN, LPWAN, RPMA, LTE Cat-"X" (e.g. LTE Cat 1, LTE Cat 0, LTE CatM1, LTE Cat NB1), CDMA (Code Division Multiple Access), TDMA (Time Division Multiple Access), FDMA (Frequency Division Multiple Access), and/or OFDMA (Orthogonal Frequency Division Multiple Access) cellular phone networks, global navigation satellite system (GNSS), such as global positioning systems (GPS), CDPD (cellular digital packet data), RIM (Research in Motion, Limited) duplex paging network, Bluetooth radio, or an IEEE 802.11-based radio frequency network. The network can further include or interface with any one or more of the following: RS-232 serial connection, IEEE-4024 (Firewire) connection, Fibre Channel connection, IrDA (infrared) port, SCSI (Small Computer Systems Interface) connection, USB (Universal Serial Bus) connection, or other wired or wireless, digital or analog, interface or connection, mesh or Digi® networking.

With further reference to FIG. 2, the system 200 may also include a security monitoring service 228. The security monitoring service 228 may be operated by the same company that manufactures, sells, and/or distributes the A/V devices 210, the hub device 202, the VA device 208, the electronic device(s) 230, the light emitters 232, the sensors 204, and/or the automation devices 206. In other embodiments, the security monitoring service 228 may be operated by a third-party company (e.g., a different company than the one that manufactured, sold, and/or distributed the A/V devices 210, the hub device 202, the VA device 208, the electronic device(s) 230, the light emitters 232, the sensors 204, and/or the automation devices 206). In any of the present embodiments, the security monitoring service 228 may have control of at least some of the features and components of the security system and/or the home-automation system (e.g., the security monitoring service 228 may be able to arm and/or disarm the security system, lock and/or unlock doors, activate and/or deactivate one or more of the sensors 204 and/or the automation devices 206, turn on and off one or more of the light emitters 232, etc.). For example, the security monitoring service 228 may operate and control their own client devices and/or network of servers/backend devices for monitoring and/or controlling security systems. In such an example, the A/V devices 210, the hub device 202, the VA device 208, the electronic device(s) 230, the light emitters 232, the sensors 204, and/or the automation devices 206 may communicate with the client devices and/or one or more components of the network of servers/backend devices of the security monitoring service 228 over the network (Internet/PSTN) 212 (in some embodiments, via one or more of the components of the network of backend server(s)s/backend devices 220).

The system 200 may also include the electronic device(s) 230. The electronic device(s) 230 may be configured to control the light emitters 232 (which may represent, and/or be similar to, the light emitters 102(1)-(4)). For example, one or more of the electronic device(s) 230 may include, but is not limited to, a transformer, a light switch, a power source, a light controller, and/or any other type of device that is cable of controlling the light emitters 232. The light emitters 232 may include pathway lights, walkway lights, floodlights, spotlights, security lights, dome lights, entryway lights, garden lights, outdoor lights, indoor lights, landscape lighting, accent lighting, wall sconces, bullets, globes, and/or any other type of electronic device that includes a light source capable of emitting light.

In some examples, the light emitters 232 may include at least a first type of light emitter 232(1), a second type of light emitter 232(2), and a third type of light emitter 232(3). The first type of light emitters 232(1) may be configured to receive power from the electronic device(s) 230. To control the first type of light emitters 232(1), the electronic device(s) 230 may begin to provide power to the first type of light emitters 232(1) to activate (e.g., turn on, cause to emit light, etc.) the first type of light emitters 232(1) and cease providing the power the deactivate (e.g., turn off, cause to cease emitting the light, etc.) the first type of light emitters 232(1). Additionally, the second type of light emitters 232(2) may be configured to receive power from the electronic device(s) 230. To control the second type of light emitters 232(2), network device(s) may transmit first data to the second type of light emitters 232(2) that are configured to cause the second type of light emitters 232(2) to activate, and transmit second data to the second type of light emitters 232(2) that are configured to cause the second type of light emitters 232(2) to deactivate. Furthermore, the third type of light emitters 232(3) may be configured to receive power from a source that is external to the electronic device(s) 230, such as a battery. To control the third type of light emitters 232(3), network device(s) may transmit first data to the third type of light emitters 232(3) that are configured to cause the third type of light emitters 232(3) to activate, and transmit second data to the third type of light emitter 232(3) that are configured to cause the third type of light emitters 232(3) to deactivate.

Figure 3:
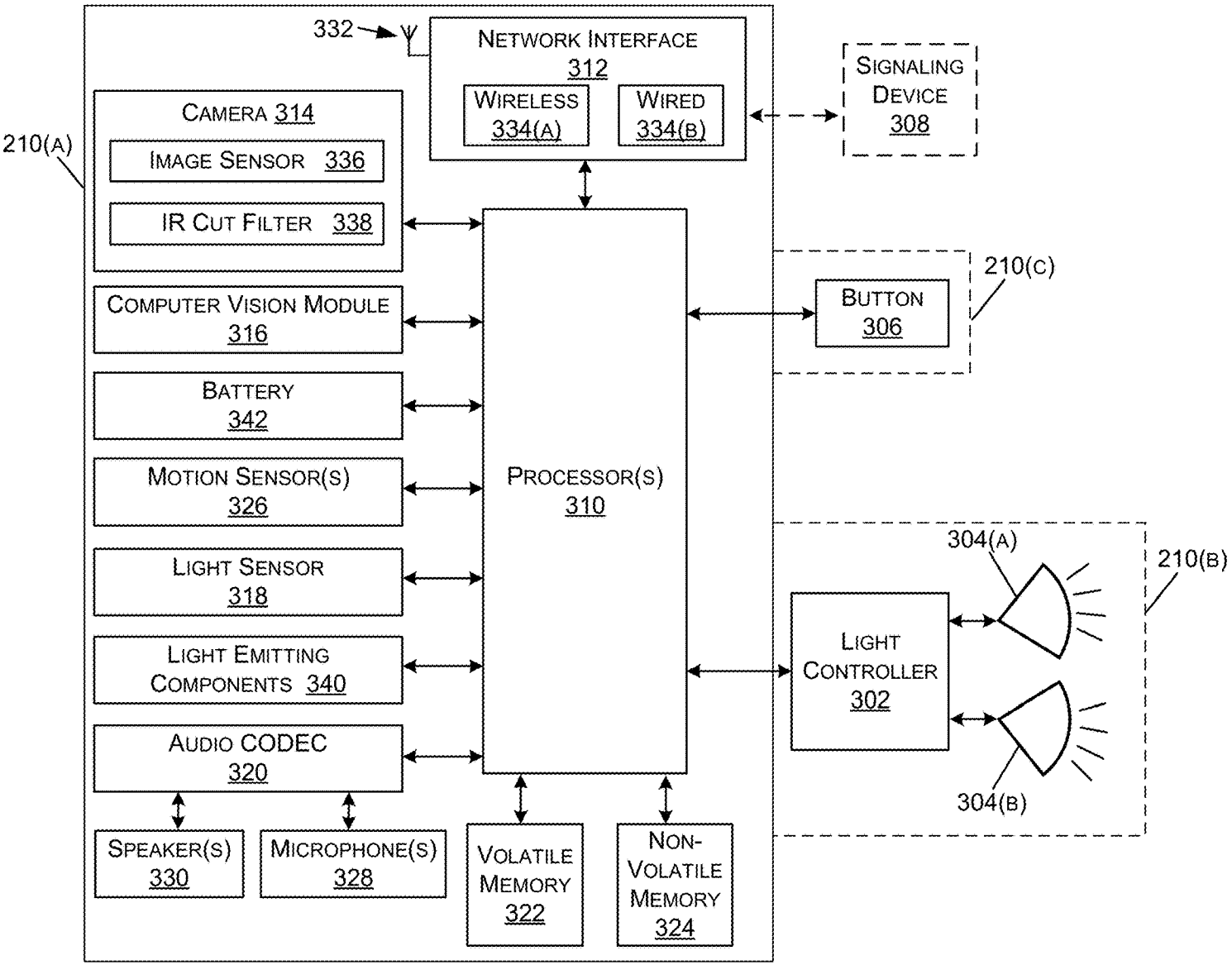
FIG. 3 is a functional block diagram illustrating one example embodiment of an A/V device, according to various aspects of the present disclosure.

FIG. 3 is a functional block diagram for an A/V device 210 according to various aspects of the present disclosure. In some embodiments, the one or more A/V devices 210 may include the security camera 210(*a*). In other embodiments, the one or more A/V devices 210 may include the light camera 210(*b*), which may include some or all of the components of the security camera 210(*a*) in addition to a light controller 302 and one or more lights (e.g., light sources) 304(*a*), 304(*b*). In some embodiments, the one or more A/V devices 210 may include the A/V doorbell 210(*c*), which may include some or all of the components of the security camera 210(*a*) in addition to a touch surface(s) 306, and in some embodiments, a connection to a signaling device 308 (e.g., a pre-installed signaling device, such as a wired signaling device, and/or a wireless signaling device, connected over Wi-Fi, BLE, or another wireless communication protocol).

With further reference to FIG. 3, the A/V device 210 may include a processor(s) 310, a network interface 312, a camera 314, a computer vision module 316, a light sensor 318, an audio CODEC (coder-decoder) 320, volatile memory 322, and non-volatile memory 324. The processor(s) 310 (alternatively referred to herein as a "CPU," a "controller," and/or a "microcontroller) may comprise an integrated circuit including a processor core, memory, and programmable input/output peripherals. The processor(s) 310 may receive input signals, such as data and/or power, from the camera 314, motion sensor(s) 326, light sensor 318, microphone(s) 328, speaker(s) 330, and/or the network interface 312, and may perform various functions as described in the present disclosure. In various embodiments, when the processor(s) 310 is triggered by the motion sensor(s) 326, the camera 314, the speaker(s) 330, the microphone(s) 328, the network interface 312, and/or another component, the processor(s) 310 performs one or more processes and/or functions. For example, when the light sensor 318 detects a low level of ambient light, the light sensor 318 may trigger the processor(s) 310 to enable a night vision camera mode. The processor(s) 310 may also provide data communication between various components such as between the network interface 312 and the camera 314.

With further reference to FIG. 3, the network interface 312 may comprise an integrated circuit including a processor core, memory, and programmable input/output peripherals. The network interface 312 may be operatively connected to the processor(s) 310. In some embodiments, the network interface 312 is configured to handle communication links between the A/V device 210 and other, external devices, external receivers, external transmitters, and/or external transceivers, and to route incoming/outgoing data appropriately. For example, inbound data from an antenna 332 of the network interface 312 may be routed through the network interface 312 before being directed to the processor(s) 310, and outbound data from the processor(s) 310 may be routed through the network interface 312 before being directed to the antenna 332 of the network interface 312. As another example, the network interface 312 may be configured to transmit data to and/or receive data from a remote network device(s) (e.g., one or more components of the network(s) of servers/backend devices 220 described in FIG. 2). The network interface 312 may include wireless 334(*a*) and wired 334(*b*) adapters. For example, the network interface 312 may include one or more wireless antennas, radios, receivers, transmitters, and/or transceivers (not shown in FIG. 3 for simplicity) configured to enable communication across one or more wireless networks, such as, without limitation, Wi-Fi, cellular, Bluetooth, Z-Wave, Zigbee, LPWAN(s), and/or satellite networks. The network interface 312 may receive inputs, such as power and/or data, from the camera 314, the processor(s) 310, the button 306 (in embodiments where the A/V device 210 is the video doorbell 210(*c*)), the motion sensors 326, a reset button (not shown in FIG. 3 for simplicity), and/or the non-volatile memory 324. The network interface 312 may also include the capability of communicating over wired connections, such as with a signaling device 308. For example, when the button 306 of the video doorbell 210(*c*) is pressed, the network interface 312 may be triggered to perform one or more functions, such as to transmit a signal over the wired 334(*b*) connection to the signaling device 308 (although, in some embodiments, the signal be transmitted over a wireless 334(*a*) connection to the signaling device) to cause the signaling device 308 to emit a sound (e.g., a doorbell tone, a user customized sound, a ringtone, a seasonal ringtone, etc.). The network interface 312 may also act as a conduit for data communicated between various components and the processor(s) 310.

With further reference to FIG. 3, the A/V device 210 may include the non-volatile memory 324 and the volatile memory 322. The non-volatile memory 324 may comprise flash memory configured to store and/or transmit data. For example, in certain embodiments the non-volatile memory 324 may comprise serial peripheral interface (SPI) flash memory. In some embodiments, the non-volatile memory 324 may comprise, for example, NAND or NOR flash memory. The volatile memory 322 may comprise, for example, DDR3 SDRAM (double data rate type three synchronous dynamic random-access memory). In the embodiment illustrated in FIG. 3, the volatile memory 322 and the non-volatile memory 324 are illustrated as being separate from the processor(s) 310. However, the illustration of FIG. 3 is not intended to be limiting, and in some embodiments the volatile memory 322 and/or the non-volatile memory 324 may be physically incorporated with the processor(s) 310, such as on the same chip. The volatile memory 322 and/or the non-volatile memory 324, regardless of their physical location, may be shared by one or more other components (in addition to the processor(s) 310) of the present A/V device 210.

With further reference to FIG. 3, the A/V device 210 may include the camera 314. The camera 314 may include an image sensor 336. The image sensor 336 may include a video recording sensor and/or a camera chip. In one aspect of the present disclosure, the imager sensor 336 may comprise a complementary metal-oxide semiconductor (CMOS) array and may be capable of recording high definition (e.g., 722p, 1800p, 4K, etc.) video files. The camera 314 may include a separate camera processor (not shown in FIG. 3 for simplicity), or the processor(s) 310 may perform the camera processing functionality. The processor(s) 310 (and/or camera processor) may include an encoding and compression chip. In some embodiments, the processor(s) 310 (and/or the camera processor) may comprise a bridge processor. The processor(s) 310 (and/or the camera processor) may process video recorded by the image sensor 336 and/or audio recorded by the microphone(s) 328, and may transform this data into a form suitable for transfer by the network interface 312 to the network (Internet/PSTN) 212. In various embodiments, the camera 314 also includes memory, such as volatile memory that may be used when data is being buffered or encoded by the processor(s) 310 (and/or the camera processor). For example, in certain embodiments the camera memory may comprise synchronous dynamic random-access memory (SD RAM).

The camera 314 may further include an IR cut filter 338 that may comprise a system that, when triggered, configures the image sensor 336 to see primarily infrared light as opposed to visible light. For example, when the light sensor 318 detects a low level of ambient light (which may comprise a level that impedes the performance of the image sensor 336 in the visible spectrum), a light-emitting components 340 may shine infrared light through an enclosure of the A/V device 210 out to the environment, and the IR cut filter 338 may enable the image sensor 336 to see this infrared light as it is reflected or refracted off of objects within the field of view of the doorbell. This process may provide the A/V device with the "night vision" function mentioned above.

With further reference to FIG. 3, the A/V device 210 may comprise the light sensor 318 and the one or more light-emitting components 340, such as LED's. The light sensor 318 may be one or more sensors capable of detecting the level of ambient light of the surrounding environment in which the A/V device 210 may be located. The light-emitting components 340 may be one or more light-emitting diodes capable of producing visible light when supplied with power (e.g., to enable night vision). In some embodiments, when activated, the light-emitting components 340 illuminates a light pipe.

The A/V device 210 may further include one or more speaker(s) 330 and/or one or more microphone(s) 328. The speaker(s) 330 may be any electromechanical device capable of producing sound in response to an electrical signal input. The microphone(s) 328 may be an acoustic-to-electric transducer or sensor capable of converting sound waves into an electrical signal. In some embodiments, the A/V device 210 may include two or more microphone(s) 328 that are spaced from one another (e.g., located on different sides of the A/V device 210) to provide noise cancelling and/or echo cancelling for clearer audio. The speaker(s) 330 and/or microphone(s) 328 may be coupled to an audio CODEC 320 to enable digital audio received by client devices to be decompressed and output by the speaker(s) 330 and/or to enable audio data captured by the microphone(s) 328 to be compressed into digital audio data. The digital audio data may be received from and transmitted to client devices using the network interface 312 (in some embodiments, through one or more intermediary devices such as the hub device 202, the VA device 208, and/or one or more components of the network of servers/backend devices 220 as described in FIG. 2). For example, when a visitor (or intruder) who is present in the area about the A/V device 210 speaks, sound from the visitor (or intruder) is received by the microphone(s) 328 and compressed by the audio CODEC 320. Digital audio data is then sent through the network interface 312 to the network 212 via the user's network 218, routed by the backend server(s) 224 and/or the backend API 226 and delivered to the client device(s) 214, 216 as described above in connection with FIG. 2. When the user speaks, after being transferred through the network 212, the user's network 218, and the network interface 312, the digital audio data from the user is decompressed by the audio CODEC 320 and emitted to the visitor through the speaker(s) 330.

With further reference to FIG. 3, the A/V device 210 may be battery powered using a battery 342 and/or may be powered using a source of external AC (alternating-current) power, such as a household AC power supply (alternatively referred to herein as "AC mains" or "wall power"). The AC power may have a voltage in the range of 112-220 VAC, for example. The incoming AC power may be received by an AC/DC adapter (not shown), which may convert the incoming AC power to DC (direct-current) and may step down the voltage from 112-220 VAC to a lower output voltage of about 12 VDC and an output current of about 2 A, for example. In various embodiments, the output of the AC/DC adapter is in a range from about 9 V to about 15 V and in a range from about 0.5 A to about 5 A. These voltages and currents are examples provided for illustration and are not intended to be limiting.

However, in other embodiments, a battery 342 may not be included. In embodiments that include the battery 342, the A/V device 210 may include an integrated circuit (not shown) capable of arbitrating between multiple voltage rails, thereby selecting the source of power for the A/V device 210. The A/V device 210 may have separate power rails dedicated to the battery 342 and the AC power source. In one aspect of the present disclosure, the A/V device 210 may continuously draw power from the battery 342 to power the A/V device 210, while at the same time routing the AC power to the battery, thereby allowing the battery 342 to maintain a substantially constant level of charge. Alternatively, the A/V device 210 may continuously draw power from the AC power to power the doorbell, while only drawing from the battery 342 when the AC power is low or insufficient. Still, in some embodiments, the battery 342 comprises the sole source of power for the A/V device 210. In such embodiments, the components of the A/V device 210 (e.g., spring contacts, connectors, etc.) are not be connected to a source of AC power. When the battery 342 is depleted of its charge, it may be recharged, such as by connecting a power source to the battery 342 (e.g., using a USB connector).

Although not illustrated in FIG. 3, in some embodiments, the A/V device 210 may include one or more of an accelerometer, a barometer, a humidity sensor, and a temperature sensor. The accelerometer may be one or more sensors capable of sensing motion and/or acceleration. The one or more of the accelerometer, the barometer, the humidity sensor, and the temperature sensor may be located outside of a housing of the A/V device 210 so as to reduce interference from heat, pressure, moisture, and/or other stimuli generated by the internal components of the A/V device 210.

With further reference to FIG. 3, the A/V device 210 may include one or more motion sensor(s) 326. However, in some embodiments, the motion sensor(s) 326 may not be included, such as where motion detection is performed by the camera 314 or another device. The motion sensor(s) 326 may be any type of sensor capable of detecting and communicating the presence of an object within their field of view. As such, the motion sensor(s) 326 may include one or more (alone or in combination) different types of motion sensors. For example, in some embodiments, the motion sensor(s) 326 may comprise passive infrared (PIR) sensors, which may be secured on or within a PIR sensor holder that may reside behind a lens (e.g., a Fresnel lens). In such an example, the PIR sensors may detect IR radiation in a field of view, and produce an output signal (typically a voltage) that changes as the amount of IR radiation in the field of view changes. The amount of voltage in the output signal may be compared, by the processor(s) 310, for example, to one or more threshold voltage values to determine if the amount of voltage in the output signal is indicative of motion, and/or if the amount of voltage in the output signal is indicative of motion of an object that is to be captured by the camera 314 (e.g., motion of a person and/or animal may prompt activation of the camera 314, while motion of a vehicle may not). Although the above discussion of the motion sensor(s) 326 primarily relates to PIR sensors, depending on the embodiment, the motion sensor(s) 326 may include additional and/or alternate sensor types that produce output signals including alternative data types. For example, and without limitation, the output signal may include an amount of voltage change based on the presence of infrared radiation in a field of view of an active infrared (AIR) sensor, the output signal may include phase shift data from a microwave-type motion sensor, the output signal may include doppler shift data from an ultrasonic-type motion sensor, the output signal may include radio wave disturbance from a tomographic-type motion sensor, and/or the output signal may include other data types for other sensor types that may be used as the motion sensor(s) 326 of the A/V device 210.

In some embodiments, computer vision module(s) (CVM) 316 may be included in the A/V device 210 as the motion sensor(s) 326, in addition to, or alternatively from, other motion sensor(s) 326. For example, the CVM 316 may be a low-power CVM (e.g., Qualcomm Glance) that, by operating at low power (e.g., less than 2 mW of end-to-end power), is capable of providing computer vision capabilities and functionality for battery powered devices (e.g., the A/V device 210 when powered by the battery 342). The low-power CVM may include a lens, a CMOS image sensor, and a digital processor that may perform embedded processing within the low-power CVM itself, such that the low-power CVM may output post-processed computer vision metadata to the processor(s) 310 (e.g., via a serial peripheral bus interface (SPI)). As such, the low-power CVM may be considered to be one or more of the motion sensor(s) 326, and the data type output in the output signal may be the post-processed computer vision metadata. The metadata may include information such as the presence of a particular type of object (e.g., person, animal, vehicle, parcel, etc.), a direction of movement of the object, a distance of the object from the A/V device 210, etc. In various embodiments, the motion sensor(s) 326 include a plurality of different sensor types capable of detecting motion such as PIR, AIR, low-power CVM, and/or cameras.

As indicated above, the A/V device 210 may include the CVM 316 (which may be the same as the above described low-power CVM 316 implemented as one or more motion sensor(s) 326, or may be additional to, or alternative from, the above described low-power CVM 316). For example, the A/V device 210, the hub device 202, the VA device 208, and/or one or more component of the network(s) of servers/backend devices 220 may perform any or all of the computer vision processes and functionalities described herein. In addition, although the CVM 316 is only illustrated as a component of the A/V device 210, the computer vision module 316 may additionally, or alternatively, be included as a component of the hub device 202, the VA device 208, and/or one or more components of the network of servers/backend devices 220. With respect to the A/V device 210, the CVM 316 may include any of the components (e.g., hardware) and/or functionality described herein with respect to computer vision, including, without limitation, one or more cameras, sensors, and/or processors. In some of the present embodiments, with reference to FIG. 3, the microphone(s) 328, the camera 314, the processor(s) 310, and/or the image sensor 336 may be components of the CVM 316. In some embodiments, the CVM 316 may include an internal camera, image sensor, and/or processor, and the CVM 316 may output data to the processor(s) 310 in an output signal, for example.

As a result of including the CVM 316, some of the present embodiments may leverage the CVM 316 to implement computer vision for one or more aspects, such as motion detection, object recognition, and/or facial recognition. Computer vision includes methods for acquiring, processing, analyzing, and understanding images and, in general, high-dimensional data from the real world in order to produce numerical or symbolic information, e.g., in the form of decisions. Computer vision seeks to duplicate the abilities of human vision by electronically perceiving and understanding an image. Understanding in this context means the transformation of visual images (the input of the retina) into descriptions of the world that can interface with other thought processes and elicit appropriate action. This image understanding can be seen as the disentangling of symbolic information from image data using models constructed with the aid of geometry, physics, statistics, and learning theory. Computer vision has also been described as the enterprise of automating and integrating a wide range of processes and representations for vision perception. As a scientific discipline, computer vision is concerned with the theory behind artificial systems that extract information from images. The image data can take many forms, such as video sequences, views from multiple cameras, or multi-dimensional data from a scanner.

One aspect of computer vision comprises determining whether or not the image data contains some specific object, feature, or activity. Different varieties of computer vision recognition include: Object Recognition (also called object classification)—One or several pre-specified or learned objects or object classes can be recognized, usually together with their 2D positions in the image or 3D poses in the scene. Identification—An individual instance of an object is recognized. Examples include identification of a specific person's face or fingerprint, identification of handwritten digits, or identification of a specific vehicle. Detection—The image data are scanned for a specific condition. Examples include detection of possible abnormal cells or tissues in medical images or detection of a vehicle in an automatic road toll system. Detection based on relatively simple and fast computations is sometimes used for finding smaller regions of interesting image data that can be further analyzed by more computationally demanding techniques to produce a correct interpretation.

Several specialized tasks based on computer vision recognition exist, such as: Optical Character Recognition (OCR)—Identifying characters in images of printed or handwritten text, usually with a view to encoding the text in a format more amenable to editing or indexing (e.g., ASCII). 2D Code Reading—Reading of 2D codes such as data matrix and QR codes. Facial Recognition. Shape Recognition Technology (SRT)—Differentiating human beings (e.g., head and shoulder patterns) from objects.

Image acquisition—A digital image is produced by one or several image sensors, which, besides various types of light-sensitive cameras, may include range sensors, tomography devices, radar, ultra-sonic cameras, etc. Depending on the type of sensor, the resulting image data may be a 2D image, a 3D volume, or an image sequence. The pixel values may correspond to light intensity in one or several spectral bands (gray images or color images), but can also be related to various physical measures, such as depth, absorption or reflectance of sonic or electromagnetic waves, or nuclear magnetic resonance.

Pre-processing—Before a computer vision method can be applied to image data in order to extract some specific piece of information, it is usually beneficial to process the data in order to assure that it satisfies certain assumptions implied by the method. Examples of pre-processing include, but are not limited to re-sampling in order to assure that the image coordinate system is correct, noise reduction in order to assure that sensor noise does not introduce false information, contrast enhancement to assure that relevant information can be detected, and scale space representation to enhance image structures at locally appropriate scales.

Feature extraction—Image features at various levels of complexity are extracted from the image data. Typical examples of such features are: Lines, edges, and ridges; Localized interest points such as corners, blobs, or points; More complex features may be related to texture, shape, or motion.

Detection/segmentation—At some point in the processing a decision may be made about which image points or regions of the image are relevant for further processing. Examples are: Selection of a specific set of interest points; Segmentation of one or multiple image regions that contain a specific object of interest; Segmentation of the image into nested scene architecture comprising foreground, object groups, single objects, or salient object parts (also referred to as spatial-taxon scene hierarchy).

High-level processing—At this step, the input may be a small set of data, for example a set of points or an image region that is assumed to contain a specific object. The remaining processing may comprise, for example: Verification that the data satisfy model-based and application-specific assumptions; Estimation of application-specific parameters, such as object pose or object size; Image recognition—classifying a detected object into different categories; Image registration—comparing and combining two different views of the same object. Decision making—Making the final decision required for the application, for example match/no-match in recognition applications.

One or more of the present embodiments may include a vision processing unit (not shown separately, but may be a component of the CVM 316). A vision processing unit is an emerging class of microprocessor; it is a specific type of AI (artificial intelligence) accelerator designed to accelerate machine vision tasks. Vision processing units are distinct from video processing units (which are specialized for video encoding and decoding) in their suitability for running machine vision algorithms such as convolutional neural networks, SIFT, etc. Vision processing units may include direct interfaces to take data from cameras (bypassing any off-chip buffers), and may have a greater emphasis on on-chip dataflow between many parallel execution units with scratchpad memory, like a manycore DSP (digital signal processor). But, like video processing units, vision processing units may have a focus on low precision fixed-point arithmetic for image processing.

Some of the present embodiments may use facial recognition hardware and/or software, as a part of the computer vision system. Various types of facial recognition exist, some or all of which may be used in the present embodiments.

Some face recognition identify facial features by extracting landmarks, or features, from an image of the subject's face. For example, an algorithm may analyze the relative position, size, and/or shape of the eyes, nose, cheekbones, and jaw. These features are then used to search for other images with matching features. Other algorithms normalize a gallery of face images and then compress the face data, only saving the data in the image that is useful for face recognition. A probe image is then compared with the face data. One of the earliest successful systems is based on template matching techniques applied to a set of salient facial features, providing a sort of compressed face representation.

Recognition algorithms can be divided into two main approaches, geometric, which looks at distinguishing features, or photometric, which is a statistical approach that distills an image into values and compares the values with templates to eliminate variances.

Popular recognition algorithms include principal component analysis using eigenfaces, linear discriminant analysis, elastic bunch graph matching using the Fisherface algorithm, the hidden Markov model, the multilinear subspace learning using tensor representation, and the neuronal motivated dynamic link matching.

Further, a newly emerging trend, claimed to achieve improved accuracy, is three-dimensional face recognition. This technique uses 3D sensors to capture information about the shape of a face. This information is then used to identify distinctive features on the surface of a face, such as the contour of the eye sockets, nose, and chin.

One advantage of 3D face recognition is that it is not affected by changes in lighting like other techniques. It can also identify a face from a range of viewing angles, including a profile view. Three-dimensional data points from a face vastly improve the precision of face recognition. 3D research is enhanced by the development of sophisticated sensors that do a better job of capturing 3D face imagery. The sensors work by projecting structured light onto the face. Up to a dozen or more of these image sensors can be placed on the same CMOS chip—each sensor captures a different part of the spectrum.

Another variation is to capture a 3D picture by using three tracking cameras that point at different angles; one camera pointing at the front of the subject, a second one to the side, and a third one at an angle. All these cameras work together to track a subject's face in real time and be able to face detect and recognize.

Another emerging trend uses the visual details of the skin, as captured in standard digital or scanned images. This technique, called skin texture analysis, turns the unique lines, patterns, and spots apparent in a person's skin into a mathematical space.

Another form of taking input data for face recognition is by using thermal cameras, which may only detect the shape of the head and ignore the subject accessories such as glasses, hats, or make up.

Further examples of automatic identification and data capture (AIDC) and/or computer vision that can be used in the present embodiments to verify the identity and/or authorization of a person include, without limitation, biometrics. Biometrics refers to metrics related to human characteristics. Biometrics authentication (or realistic authentication) is used in various forms of identification and access control. Biometric identifiers are the distinctive, measurable characteristics used to label and describe individuals. Biometric identifiers can be physiological characteristics and/or behavioral characteristics. Physiological characteristics may be related to the shape of the body. Examples include, but are not limited to, fingerprints, palm veins, facial recognition, three-dimensional facial recognition, skin texture analysis, DNA, palm prints, hand geometry, iris recognition, retina recognition, and odor/scent recognition. Behavioral characteristics may be related to the pattern of behavior of a person, including, but not limited to, typing rhythm, gait, and voice recognition.

The present embodiments may use any one, or any combination of more than one, of the foregoing biometrics to identify and/or authenticate a person who is either suspicious or who is authorized to take certain actions with respect to a property or expensive item of collateral. For example, with reference to FIG. 3, the CVM 316, and/or the camera 314 and/or the processor(s) 310 may receive information about the person using any one, or any combination of more than one, of the foregoing biometrics.

Again, with reference to FIG. 3, in embodiments where the A/V device 210 includes a light camera, the A/V device 210 may include the light controller 302 and one or more lights 304(*a*), 304(*b*) (collectively referred to herein as "lights 304"). The light controller 302 may include a switch for controlling the lights 304. For example, in response to the motions sensor(s) 326 and/or the camera 314 detecting motion, the light controller 302 may receive an output signal from the processor(s) 310 that causes the light controller 302 to activate the one or more lights 304(*a*), 304(*b*). In some embodiments, the light camera may include motion sensor(s) 326 detecting motion for controlling activation of the lights 304, and may further include the camera 314 for detecting motion for activating the recording of the image data using the camera 314 and/or the recording of the audio data using the microphone(s) 328. In other embodiments, the motion sensor(s) 326 may detect the motion for activating the lights 304, the camera 314, and the microphone(s) 328, or the camera 314 may detect the motion for activating the lights 304, the camera 314 to being recording the image data, and the microphone(s) 328 to being recording the audio data. The lights 304 may include floodlights, spotlights, porch lights, or another type of illumination device. The lights 304 may provide for better image data quality when ambient light levels are low (e.g., at dusk, dawn, or night), while also providing a deterrent effect by being illuminated when motion is detected.

Although the A/V device 210 is referred to herein as an "audio/video" device, the A/V device 210 need not have both audio and video functionality. For example, in some embodiments, the A/V device 210 may not include the speakers 330, microphones 328, and/or audio CODEC. In such examples, the A/V device 210 may only have video recording and communication functionalities. In other examples, the A/V device 210 may only have the speaker(s) 330 and not the microphone(s) 328, or may only have the microphone(s) 328 and not the speaker(s) 330.

In some examples, the A/V device 210 may operate as a "bridge" between other devices. For example, the A/V device 210 may receive first data that is transmitted from a first device, such as the backend server(s) 224, where the first data includes is associated with a second device (e.g., the first data includes a command to be executed by the second device), such as a light emitter 232. The A/V device 210 may then transmit the first data to the second device. Additionally, the A/V device 210 may receive second data from the second device, where the second data is associated with the first device (e.g., the second data indicates that the command was executed). The A/V device 210 may then transmit the second data to the backend server(s) 224. In some examples, the A/V device 210 may be transmitting/receiving the first data over a first network and be transmitting/receiving the second data over a second network. For example, the first network may include a wireless local area network, such as, but not limited to, the Internet, a local intranet, a Personal Area Network (PAN), a Local Area Network (LAN), a Wide Area Network (WAN), and/or the like. Additionally, the second network may include a low-power wide-area network (LPWAN), such as, but not limited to, a chirp spread spectrum (CSS) modulation technology network (e.g., LoRaWAN), an Ultra Narrow Band modulation technology network (e.g., Sigfox, Telensa, NB-IoT, etc.), RingNet, and/or the like.

Figure 4:
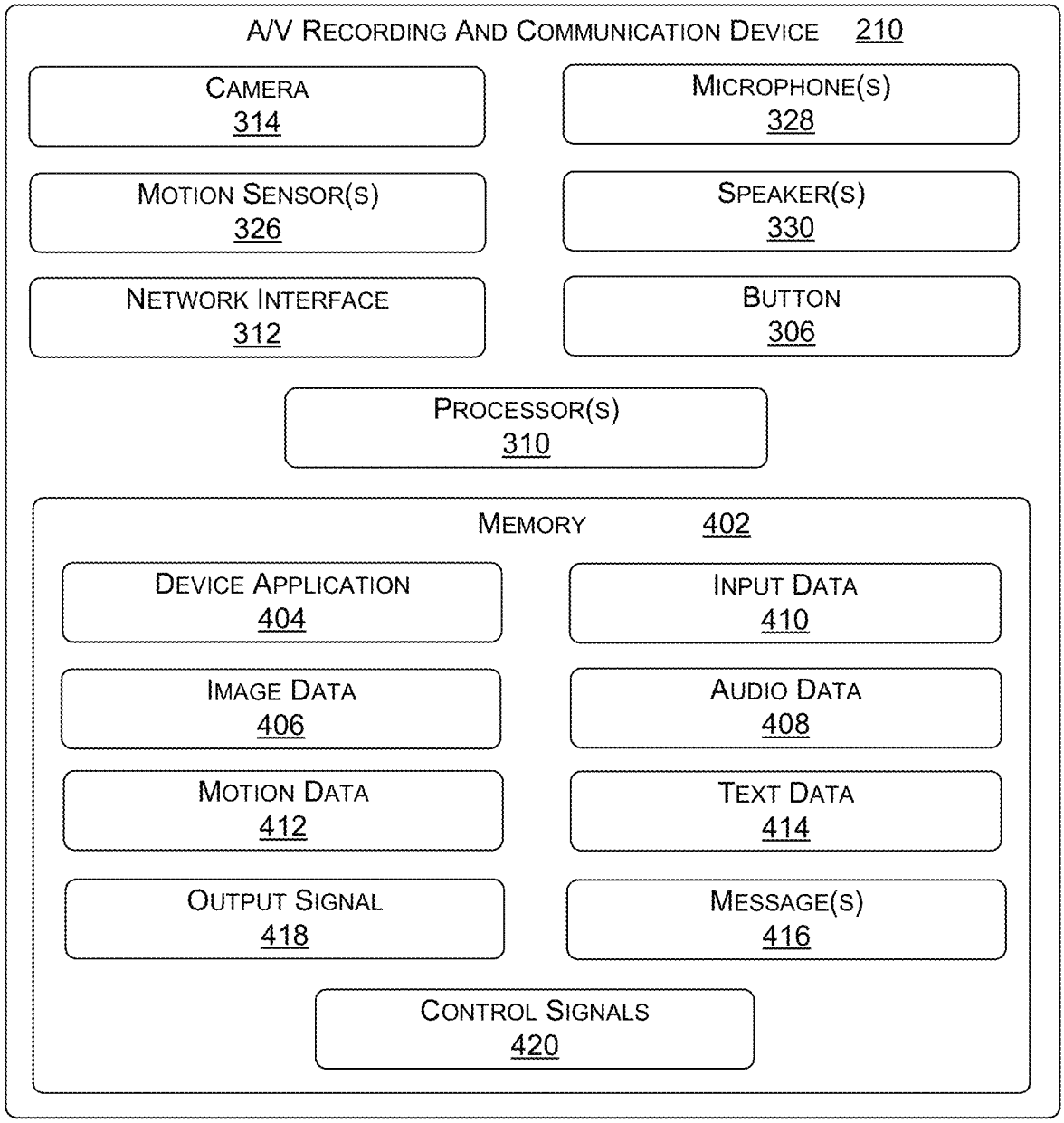
FIG. 4 is a functional block diagram illustrating one example embodiment of an A/V device, according to various aspects of the present disclosure.

FIG. 4 is another functional block diagram illustrating an embodiment of the A/V device 210 according to various aspects of the present disclosure. In some embodiments, the A/V device 210 may represent, and further include one or more of the components from, the A/V recording and communication doorbell 210(*c*), the A/V recording and communication security camera 210(*a*), and/or the floodlight controller 210(*b*). Additionally, in some embodiments, the A/V device 210 may omit one or more of the components shown in FIG. 4 and/or may include one or more additional components not shown in FIG. 4.

As shown in FIG. 4, the A/V device 210 includes memory 402, which may represent the volatile memory 322 and/or the non-volatile memory 324. The memory 402 stores a device application 404. In various embodiments, the device application 404 may include instructions that cause the processor(s) 310 to generate image data 406 (which may represent, and/or be similar to, the image data 122) using the camera 314, audio data 408 using the microphone(s) 328, input data 410 using the button 306 (and/or the camera 314 and/or the motion sensor(s) 326, depending on the embodiment), and/or motion data 412 using the camera 314 and/or the motion sensor(s) 326. In some embodiments, the device application 404 may also include instructions that cause the processor(s) 310 to generate text data 414 describing the image data 406, the audio data 408, and/or the input data 410, such as in the form of metadata, for example.

In addition, the device application 404 may include instructions that cause the processor(s) 310 to transmit the image data 406, the audio data 408, the motion data 412, the input data 410, the text data 414, and/or message(s) 416 to the client devices 214, 216, the hub device 202, and/or the backend server(s) 224 using the network interface 312. In various embodiments, the device application 404 may also include instructions that cause the processor(s) 310 to generate and transmit an output signal 418 that may include the image data 406, the audio data 408, the text data 414, the input data 410, and/or the motion data 412. In some of the present embodiments, the output signal 418 may be transmitted to the backend server(s) 224 and/or the hub device 202 using the network interface 312. The backend server(s) 224 may then transmit (or forward) the output signal 418 to the client device(s) 214, 216, and/or the hub device 202 may then transmit (or forward) the output signal 418 to the client device(s) 214, 216, and/or the hub device 202 may then transmit (or forward) the output signal 418 to the backend server(s) 224, and the backend server(s) 224 may then transmit (or forward) the output signal 418 to the client device(s) 214, 216. In other embodiments, the output signal 418 may be transmitted directly to the client device(s) 214, 216 by the A/V device 210.

In further reference to FIG. 4, the image data 406 may comprise image sensor data such as (but not limited to) exposure values and data regarding pixel values for a particular sized grid. The image data 406 may include still images, live video, and/or pre-recorded images and/or video. The image data 406 may be recorded by the camera 314 in a field of view of the camera 314. The image data 406 may be representative of (e.g., depict) a physical environment in a field of view of the camera 314. In some embodiments, the physical environment may include one or more objects (e.g., persons, vehicles, animals, items, etc.), and the image data 406 may be representative of the one or more objects, such as the one or more objects within the physical environment.

In further reference to FIG. 4, the motion data 412 may comprise motion sensor data generated in response to motion events. For example, the motion data 412 may include an amount or level of a data type generated by the motion sensor(s) 326 (e.g., the voltage level output by the motion sensor(s) 326 when the motion sensor(s) 326 are PIR type motion sensor(s)). In some of the present embodiments, such as those where the A/V device 210 does not include the motion sensor(s) 326, the motion data 412 may be generated by the camera 314. In such embodiments, based on a frame by frame comparison of changes in the pixels from the image data 406, it may be determined that motion is present.

The input data 410 may include data generated in response to an input to the button 306. The button 306 may receive an input (e.g., a press, a touch, a series of touches and/or presses, etc.) and may generate the input data 410 in response that is indicative of the type of input. In embodiments where the A/V device 210 is not a doorbell (e.g., the video doorbell 210(*c*)), the A/V device 210 may not include the button 306, and the A/V device 210 may not generate the input data 410.

With further reference to FIG. 4, a message 416 may be generated by the processor(s) 310 and transmitted, using the network interface 312, to the client device 214, 216, the backend server(s) 224, and/or the hub device 202. For example, in response to detecting motion using the camera 314 and/or the motion sensor(s) 326, the A/V device 210 may generate and transmit the message 416. In some of the present embodiments, the message 416 may include at least the image data 406, the audio data 408, the text data 414, and/or the motion data 412.

As described herein, the message(s) 416 may include messages, signals, data, notifications, and/or any type of electronic communication that electronic devices (e.g., the A/V device 210, the client device 214, 216, the hub device 202, and/or one or more components of the network(s) of servers/backend devices 220) may transmit and receive with other electronic devices (e.g., the A/V device 210, the client device 214, 216, the hub device 202, and/or one or more components of the network(s) of servers/backend devices 220). For instance, message(s) 416 may include push notifications, email messages, short message service (SMS) messages, multimedia messages (MMS), voicemail messages, video signals, audio signals, data transmissions, and/or any other type of electronic communication that an electronic device can send to another electronic device.

The image data 406, the audio data 408, the text data 414, and/or the motion data 412 may be tagged with (e.g., a time stamp, based on clock data) and/or stored separately (e.g., on the backend server(s) 224, the hub device 202, and/or the A/V device 210) based on when the motion was detected, how long the motion was detected for, and/or a duration of time associated with the detected motion, or motion event (e.g., the duration of time may include the time the motion was detected plus an additional time, such as, without limitation, 5 seconds, 10 seconds, or 30 seconds). For example, each separate detection of motion, or motion event, may be associated with image data 406, audio data 408, text data 414, and/or motion data 412 representative of the detection of motion, or motion event. As a result, when a request for data pertaining to particular motion event, or a particular time period, is received (e.g., by the client device 214, 216, the backend server(s) 224, and/or the hub device 202), the image data 406, the audio data 408, the text data 414, and/or the motion data 412 associated with a particular motion event, and/or associated with motion event(s) within the particular time period, may be transmitted, retrieved, and/or received.

Although examples discuss the A/V device 210 generating and transmitting the image data 406, the audio data 408, the text data 414, and/or the motion data 412 when motion is detected, in other examples the data may be generated and/or transmitted at other times. For example, the image data 406, the audio data 408, the text data 414, and/or the motion data 412 may be generated and transmitted continuously (e.g., in a streaming manner), periodically, upon request, etc. In examples where the image data 406, the audio data 408, the text data 414, and/or the motion data 412 may be generated and transmitted continuously, the detection of motion (e.g., a motion event) may cause an indication of when the motion was detected (e.g., a time stamp) and/or how long the motion was detected for (e.g., a duration) to be associated with the image data 406, the audio data 408, the text data 414, and/or the motion data 412. As a result, even though the image data 406, the audio data 408, the text data 414, and/or the motion data 412 may be continuously generated by the A/V device 210, the image data 406, the audio data 408, the text data 414, and/or the motion data 412 associated with motion events may be tagged and/or stored separately (e.g., similar to that of the image data 406, the audio data 408, the text data 414, and/or the motion data 412 generated in response to the detection of motion), from the image data 406, the audio data 408, the text data 414, and/or the motion data 412 that is not associated with motion events.

In some examples, such as when the A/V device 210 is not continuously transmitting the image data 406, the A/V device 210 may generate and/or transmit image data 406 based on receiving control signals 420. For example, the A/V device 210 may receive, using the network interface 312, a control signal 420 from the backend server(s) 224, the hub device 202, and/or the client device 214, 216. If the A/V device 210 is not already generating image data 406, the control signal 420 may cause the A/V device 210 to generate the image data 406. For example, the control signal 420 may include data representing a first command to generate the image data 406. Additionally, the control signal 420 may cause the A/V device 410 to transmit the image data 406. For example, the control signal 420 may include data representing a second command to transmit the image data 406, such as to the backend server(s) 224, the hub device 202, and/or the client device 214, 216.

Figure 5:
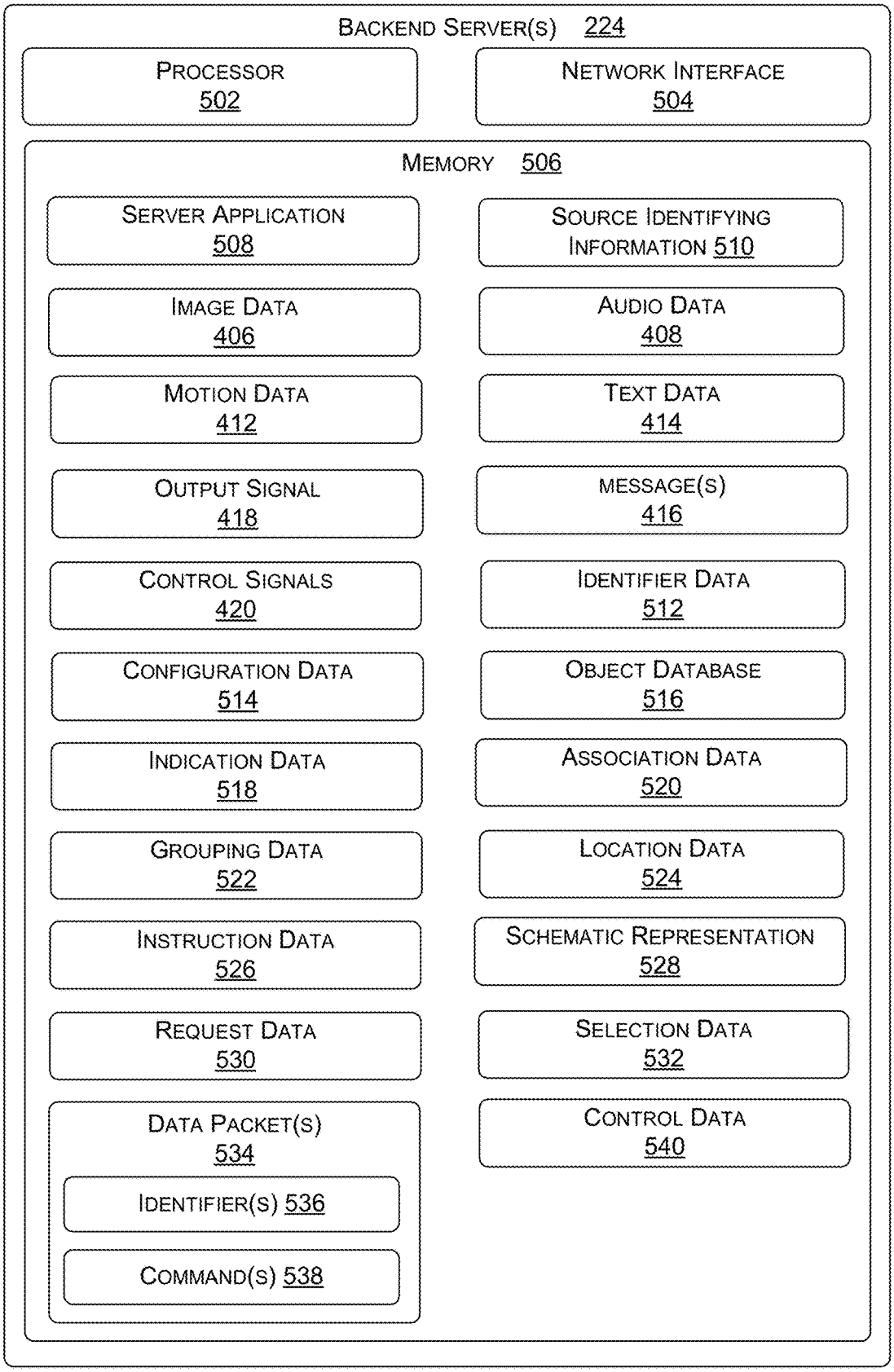
FIG. 5 is a functional block diagram illustrating one example embodiment of a backend server, according to various aspects of the present disclosure.

FIG. 5 is a functional block diagram illustrating one embodiment of the backend server(s) 224, according to various aspects of the present disclosure. The backend server(s) 224 may comprise processor(s) 502 (which may be similar to, and/or include similar functionality as, the processor(s) 310), network interface(s) 504 (which may each be similar to, and/or include similar functionality as, the network interface 312), and a memory 506 (which may be similar to, and/or include similar functionality as, the memory 402). The network interface(s) 504 may allow the backend server(s) 224 to access and communicate with devices connected to the network (Internet/PSTN) 212 (e.g., the A/V device 210, the hub device 202, the client devices 214, 216, a device controlled by the security monitoring service 228, the electronic device(s) 230, the light emitters 232, etc.).

The memory 506 may include a server application 508. The server application 508 may include instruction that cause the processor(s) 502 to receive and/or retrieve the audio data 408, the text data 414, the input data 410, the messages 416, the image data 406, the motion data 412, and/or the input data 410 from the A/V device 210 (e.g., in the output signal 418), the client device 214, 216, and/or the hub device 202. The server application 508 may also include instructions that cause the processor(s) 502 to transmit (and/or forward) the audio data 408, the text data 414, the input data 410, the messages 416, the image data 406, the motion data 412, and/or the input data 410 to the client devices 214, 216 using the network interface(s) 504.

Although referred to as the backend server(s) 224 with reference to the processes described herein, the backend server(s) 224 may additionally, or alternatively, include one or more of the devices from the network(s) of servers/backend devices 220. For example, the processes described herein with respect to the backend server(s) 224 may additionally, or alternatively, at least in part, be performed by one or more backend APIs 226.

In further reference to FIG. 5, the memory 506 may also include source identifying data 510 that may be used to identify the A/V device 210, the hub device 202, the client devices 214, 216, the electronic device(s) 230, the light emitters 232, the sensors 204, and/or the automation devices 206. In addition, the source identifying data 510 may be used by the processor(s) 502 of the backend server(s) 224 to determine the client devices 214, 216 are associated with the A/V device 210, the electronic device(s) 230, the light emitters 232, the sensors 204, and/or the automation devices 206.

In some embodiments, the server application 508 may further include instructions that cause the processor(s) 502 to generate and transmit a report signal (not shown) to a third-party client device, which may be associated with a law enforcement agency or the security monitoring service 228, for example. The report signal, which may be the message 416, in some examples, may include the image data 406, the audio data 408, and/or the text data 414.

As described herein, at least some of the processes of the A/V device 210, the hub device 202, and/or the client device 214, 216 may be executed by the backend server(s) 224. For example, the backend server(s) 224 may receive, using the network interface 504, data (e.g., identifier data 512) from the client device 214, 214, the hub device 202, the electronic device(s) 230, the light emitter(s) 232, and/or another device. The identifier data 512 may represent a respective identifier for one or more of the light emitter(s) 232 that a user is installing at an environment. An identifier for a light emitter 232 may include, but is not limited to, an IP address, a MAC address, a numerical identifier, an alphabetic identifier, a mixed numerical and alphabetic identifier, and/or any other type of identifier that may be used to identify the light emitter 232.

After installing the light emitter(s) 232, the backend server(s) 224 may receive, using the network interface 504, data (e.g., configuration data 514, which may represent, and/or be similar to, the configuration data 118) from the client device 214, 216, where the configuration data 514 includes a request to configure the light emitter(s) 232. Based on receiving the configuration data 514, the backend server(s) 224 may obtain image data 406 (referred to, in this example, as "first image data 406") to be transmitted to the client device 214, 216. In some examples, such as if the backend server(s) 224 are not already receiving the first image data 406, the backend server(s) 224 may transmit, using the network interface 504, a control signal 420 to the A/V device 210 that includes a command to begin generating and/or a command to begin transmitting the first image data 406. The backend server(s) 224 may then receive, using the network interface 504, the first image data 406 from the A/V device 210. Additionally, the backend server(s) 224 may transmit, using the network interface 504, the first image data 406 to the client device 214, 216. Additionally, or alternatively, in some examples, such as if the backend server(s) 224 are already receiving the first image data 406 from the A/V device 210, the backend server(s) 224 may begin transmitting the first image data 406 to the client device 214, 216.

In some examples, the backend server(s) 224 may analyze the first image data 406 to identify portion(s) of the first image data 406 that potentially represent the light emitter(s) 232. For example, to analyze the first image data 406, computer vision processing and/or image processing, as described herein, for example, may be performed by the backend server(s) 224 to determine that the first image data 406 represents one or more objects. For example, in any of the present embodiments, the first image data 406 generated by the A/V device 210 may be analyzed to determine object data. In some of the present embodiments, one or more of the first image data 406, the motion data 412, and the audio data 408 may be used to determine the object data. The computer vision and/or image processing may be executed using computer vision and/or image processing algorithms. Examples of computer vision and/or image processing algorithms may include, without limitation, spatial gesture models that are 3D model-based and/or appearance based. 3D model-based algorithms may include skeletal and volumetric, where volumetric may include NURBS, primitives, and/or super-quadrics, for example.

In some embodiments, the backend server(s) 224 may compare the object data to an object database 516 to determine what, if any, object(s) the first image data 406 represents in the field of view of the A/V device 210. For example, the object database 516 may store image data corresponding to images and/or video footage that represent various objects, where the image data may be labeled (e.g., tagged, such as in the form of metadata) to indicate the type of object represented by each image and/or video footage. For example, the object database 516 may store image data representing various types of light emitters 232, where the image data is labeled to indicate that the type of object includes a respective type of light emitter 232.

Based on the comparing, the backend server(s) 224 may match the object data from the first image data 406 to the image data stored in the object database 516. The backend server(s) 224 may then use the match to determine that the object data represents an object and/or to determine the type of object that the object data represents. For example, if the backend server(s) 224 match the object data from the first image data 406 to image data stored in the object database 516 that represents a light emitter 232, then the backend server(s) 224 may determine that the first image data 406 represents an object and/or that the first image data 406 represents a light emitter 232. Additionally, the backend server(s) 224 may determine the portion of the first image data 406 (and/or the portion of first image(s) represented by the first image data 406) that represents the light emitter 232. In some examples, when the object data represents multiple objects, the backend server(s) 224 may perform a similar analysis to identify one or more objects represented by the object data and/or the respective type of object associated with one or more of the objects represented by the object data.

In some examples, in addition to, or alternatively from, comparing the first image data 406 to the image data stored in the object database 516, features and/or characteristics of various objects may be stored in the object database 516, and the features and/or characteristics of the objects in the first image data 406 may be determined (e.g., using computer vision processing, image processing, or the like) and compared against the features and/or characteristics from the object database 516. For example, sizes, volumes, weights, colors, movement types, and/or other features and/or characteristics of various objects may be stored in the object database 516. The size, volume, weight, color, movement type, and/or other features and/or characteristics of an object represented by the first image data 406 may then be compared to the sizes, volumes, weights, colors, movement types, and/or other features and/or characteristics stored in the object database 516 to identify the type of object represented by the first image data 406.

The backend server(s) 224 may then transmit, using the network interface 504, data (e.g., indication data 518) to the client device 214, 216, where the indication data 518 includes indication(s) of portion(s) of the first image data 406 (and/or portion(s) of the first image(s) represented by the first image data 406) that represent potential light emitter(s) 232. In some examples, the indication data 518 may be configured to cause the client device 214, 216 to display interface element(s) at the portion(s) of the first image(s), where one or more interface elements indicate a potential location of a light emitter 232. Furthermore, in some examples, the backend server(s) 224 may transmit, using the network interface 504, the identifier data 512 to the client device 214, 216 (e.g., if the client device 214, 216 is not already storing the identifier data 512).

The backend server(s) 224 may then receive, using the network interface 504, data (e.g., association data 520, which may represent, and/or be similar to, the association data 134) from the client device 214, 216. In some examples, the association data 520 may indicate association(s) between portion(s) of the FOV of the A/V device 210 and the identifier(s) of the light emitter(s) 232. The backend server(s) 224 may then store the association data 520. Additionally, or alternatively, in some examples, the association data 520 may indicate association(s) between portion(s) of the first image data 406 (and/or portion(s) of the first image(s) represented by the first image data 406) and the identifier(s) of the light emitter(s) 232. For example, the association data 520 may indicate that the client device 214, 216 received a respective input selecting a portion of the first image(s) that represents a respective light emitter 232. The backend server(s) 224 may then determine which portion(s) of the FOV of the A/V device 210 correspond to the portion(s) of the first image data 406 (and/or the portion(s) of the first image(s) represented by the first image data 406). The backend server(s) 230 may then store association data 520 that includes association(s) between the portion(s) of the FOV of the A/V device 210 and the identifier(s) of the light emitter(s) 232.

In some examples, to determine that a portion of a first image corresponds to a portion of the FOV of the A/V device 210, the backend server(s) 224 may identify which pixels are included within the portion of the first image. The backend server(s) 224 may then map the pixels to the FOV of the A/V device 210 to identify the portion of the FOV of the A/V device 210 that corresponds to the portion of the first image. For example, if the portion of the first image includes the bottom ten percent of the pixels of the first image, then the backend server(s) 224 may determine that the portion of the first image corresponds to the bottom ten percent of the FOV of the A/V device 210. As such, the backend server(s) 224 may determine that the portion of the FOV of the A/V device 210 includes the bottom ten percent of the FOV of the A/V device 210. While this is just one example, in other example, any other process and/or technique may be used to identify the portion of the FOV of the A/V device 210 that corresponds to the portion of the first image selected by the user.

In some examples, the backend server(s) 224 may then group the light emitter(s) 232 (and/or at least a portion of the light emitter(s) 232) that are located within the FOV of the A/V device 210. For example, the backend server(s) 224 may store data (e.g., grouping data 522, which may represent, and/or be similar to, the grouping data 136) that indicates that the light emitter(s) 232 that are located within the FOV of the A/V device 210 are associated with one another. In some examples, the backend server(s) 224 may further receive, using the network interface 504 and from the client device 214, 216, data that indicates one or more additional identifiers of one or more additional light emitters 232 that are not located within the FOV of the A/V device 210, but which should be grouped with the light emitter(s) 232. In such examples, the grouping data 522 may further indicate that the one or more additional light emitters 232 are associated with the light emitter(s) 232 located within the FOV of the A/V device 210.

In some examples, in addition to, or alternatively from, grouping the light emitter(s) 232 that are located within the FOV view of the A/V device 210, the backend server(s) 224 may group the light emitter(s) 232 using motion data 412 generated by the light emitter(s) 232. For example, the backend server(s) 224 may transmit, using the network interface 504, data to the client device 214, 216, where the data includes an instruction to move past the light emitters(s) 232 which the user wants grouped together. The backend server(s) 224 may then receive motion data 412 generated by the light emitter(s) 232, where the motion data 412 indicates that the light emitter(s) 232 detected an object (and/or motion). In some examples, the backend server(s) 224 may then determine that the motion data 412 generated by one or more of the light emitters 232 was generated within a threshold period of time from motion data 412 generated by another light emitter 232. The threshold period of time may include, but is not limited to, five seconds, ten seconds, thirty seconds, and/or any other duration of time. The backend server(s) 224 may then generate grouping data 522 that indicates that the light emitter(s) 232 that generated the motion data 412 are associated within one another.

For example, the backend server(s) 224 may receive first motion data 412 generated by a first light emitter 232 and second motion data 412 generated by a second light emitter 232. The backend server(s) 224 may then determine that the second motion data 412 was generated within the threshold period of time as the first motion data 412. Based on the determination, the backend server(s) 224 may generate grouping data 522 that associates the first light emitter 232 with the second light emitter 232. The backend server(s) 224 may then perform a similar process to add additional light emitter(s) 232 to the group.

Additionally, in some examples, the backend server(s) 224 may perform a similar process to group the light emitter(s) 232 with other devices, such as the A/V device 210. For example, and using the example above, the backend server(s) 224 may receive third motion data 412 and/or image data 406 generated by the A/V device 210, where the third motion data 412 and/or the image data 406 indicates that the A/V device 210 detected the object (and/or motion). The backend server(s) 224 may then determine that the third motion data 412 and/or the image data 406 was generated within the threshold period of time to the second motion data 412. Based on the determination, the backend server(s) 224 may generate grouping data 522 that associates the A/V device 210 with the first light emitter 232 and the second light emitter 232.

In some examples, in addition to, or alternatively from, configuring the light emitter(s) 232 using the first image data 406 generated by the A/V device 210, the backend server(s) 224 may configure the light emitter(s) 232 using location data 524 received from the client device 214, 216. For example, the backend server(s) 224 may transmit, using the network interface 504, data (e.g., instruction data 526) to the client device 214, 216, where the instruction data 526 represents an identifier of a light emitter 232 and/or includes instructions to place the client device 214, 216 within a threshold distance to the light emitter 232. The threshold distance may include, but is not limited to, six inches, one foot, two feet, five feet, and/or any other distance. Once the client device 214, 216 is located within the threshold distance to the light emitter 232, the backend server(s) 224 may receive, using the network interface, the location data 524 from the client device 214, 216, where the location data 524 indicates the geographic location of the client device 214, 216. The geographic location may include, but is not limited to, GNSS coordinates, GPS coordinates, and/or the like. The backend server(s) 224 may then store association data 520 that associates the geographic location with the identifier of the light emitter 232. Additionally, the backend server(s) 224 may perform similar processes and/or techniques to associate a respective geographic location with the respective identifier for one or more of the other light emitter(s) 232.

In some examples, the backend server(s) 224 may then use the association data 520 to generate a schematic representation 528 of the environment. In some examples, the schematic representation 528 of the environment may be based on or augmented using map data, which may be received from a third-party map provider, such as GOOGLE MAPS, APPLE MAPS, GOOGLE EARTH, and/or the like. The map data may include any details about a geographic area that includes the environment or portions of that geographic area. In some examples, the map data may include an identification of metes and bounds of environments in a geographic area, an identification of features of the environments, e.g., buildings, trees, utility poles, roads and the like; an identification of features of structures in the geographic area, e.g., footprints or layouts. In some examples, the map data may include local, city, state, or other government-based papers, permits, building data, and/or the like. The map data may generally include any information that may be used to generate the schematic representation 528 of the environment, for example.

The backend server(s) 224 may then use the association data 520 to determine the geographic location(s) of the light emitter(s) 232. For one or more of the light emitters 232, the backend server(s) 224 may add an interface element to the schematic representation 528 that is located at the geographic location associated with the light emitter 232. In some examples, the interface element may indicate the identifier of the light emitter 232. In some examples, and as discussed herein, the interface element may be associated with controlling the light emitter 232.

In some examples, the backend server(s) 224 may use the associations data 520 and/or the schematic representation 528 to control the light emitter(s) 232. For example, the backend server(s) 224 may transmit, using the network interface 504, image data 406 (referred to, in this example, as "second image data 406") and/or the association data 520 to the client device 214, 216. In some examples, the backend server(s) 224 may transmit the second image data 406 and/or the association data 520 based on receiving, using the network interface 504, data (e.g., request data 530, which may represent, and/or be similar to, the request data 138) from the client device 214, 216, where the request data 530 indicates a request to operate the light emitter(s) 232. In some examples, the backend server(s) 224 may transmit the second image data 406 and/or the association data 520 based on determining that the A/V device 210 detected an object (and/or motion). In some examples, the backend server(s) 224 may transmit the second image data 406 and/or the association data 520 based on a current time. For example, the current time may be associated with a sunset at a geographic location of the environment at which the light emitter(s) 232 are located. Still, in some examples, the backend server(s) 224 may transmit the second image data 406 and/or the association data 520 based on receiving, using the network interface 504, data from the A/V device 210 (and/or one of the light emitter(s) 232), where the data indicates that an amount of ambient light is below a threshold amount of ambient light.

In some examples, the backend server(s) 224 may then receive, using the network interface 504, data (e.g., selection data 532, which may represent, and/or be similar to, the selection data 144) from the client device 214, 216, where the selection data 532 indicates that the client device 214, 216 received a selection of an interface element associated with a light emitter 232. Based on the selection data 532, the backend server(s) 224 may generate a first data packet 534 (which may represent, and/or be similar to, the data packet 146) that includes data representing the identifier 536 of the light emitter 232 and data representing a command 538 to activate (if the light emitter 232 is deactivated) or data representing a command 538 to deactivate (if the light emitter 232 is activated). The backend server(s) 224 may then transmit, using the network interface 504, the data packet 534 to the light emitter 232 (which may be via the hub device 202, the VA device 208, the A/V device 210, the electronic device 230, and/or another device).

Additionally, or alternatively, in some examples, the backend server(s) 224 may receive, using the network interface 504, data (e.g., control data 540, which may represent, and/or be similar to, the control data 148) from the client device 214, 216, where the control data 540 indicates the identifier 536 of the light emitter 232 and a command 538 to activate (e.g., if the light emitter 232 is deactivated) or a command 538 to deactivate (e.g., if the light emitter 232 is activated). Based on the control data 540, the backend server(s) 224 may generate a data packet 534 that includes data representing the identifier 536 of the light emitter 232 and data representing a command 538 to activate (if the light emitter 232 is deactivated) or data representing a command 538 to deactivate (if the light emitter 232 is activated). The backend server(s) 224 may then transmit, using the network interface 504, the data packet 534 to the light emitter 232 (which may be via the hub device 202, the VA device 208, the A/V device 210, the electronic device 230, and/or another device).

Additionally, or alternatively, in some examples, the backend server(s) 224 may receive, using the network interface 504, data (e.g., which may also be represented by selection data 532) from the client device 214, 216, where the selection data 532 indicates a selected portion of second image(s) represented by the second image data 406. The backend server(s) 224 may then determine that the portion of the second image(s) is associated with a light emitter 232. For a first example, and using the association data 520, the backend server(s) 224 may determine that the portion of the second image(s) corresponds to the portion of the first image(s) that is associated with the light emitter 232. For a second example, and again using the association data 520, the backend server(s) 224 may determine that the portion of the second image(s) corresponds to the portion of the FOV of the A/V device 210 that is associated with the light emitter 232 (e.g., using the processes above). In either example. Based on the determination, the backend server(s) 224 may generate a first data packet 534 that includes data representing the identifier 536 of the light emitter 232 and data representing a command 538 to activate (if the light emitter 232 is deactivated) or data representing a command 538 to deactivate (if the light emitter 232 is activated). The backend server(s) 224 may then transmit, using the network interface 504, the first data packet 534 to the light emitter 232 (which may be via the hub device 202, the VA device 208, the A/V device 210, the electronic device 230, and/or another device).

In addition to, or alternatively from, transmitting the second image data 406 and/or the association data 520 to the client device 214, 216, the backend server(s) 224 may transmit, using the network interface 504, data representing the schematic representation 528 to the client device 214, 216. The backend server(s) 224 may then receive, using the network interface 504, data (e.g., selection data 532) from the client device 214, 216, where the selection data 532 indicates that the client device 214, 216 receive a selection of an interface element associated with a light emitter 232. Based on the selection data 532, the backend server(s) 224 may generate a first data packet 534 that includes data representing the identifier 536 of the light emitter 232 and data representing a command 538 to activate (if the light emitter 232 is deactivated) or data representing a command 538 to deactivate (if the light emitter 232 is activated). The backend server(s) 224 may then transmit, using the network interface 504, the first data packet 534 to the light emitter 232 (which may be via the hub device 202, the VA device 208, the A/V device 210, the electronic device 230, and/or another device).

In some examples, the backend server(s) 224 may perform similar processes and/or techniques for operating more than one light emitter 232. For example, the backend server(s) 224 may receive data (e.g., the selection data 532, the control data 540, etc.) associated with controlling a second light emitter 232. In some examples, based on the data, the backend server(s) 224 may add data to the first data packet 534 that further includes the identifier 536 of the second light emitter 232. Additionally, or alternatively, in some examples, based on the data, the backend server(s) 224 may generate a second data packet 534 that includes that includes data representing the identifier 536 of the second light emitter 232 and data representing a command 538 to activate (if the second light emitter 232 is deactivated) or data representing a command 538 to deactivate (if the second light emitter 232 is activated). The backend server(s) 224 may then transmit, using the network interface 504, the second data packet 534 to the second light emitter 232 (which may be via the hub device 202, the VA device 208, the A/V device 210, the electronic device 230, and/or another device). In either of the examples, the backend server(s) 224 may cause both the light emitter 232 and the second light emitter 232 to activate or deactivate.

In some examples, the backend server(s) 224 may use the grouping data 522 to cause other light emitters to activate or deactivate. For example, the backend server(s) 224 may use the grouping data 522 to determine that the light emitter 232 is included a similar group as at least a second light emitter 232. In some examples, based on the determination, the backend server(s) 224 may add data to the first data packet 534 that further includes the identifier 536 of the second light emitter 232. Additionally, or alternatively, in some examples, based on the determination, the backend server(s) 224 may generate a second data packet 534 that includes that includes data representing the identifier 536 of the second light emitter 232 and data representing a command 538 to activate (if the second light emitter 232 is deactivated) or data representing a command 538 to deactivate (if the second light emitter 232 is activated). The backend server(s) 224 may then transmit, using the network interface 504, the second data packet 534 to the second light emitter 232 (which may be via the hub device 202, the VA device 208, the A/V device 210, the electronic device 230, and/or another device). In either of the examples, the backend server(s) 224 may cause both the light emitter 232 and the second light emitter 232 to activate or deactivate based on the grouping data 522.

In some examples, the backend server(s) 224 may use the grouping data 522 to cause the A/V device 210 to generate and/or transmit image data 406. For example, the backend server(s) 224 may receive, using the network interface 504, motion data 412 generated by a light emitter 232, where the motion data 412 indicates that the light emitter 232 detected an object (and/or motion). The backend server(s) 224 may then determine, using the grouping data 522, that the light emitter 232 is associated with the A/V device 210. Based on motion data 412 and the grouping data 522, the backend server(s) 224 may transmit, using the network interface 504, a control signal 420 to the A/V device 210, where the control signal 420 is configured to cause the A/V device 210 to generate and/or transmit image data 406.

Figure 6:
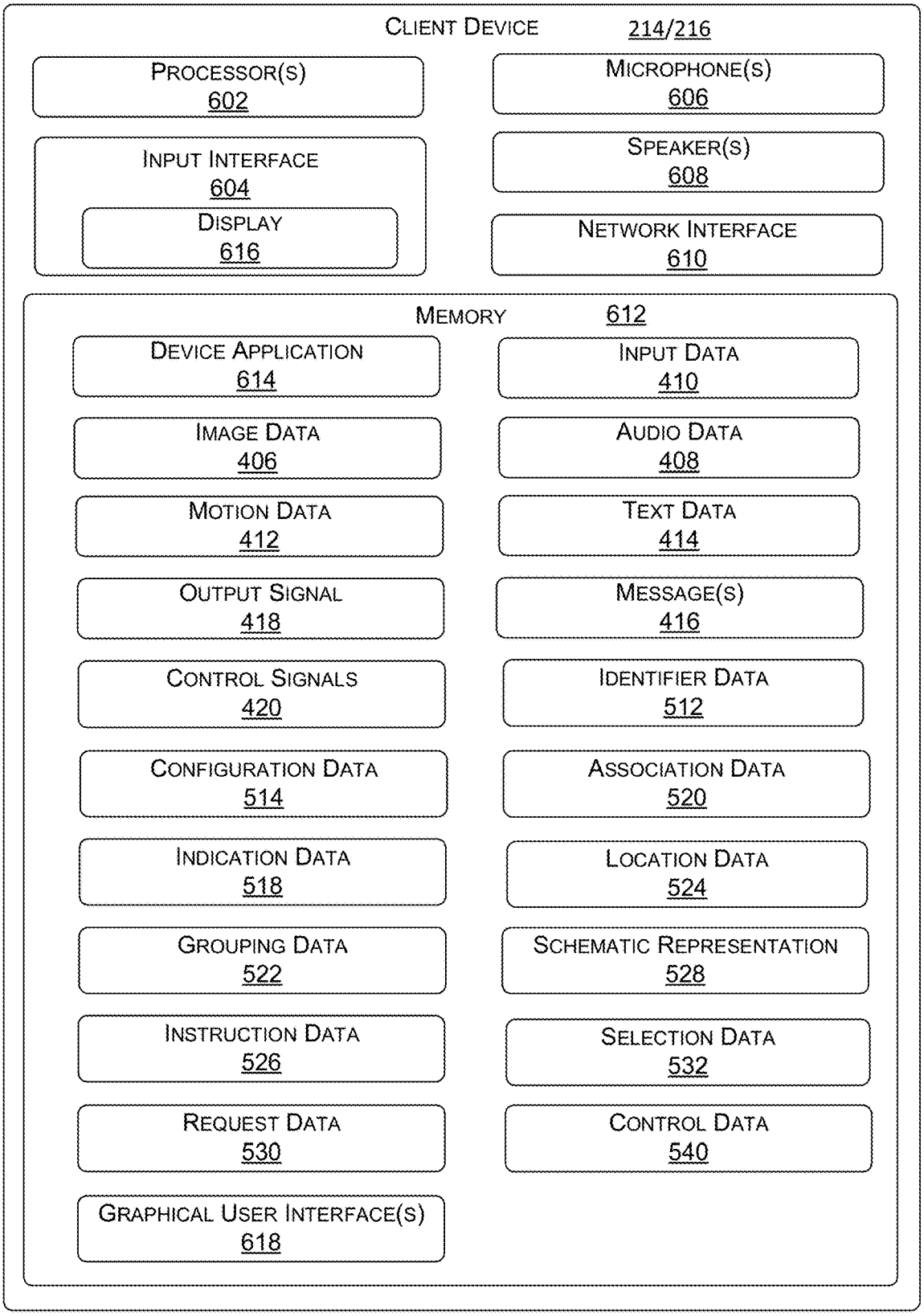
FIG. 6 is a functional block diagram illustrating one example embodiment of a client device, according to various aspects of the present disclosure.

Now referring to FIG. 6, FIG. 6 is a functional block diagram illustrating one embodiment of the client device 214, 216, according to various aspects of the present disclosure. The client device 214, 216 may comprise processor(s) 602 (which may be similar to, and/or include similar functionality as, the processor(s) 310) that are operatively connected to an input interface 604, microphone(s) 606 (which may be similar to, and/or include similar functionality as, the microphone(s) 328), speaker(s) 608 (which may be similar to, and/or include similar functionality as, the speaker(s) 330), a network interface 610 (which may be similar to, and/or include similar functionality as, the network interface 312), and memory 612 (which may be similar to, and/or include similar functionality as, the memory 402). The client device 214, 216 may further comprise a camera (not shown) operatively connected to the processor(s) 602.

The memory 612 may store a device application 614. In various embodiments, the device application 614 may include instructions that cause the processor(s) 602 to receive input(s) to the input interface 604 (e.g., input(s) to associate portion(s) of a FOV of an A/V device 210 with light emitter(s) 232, input(s) associated with controlling light emitter(s) 232, etc.). In addition, the device application 614 may include instructions that cause the processor(s) 602 to receive, using the network interface 610, the input data 410, the image data 406, the audio data 408, the output signal 418, the messages 416, the indication data 518, the association data 520, the grouping data 522, the instruction data 526, and/or the data representing the schematic representation 528 from one or more of the A/V device 210, the hub device 202, or the backend server(s) 224.

With further reference to FIG. 6, the input interface 604 may include a display 616. The display 616 may include a touchscreen, such that the user of the client device 214, 216 may provide inputs directly to the display 616 (e.g., input(s) to associate portion(s) of a FOV of an A/V device 210 with light emitter(s) 232, input(s) associated with controlling light emitter(s) 232, etc.). In some embodiments, the client device 214, 216 may not include a touchscreen. In such embodiments, and in embodiments where the client device 214, 216 includes the touchscreen, the user may provide an input using any input device, such as, without limitation, a mouse, a trackball, a touchpad, a j oystick, a pointing stick, a stylus, etc.

In some of the present embodiments, in response to receiving a message 416, the device application 614 may include instructions that cause the processor(s) 602 to display the message 416 on the display 616. The message 416 may indicate that an A/V device 210 detected motion, detected the presence of an object, received a touch input (e.g., at the button 306), detected an event, etc. While displaying the message 416, the input interface 604 may receive input from the user to answer the message 416. In response, the device application 614 may include instructions cause the processor(s) 602 to display image(s) and/or video footage represented by the image data 406 on the display 616.

In some examples, the client device 214, 216 may receive, using the input interface 604, an input associated with configuring light emitter(s) 232. Based on the input, the client device 214, 216 may transmit, using the network interface 610, the configuration data 514 to network device(s) (e.g., the backend server(s) 224, the hub device 202, the VA device 208, etc.). The client device 214, 216 may then receive, using the network interface 610, the first image data 406, the identifier data 512, and/or the indication data 518 from the network device(s). The client device 214, 216 may then display a graphical user interface (GUI) 618 that includes the first image(s) represented by the first image data 406. Additionally, in some examples, and using the identifier data 518, the GUI 618 may display the identifier(s) of the light emitter(s) 232 that are being configured. Furthermore, in some examples, and using the indication data 518, the GUI 618 may include interface element(s) located at the portion(s) of the first image(s) that potentially represent the light emitter(s) 232.

While displaying the GUI 618, the client device 214, 216 may receive input(s) associating portion(s) of the FOV of the A/V device 210 with the identifier(s) of the light emitter(s) 232. For a first example, such as if the GUI 618 includes the interface element(s), the client device 214, 216 may receive, using the input interface 604, input associating an identifier of a light emitter 232 with an interface element. In some examples, the input may include a selection of the identifier and a selection of the interface element. In some examples, the input may correspond to a drag-and-drop input where the identifier is selected and dropped on the interface element. In either example, the client device 214, 216 may generate association data 520 indicating an association between the identifier of the light emitter 232 and the interface element. The client device 214, 216 may then store the association data 520. In some examples, the client device 214, 216 may further transmit, using the network interface 610, the association data 520 to the network device(s). The client device 214, 216 may then perform similar processes and/or techniques to generate association data 520 for one or more of the other light emitter(s) 232.

For a second example, such as if the GUI 618 does not include the interface element(s), the client device 214, 216 may receive, using the input interface 604, input associating an identifier of a light emitter 232 with a portion of the first image(s). In some examples, the input may include a selection of the identifier and a selection of the potion of the first image(s). In some examples, the input may correspond to a drag-and-drop input where the identifier is selected and dropped on the portion of the first image(s). In either example, the client device 214, 216 may generate association data 520 indicating an association between the identifier of the light emitter 232 and the portion of the first image(s). The client device 214, 216 may then store the association data 520. In some examples, the client device 214, 216 may further transmit, using the network interface 610, the association data 520 to the network device(s). The client device 214, 216 may then perform similar processes and/or techniques to generate association data 520 for one or more of the other light emitter(s) 232.

In some examples, before generating the association data 520, the client device 214, 216 may determine that the portion of the first image(s) corresponds to a portion of the FOV of the A/V device 210 (e.g., using the processes described above with respect to the backend server(s) 224). The client device 214, 216 may then generate association data 520 indicating an association between the identifier of the light emitter 232 and the portion of the FOV of the A/V device 210. In some examples, the client device 214, 216 may determine that the portion of the first image(s) (and/or the input) corresponds to a portion of the display 616. The client device 214, 216 may then generate association data 520 indicating an association between the identifier of the light emitter 232 and the portion of the display 616. In either of the examples, the client device 214, 216 may perform similar processes and/or techniques to generate association data 520 for one or more of the other light emitter(s) 232. The client device 214, 216 may then store the association data 520 and/or transmit, using the network interface 610, the association data 520 to the network device(s).

In some examples, the client device 214, 216 may then group the light emitter(s) 232 (and/or at least a portion of the light emitter(s) 232) that are located within the FOV of the A/V device 210. For example, the client device 214, 216 may store data (e.g., grouping data 522) that indicates that the light emitter(s) 232 that are located within the FOV of the A/V device 210 are associated with one another. In some examples, the client device 214, 216 may further receive, using the input interface 604, input indicating that one or more additional light emitters 232, which may not be located within the FOV of the A/V device 210, are to be grouped with the light emitter(s) 232 located within the FOV of the A/V device 210. In such examples, the grouping data 522 may further indicate that the one or more additional light emitters 232 are associated with the light emitter(s) 232 located within the FOV of the A/V device 210.

Additionally to, or alternatively from, configuring the light emitter(s) 232 using the first image data 406, in some examples, the client device 214, 216 may receive, using the network interface 610, instruction data 526 from the network interface(s). Using the instruction data 526, the client device 214, 216 may display a GUI 618 that includes the identifier of a light emitter 232 and/or includes instructions to place the client device 214, 216 within the threshold distance to the light emitter 232. The client device 214, 216 may then determine when the client device 214, 216 is within the threshold distance to the light emitter 232. In some examples, the client device 214, 216 makes the determination based on receiving, using the input interface 604, an input indicating that the client device 214, 216 is within the threshold distance. In some examples, the client device 214, 216 makes the determination based on establishing a network connection, using the network interface 610, with the light emitter 232 (e.g., transmitting data to, and/or receiving data from, the light emitter 232 using the network interface 610). In either example, the client device 214, 216 may then transmit, using the network interface 610, location data 524 to the network device(s), where the location data 524 indicates the geographic location of the client device 214, 216. The client device may then perform similar processes and/or techniques for one or more of the other light emitter(s) 232.

In some examples, the client device 214, 216 may operate the light emitter(s) 232 using the association data 520. For example, the client device 214, 216 may receive, using the network interface 610, the second image data 406 and/or the association data 520 from the network device(s). In some examples, the client device 214, 216 may receive the second image data 406 and/or the association data 520 based on transmitting, using the network interface 610, the request data 530 to the network device(s), where the request data 530 indicates a request to operate the light emitter(s) 232. In some examples, the client device 214, 216 may receive the second image data 406 and/or the association data 520 based on the A/V device 210 detecting an object (and/or motion). In some examples, the client device 214, 216 may receive the second image data 406 and/or the association data 520 based on a current time. For example, the current time may be associated with a sunset at a geographic location of the environment at which the light emitter(s) 232 are located. Still, in some examples, the client device 214, 216 may receive the second image data 406 and/or the association data 520 based on the A/V device 210 (and/or one of the light emitter(s) 232) determining an amount of ambient light is below a threshold amount of ambient light.

The client device 214, 216 may then display a GUI 618 that includes the second image(s) represented by the second image data 406. Additionally, in some examples, and using the association data 520, the GUI 618 may include interface element(s) located at the portion(s) of the second image(s) that represent the light emitter(s) 232. While displaying the GUI 618, the client device 214, 216 may receive input(s) associated with operating the light emitter(s) 232.

For a first example, such as if the GUI 618 includes the interface element(s), the client device 214, 216 may receive, using the input interface 604, input selecting an interface element associated with a light emitter 232. In some examples, based on the input, the client device 214, 216 may transmit, using the network interface 610, selection data 532 to the network device(s), where the selection data 532 indicates the selection of the interface element associated with the light emitter 232. Additionally, or alternatively, in some examples, based on the input, the client device 214, 216 may transmit, using the network interface 610, control data 540 to the network device(s), where the control data 540 indicates the identifier 536 of the light emitter 232 and a command 538 to activate (e.g., if the light emitter 232 is deactivated) or a command 538 to deactivate (e.g., if the light emitter 232 is activated).

For a second example, such as if the GUI 618 does not include the interface element(s), the client device 214, 216 may receive, using the input interface 604, input selecting a portion of the second image(s) that represents a light emitter 232. In some examples, based on the input and using the association data 520, the client device 214, 216 may determine that the portion of the second image(s) corresponds to the portion of the FOV of the A/V device 210 that is associated with the light emitter 232. In some examples, based on the input and using the association data 520, the client device 214, 216 may determine that the portion of the second image(s) corresponds to the portion of the first image(s) that is associated with the light emitter 232. Still, in some examples, based on the input, the client device 214, 216 may determine a portion of the display at which the input occurred. The client device 214, 216 may then determine, using the association data 520, that the portion of the display 616 corresponds to the portion of the display 616 that is associated with the light emitter 232. In either example, the client device 214, 216 may transmit, using the network interface 610, control data 540 to the network device(s), where the control data 540 indicates the identifier 536 of the light emitter 232 and a command 538 to activate (e.g., if the light emitter 232 is deactivated) or a command 538 to deactivate (e.g., if the light emitter 232 is activated).

For a third example, and again if the GUI 618 does not include the interface element(s), the client device 214, 216 may receive, using the input interface 604, input selecting a portion of the second image(s) that represents a light emitter 232. Based on the input, the client device 214, 216 may transmit, using the network interface 610, selection data 532 to the network device(s), where the selection data 532 indicates that the client device 214, 216 received the input selecting the portion of the second image(s) represented by the second image data 406.

Additionally to, or alternatively from, controlling the light emitter(s) 232 using the second image data 406, the client device 214, 216 may receive, using the input interface 610, the data representing the schematic representation 528. The client device 214, 216 may then display a GUI 618 that includes the schematic representation 528. While displaying the schematic representation 528, the client device 214, 216 may receive, using the input interface 504, input selecting an interface element associated with a light emitter 232. In some examples, based on the input, the client device 214, 216 may transmit, using the network interface 610, selection data 532 to the network device(s), where the selection data 532 indicates the selection of the interface element associated with the light emitter 232. Additionally, or alternatively, in some examples, based on the input, the client device 214, 216 may transmit, using the network interface 610, control data 540 to the network device(s), where the control data 540 indicates the identifier 536 of the light emitter 232 and a command 538 to activate (e.g., if the light emitter 232 is deactivated) or a command 538 to deactivate (e.g., if the light emitter 232 is activated).

In either of the examples above, the client device 214, 216 may perform similar processes and/or techniques for controlling one or more of the other light emitter(s) 232. In some examples, the selection data 532 may indicate one or more of the input(s) received by the client device 214, 216. In some examples, the client device 214, 216 may transmit new selection data 532 for each time a respective input is received by the client device 214, 216. In some examples, the control data 540 may indicate the respective identifier of one or more of the light emitter(s) 232 for which an input was received. Still, in some examples, the client device 214, 216 may transmit new control data 540 each time a respective input is received by the client device 214, 216.

In some examples, after transmitting selection data 532 and/or control data 540, the client device 214, 216 may receive, using the network interface 610, the third image data 406 from the network device(s). The client device 214, 216 may then display third image(s) represented by the third image data 406, where the third image(s) depict the light emitter(s) 232 as having activated or deactivated.

Figure 7:
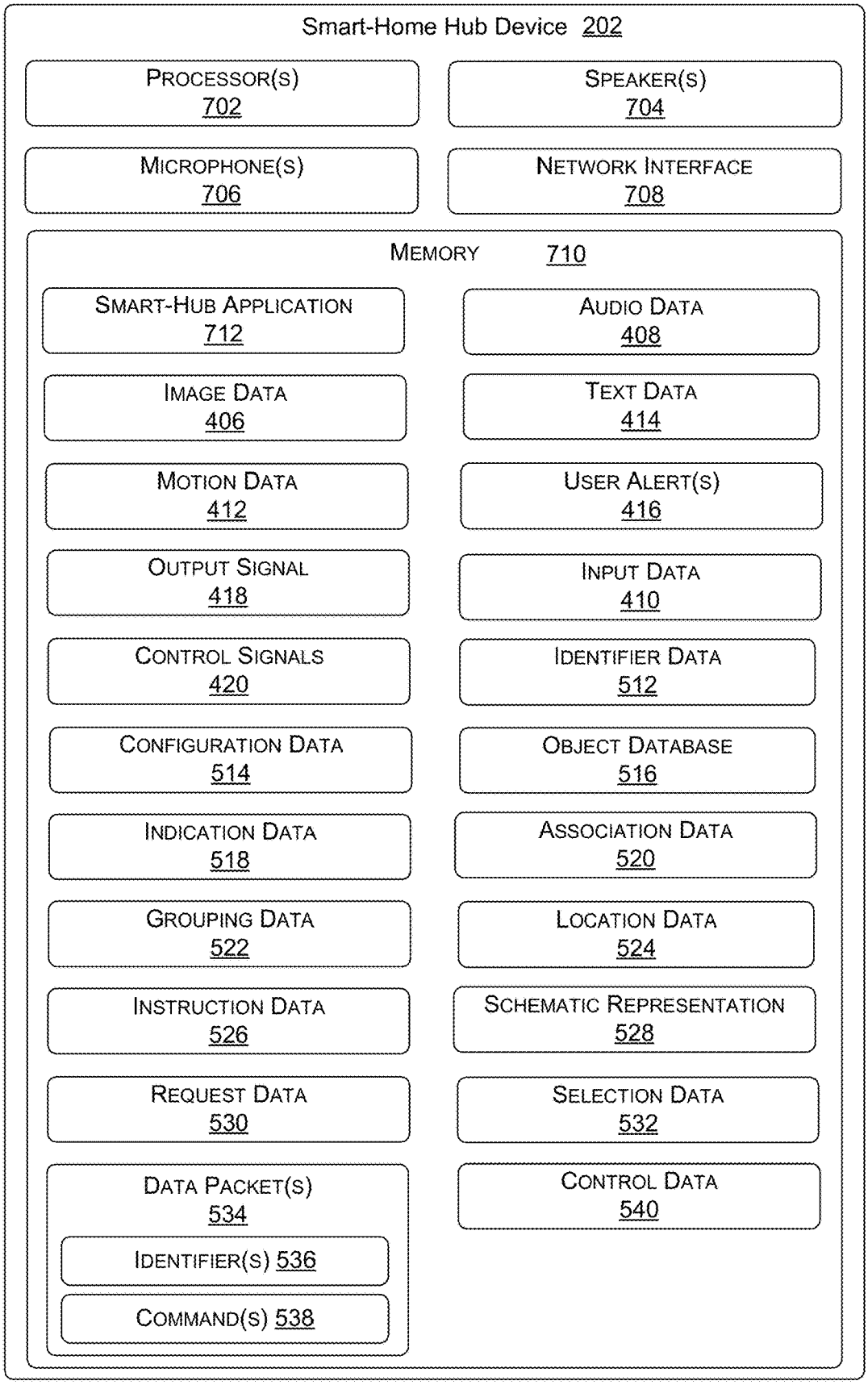
FIG. 7 is a functional block diagram illustrating one example embodiment of a hub device, according to various aspects of the present disclosure.

FIG. 7 is a functional block diagram illustrating an embodiment of the smart-home hub device 202 (alternatively referred to herein as the "hub device 202") according to various aspects of the present disclosure. The hub device 202 may be, for example, one or more of a Wi-Fi hub, a smart-home hub, a hub of a home security/alarm system, a gateway device, a hub for a legacy security/alarm system (e.g., a hub for connecting a pre-existing security/alarm system to the network (Internet/PSTN) 212 for enabling remote control of the hub device 202), and/or another similar device. In some examples, the hub device 202 may include the functionality of the VA device 208. The hub device 202 may comprise processor(s) 702 (which may be similar to, and/or include similar functionality as, the processor(s) 310) that are operatively connected to speaker(s) 704 (which may be similar to, and/or include similar functionality as, the speaker(s) 330), microphone(s) 706 (which may be similar to, and/or include similar functionality as, the microphone(s) 328), a network interface 708 (which may be similar to, and/or include similar functionality as, the network interface 310), and memory 710 (which may be similar to, and/or include similar functionality as, the memory 402). In some embodiments, the hub device 202 may further comprise a camera (not shown). In some embodiments, the hub device 202 may not include one or more of the components shown in FIG. 7, such as the speaker(s) 704 and/or the microphone(s) 706.

As shown in the example of FIG. 7, the memory 710 stores a smart-home hub application 712. In various embodiments, the smart-home hub application 712 may include instructions that cause the processor(s) 702 to receive sensor data from the sensors 204, the automation devices 206, the A/V devices 210, and/or other electronic devices (e.g., the electronic devices 230). As discussed herein, in some examples, the sensor data may include a current state (e.g., opened/closed for door and window sensors, motion detected for motion sensors, living room lights on/off for a lighting automation system, etc.) of each of the sensors 204, the automation devices 206, and/or other electronic devices. In some of the present embodiments, the sensor data may be received in response to sensor triggers. The sensor triggers may be a door opening/closing, a window opening/closing, lights being turned on/off, blinds being opened/closed, etc. As such, the sensor data may include the current state of the sensors 204, the automation devices 206, and/or other electronic devices, as well as any updates to the current state based on sensor triggers.

With further reference to FIG. 7, the smart-home hub application 712 may include instructions that cause the processor(s) 702 to receive the audio data 408, the text data 414, the image data 406, the motion data 412, the input data 410, and/or the messages 416, from the A/V device 210 (in some embodiments, via the backend server(s) 224) using the network interface 708. For example, the hub device 202 may receive and/or retrieve (e.g., after receiving a signal from the A/V device 210 that the A/V device 210 has been activated) the image data 406, the input data 410, and/or the motion data 412 from the A/V device 210 and/or the backend server(s) 224 in response to motion being detected by the A/V device 210. The smart-hub application 712 may further include instructions that cause the processor(s) 702 to transmit, using the network interface 708, the audio data 408, the text data 414, the image data 406, the motion data 412, the input data 410, and/or the messages 416 to the client device 214, 216, the backend server(s) 224, and/or an additional electronic device.

As described herein, at least some of the processes of the A/V device 210, the backend server(s) 224, and/or the client device 214, 216 may be executed by the hub device 202. For example, the hub device 202 may perform at least some of the processes described above with regard to the backend server(s) 224 in order to associate the light emitter(s) 232 with the FOV of the A/V device 210. Additionally, the hub device 202 may perform at least some of the processes described above with regard to the backend server(s) 224 to generate the schematic representation 528 of the environment. Furthermore, the hub device 202 may perform at least some of the processes described above with regard to the backend server(s) 224 in order to control the light emitter(s) 232 using the data packet(s) 534.

Figure 8:
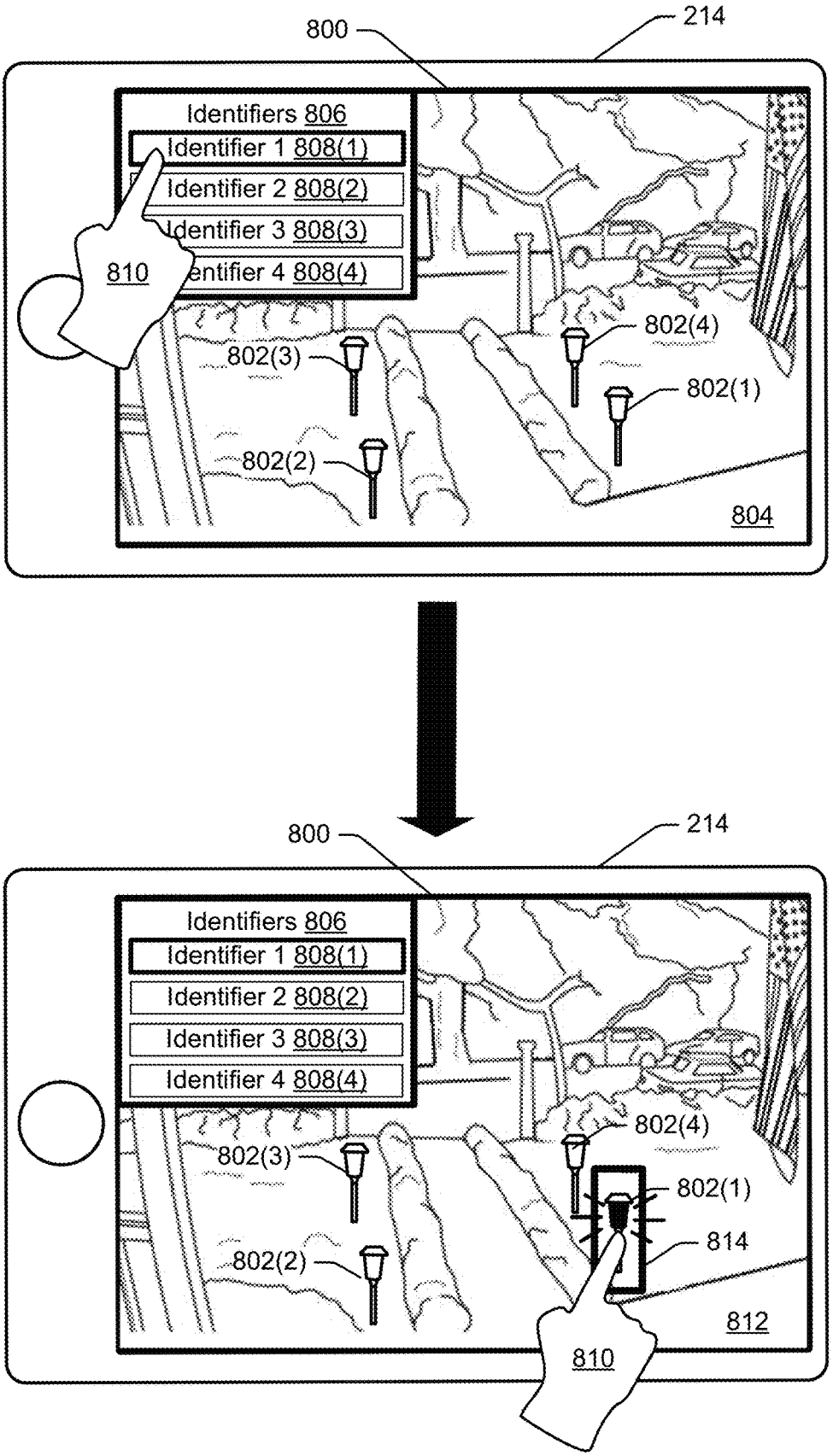
FIG. 8 illustrates an example of a graphical user interface (GUI) for associating light emitters with a field of view (FOV) of an A/V device, according to various aspects of the present disclosure.

FIG. 8 illustrates a GUI 800 (which may be an example of the GUI 618 (FIG. 6)) for associating light emitters 802(1)-(4) (which may represent, and/or be similar to, the light emitter(s) 232) with the FOV of the A/V device 210, according to various aspects of the present disclosure. For example, at a first time, the GUI 800 may include image(s) 804 represented by image data 406. The GUI 800 may further include a list of identifiers 806 associated with the light emitters 802(1)-(4). For example, a first identifier 808(1) may be associated with the first light emitter 802(1), a second identifier 808(2) may be associated with the second light emitter 802(2), a third identifier 808(3) may be associated with the third light emitter 802(3), and a fourth identifier 808(4) may be associated with the fourth light emitter 802(4).

In some examples, one or more of the identifiers 808(1)-(4) included in the GUI 800 may be associated with a respective interface element that is selectable to control a respective light emitter 802(1)-(4). For example, and as shown by the top illustration of the client device 214, the client device 214 may receive, from a user 908, an input selecting the interface element associated with the first identifier 808(1). In some examples, based on the input, the client device 214 may transmit selection data 532 to the network device(s), where the selection data 532 indicates the selection of the first identifier 808(1) (and/or the interface element). In some examples, based on the input, the client device 214 may transmit control data 540 to the network device(s), where the control data 540 includes data representing the first identifier 808(1) and a command to activate. In either example, the network device(s) may cause the first light emitter 802(1) to activate.

Next, at a second time and as illustrated by the bottom illustration of the client device 214, the GUI 800 may include image(s) 812 represented by additional image data 406. As shown, the image(s) 812 represent the first light emitter 802(1) as being activated (e.g., the image(s) 812 represent the first light emitter 8082(1) as emitting light). The user 810 may then use the image(s) 812 to determine which of the light emitter(s) 802(1)-(4) includes the first light emitter 802(1) associated with the first identifier 808 (1). Additionally, and as illustrated in the example of FIG. 8, the client device 214 may receive, from the user 810, an input indicating a portion 814 of the image(s) 812 that is associated with the first light emitter 814. Using the indication, the client device 214 and/or the network device(s) may generate association data 520 that associates a portion of the FOV of the A/V device 210 with the first identifier 808(1) associated with the first light emitter 802(1), where the portion of the FOV of the A/V device 210 corresponds to the portion 814 of the image(s) 812.

Figure 9A:
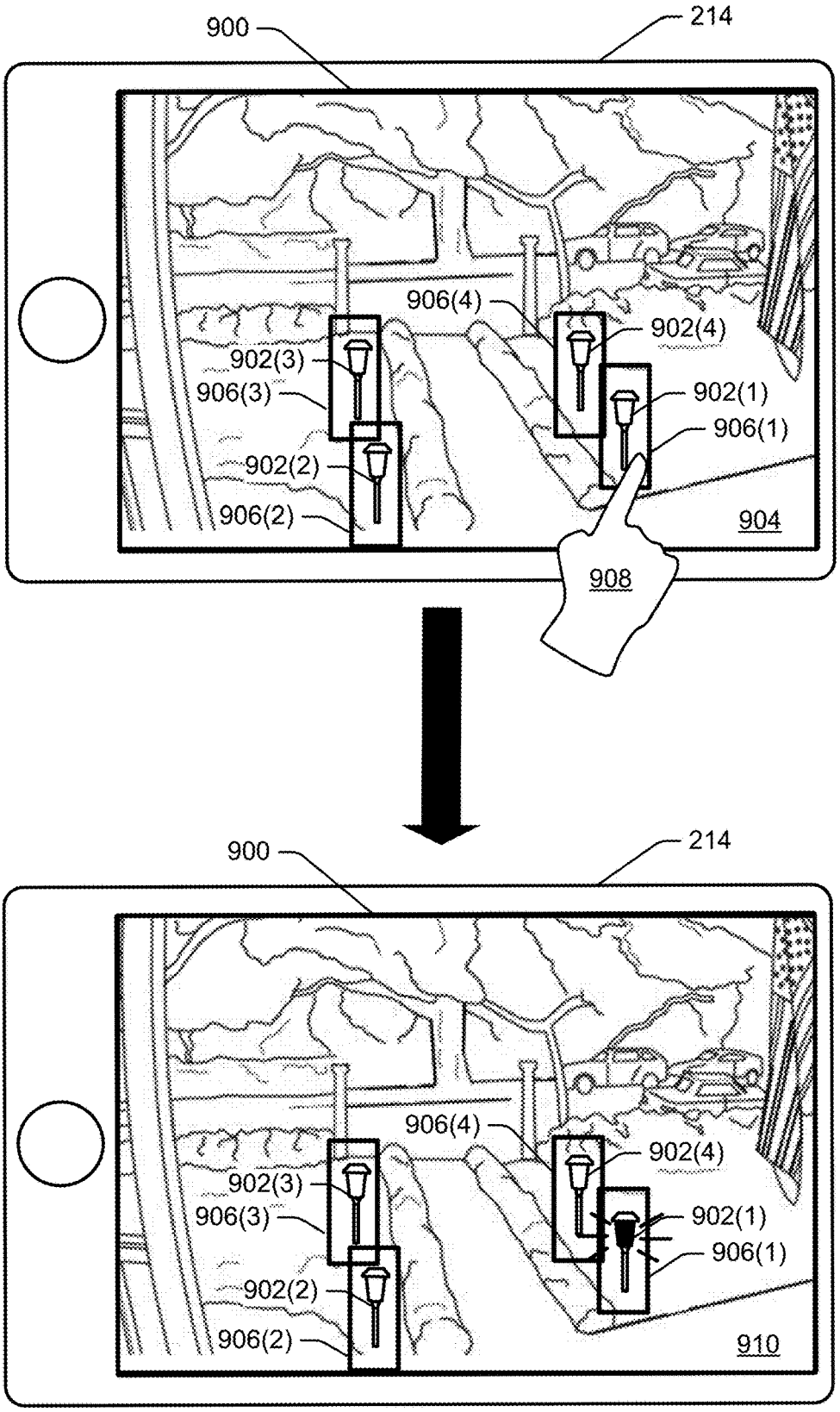
FIG. 9A illustrates an example of using a GUI to activate a light emitter, according to various aspects of the present disclosure.

FIG. 9A illustrates an example of using a GUI 900 (which may be another example of the GUI 618 (FIG. 6)) to activate light emitters 902(1)-(4) (which may represent, and/or be similar to, the light emitter(s) 232), according to various aspects of the present disclosure. For example, at a first time and as illustrated in the top illustration of the client device 214, the client device 214 may be displaying the GUI 900 that includes image(s) 904 represented by image data 406. Additionally, the GUI 900 includes interface elements 906(1)-(4) associated with the light emitters 902(1)-(4). For example, a first interface element 906(1) may be associated with controlling the first light emitter 902(1), a second interface element 906(2) may be associated with controlling the second light emitter 902(2), a third interface element 906(3) may be associated with controlling the third light emitter 902(3), and a fourth interface element 906(4) may be associated with controlling the fourth light emitter 902(4). In some examples, the interface elements 906(1)-(4) may be visible to a user 908 (e.g., the client device 214 is displaying the interface elements 906(1)-(4)). In other examples, the interface elements 906(1)-(4) may not be visible to the user 908 (e.g., the client device 214 is not displaying the interface elements 906(1)-(4)).

For example, the client device 214 may receive, from the user 908, an input selecting the first interface element 906(1). In some examples, based on the input, the client device 214 may transmit selection data 532 to the network device(s), where the selection data 532 indicates the selection of the first interface element 906(1). In some examples, based on the input, the client device 214 may transmit control data 540 to the network device(s), where the control data 540 includes data representing a first identifier associated with the first light emitter 902(1) and a command to activate. In either example, the network device(s) may cause the first light emitter 902(1) to activate. Additionally, at a second time and as illustrated in the bottom illustration of the client device 214, the GUI 900 may include image(s) 910 represented by additional image data, where the image(s) 910 represent the first light emitter 902(1) as being activated (e.g., the image(s) 910 represent the first light emitter 902(1) emitting light).

In some examples, the image(s) being displayed by the client device 214 may represent an electronic device 230 that controls the light emitters 902(1)-(4). In such examples, the user 908 may be able to control the light emitters 902(1)-(4) may selecting a portion of the image(s) that represents the electronic device 230 and/or selecting an interface element associated with the electronic device. For example, based on the input, the client device 214 may transmit selection data 532 to the network device(s), where the selection data 532 indicates the selection of the portion of the image(s) that represents the electronic device 230. In some examples, based on the input, the client device 214 may transmit control data 540 to the network device(s), where the control data 540 includes data representing an identifier associated with the electronic device 230 and a command to activate. In either example, the network device(s) may cause one or more light emitters 902(1)-(4) that are controlled by the electronic device 230 to activate.

Figure 9B:
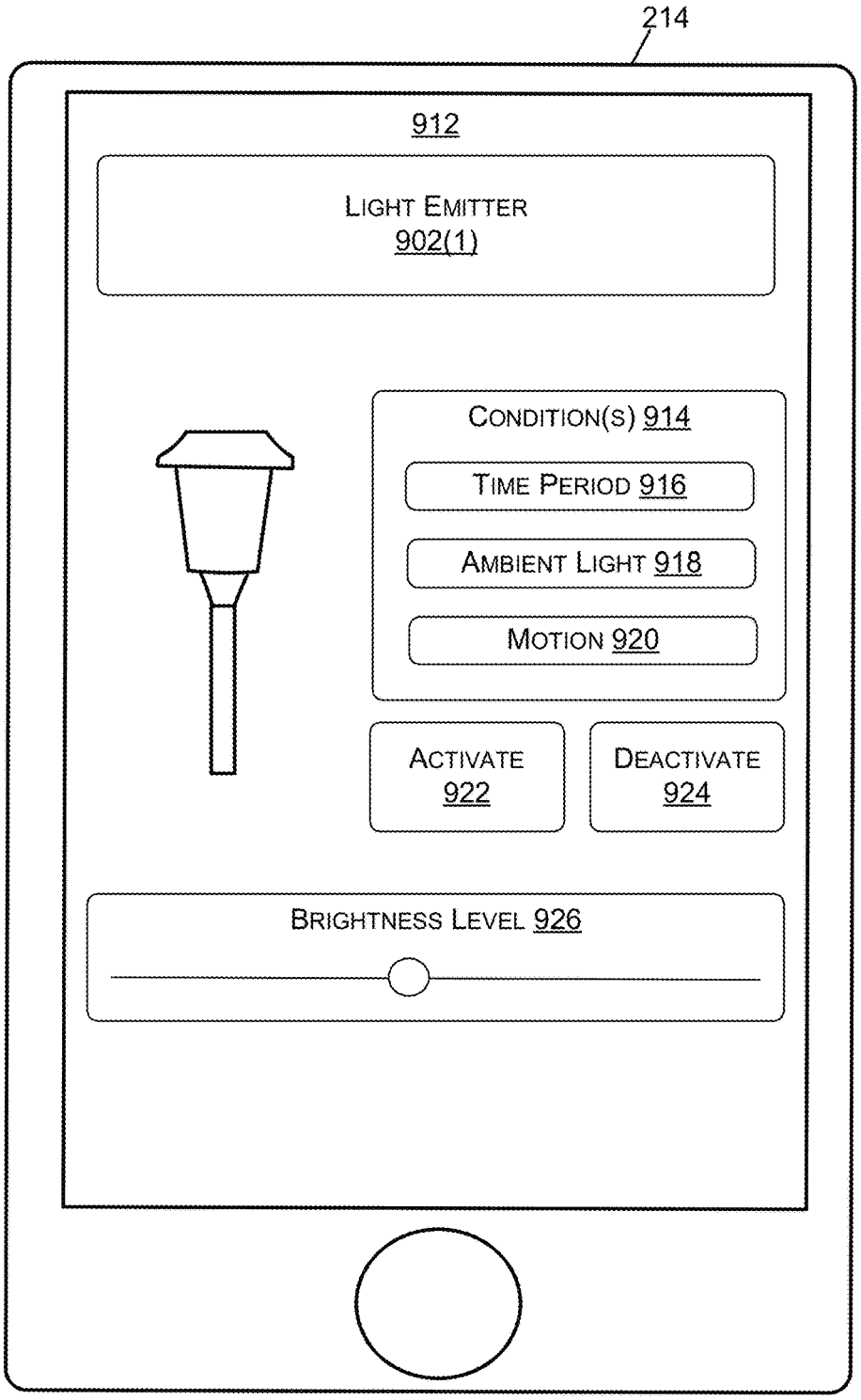
FIG. 9B illustrates an example GUI for controlling settings for a light emitter, according to various aspects of the present disclosure.

FIG. 9B illustrates an example GUI 912 (which may represent one of the GUIs 618 (FIG. 6)) for controlling settings for the first light emitter 902(1) after the selection in FIG. 9A, according to various aspects of the present disclosure. For example, based on the client device 214 receiving the input selectin the first light emitter 902(1) and/or the first interface element 906(1), the client device 214 may display the GUI 912. As shown, the GUI 912 allows the user to update condition(s) 914 for the first light emitter 902(1). For example, the GUI 912 includes a first control 916 for indicating a time period at which the first light emitter 902(1) is to activate. The GUI 912 further includes a second control 918 for indicating an amount of ambient light at which the first light emitter 902(1) is to activate. Furthermore, the GUI 912 includes a third control 920 for indicating a device (e.g., A/V device 210, sensor 204, etc.) for which, when motion is detected by the device, the first light emitter 902(1) is to activate.

In some examples, the GUI 912 may further include a fourth control 922 for activating the first light emitter 902(1). Additionally, the GUI 912 may further include a fifth control 924 for deactivating the first light emitter 902(1). Furthermore, the GUI 912 may further include a sixth control 926 for controlling the brightness level of the first light emitter 902(1). In the example of FIG. 9B, the sixth control 926 may include a slider that the user may use to change the brightness level of the first light emitter 902(1). However, in other example, the sixth control 926 may include any other input control that the user may use to change the brightness level of the first light emitter 902(1). In other examples, any number of other controls may be included for changing or setting the intensity, hue, color, pattern, and/or other settings of the first light emitter 902(1).

While displaying the GUI 912, the client device 214 may receive an input selecting of one of the controls 916-926. In some examples, based on the input, the client device 214 may transmit selection data 532 to the network device(s), where the selection data 532 indicates the selection of the control 916-926. In some examples, based on the input, the client device 214 may transmit control data 540 to the network device(s), where the control data 540 includes data representing a first identifier associated with the first light emitter 902(1) and a command to perform the action associated with the selected control 916-926. In either example, the network device(s) may cause the first light emitter 902(1) to perform the action. For example, the network device(s) may generate a data packet 534, where the data packet 534 includes data representing a first identifier 536 associated with the first light emitter 902(1) and a command 538 to perform the action associated with the selected control 916-926. The network device(s) may then transmit the data packet 534 to the first light emitter 902(1).

Figure 10:
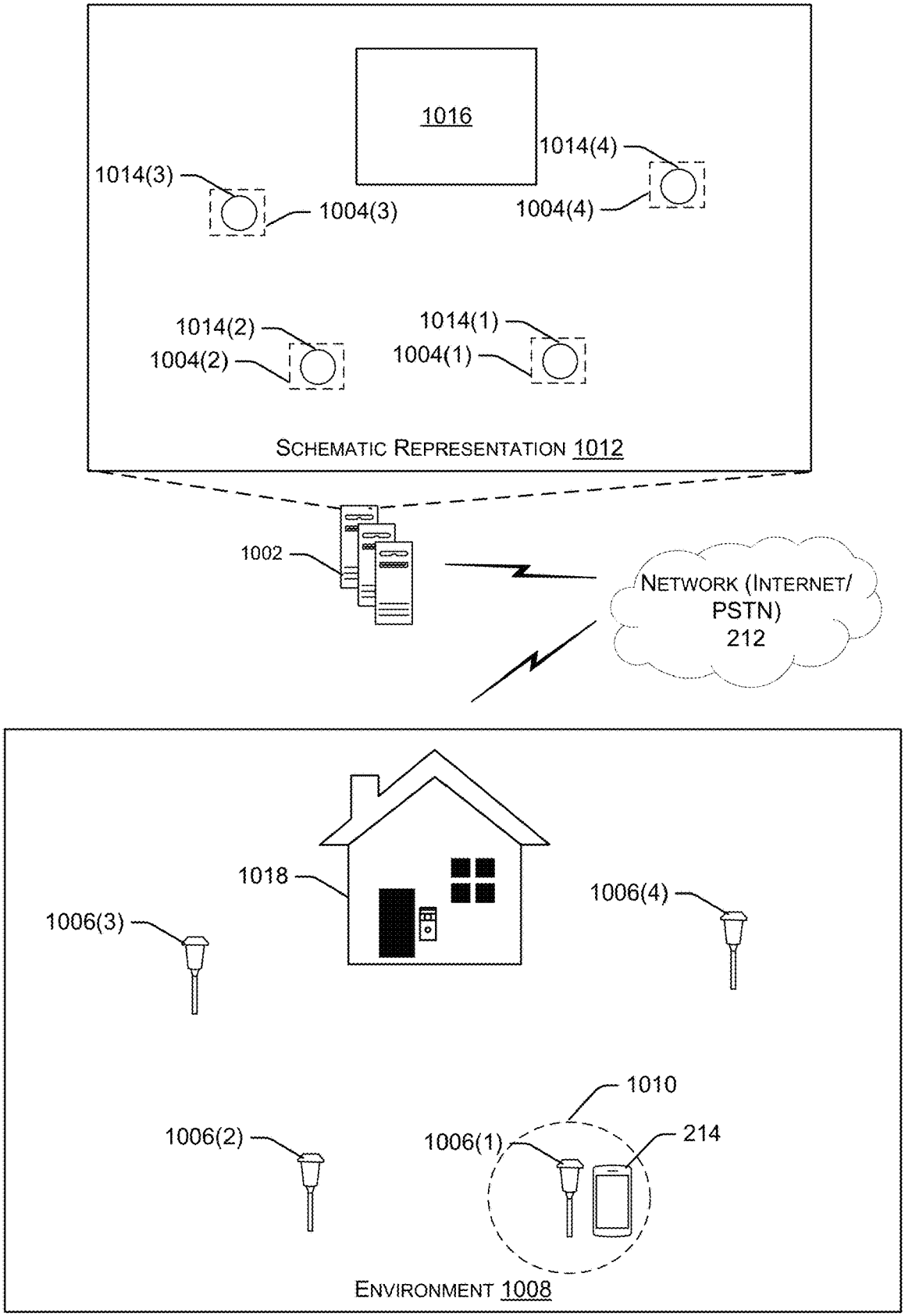
FIG. 10 is a schematic diagram illustrating an example of network device(s) determining locations of light emitters using geographic data associated with a client device, according to various aspects of the present disclosure.

FIG. 10 illustrates an example of network device(s) 1002 (e.g., the backend server(s) 224, the hub device 202, the VA device 208, etc.) determining geographic locations 1004(1)-(4) of light emitters 1006(1)-(6) (which may represent, and/or be similar to, the light emitter(s) 232) using location data 524 associated with the client device 214, according to various aspects of the present disclosure. For example, a user may install the light emitters 1006(1)-(4) at various locations of an environment 1008. To configure the first light emitter 1006(1), the network device(s) 1002 may transmit instruction data 526 to the client device 214, where the instruction data 526 represents an identifier of the first light emitter 1006(1) and/or includes instructions to place the client device 214 within a threshold distance 1010 to the first light emitter 102(1).

Once the client device 214 is located within the threshold distance 1010 to the first light emitter 1006(1), the network device(s) 1002 may receive location data 524 from the client device 214, where the location data 524 indicates a first geographic location 1004(1) of the client device 214. The network device(s) 1002 may then generate first association data 520 that associates the first geographic location 1004(1) with the first light emitter 1006(1). Additionally, the network device(s) 1002 and the client device 214 may perform similar processes to generate second association data 520 that associates the second geographic location 1004(2) with the second light emitter 102(2), generate third association data 520 that associates the third geographic location 1004 (3) with the third light emitter 1006(3), and generate fourth association data 520 that associates the fourth geographic location 1004(4) with the fourth light emitter 1006(4).

In some examples, the network device(s) 1002 may then generate a schematic representation 1012 (which may represent, and/or further include, a schematic representation 528) of the environment 1008. As shown, the schematic representation 1012 includes a first interface element 1014 (1) representing the first light emitter 1006(1) located at the first geographic location 1004(1), a second interface element 1014(2) representing the second light emitter 1006(2) located at the second geographic location 1004(2), a third interface element 1014(3) representing the third light emitter 1006(3) located at the third geographic location 1004(3), and a fourth interface element 1014(4) representing the fourth light emitter 1006(4) located at the fourth geographic location 1004(4). The schematic representation 1012 further includes a graphical element 1016 representing the house 1018 located on the environment.

Each of the processes described herein, including the processes 1100, 1200, 1300, 1400, 1500, 1600, 1700, 1800, and 1900 are illustrated as a collection of blocks in a logical flow graph, which represent a sequence of operations that may be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks may be combined in any order and/or in parallel to implement the processes. Additionally, any number of the described blocks may be optional and eliminated to implement the processes.

Figure 11A:
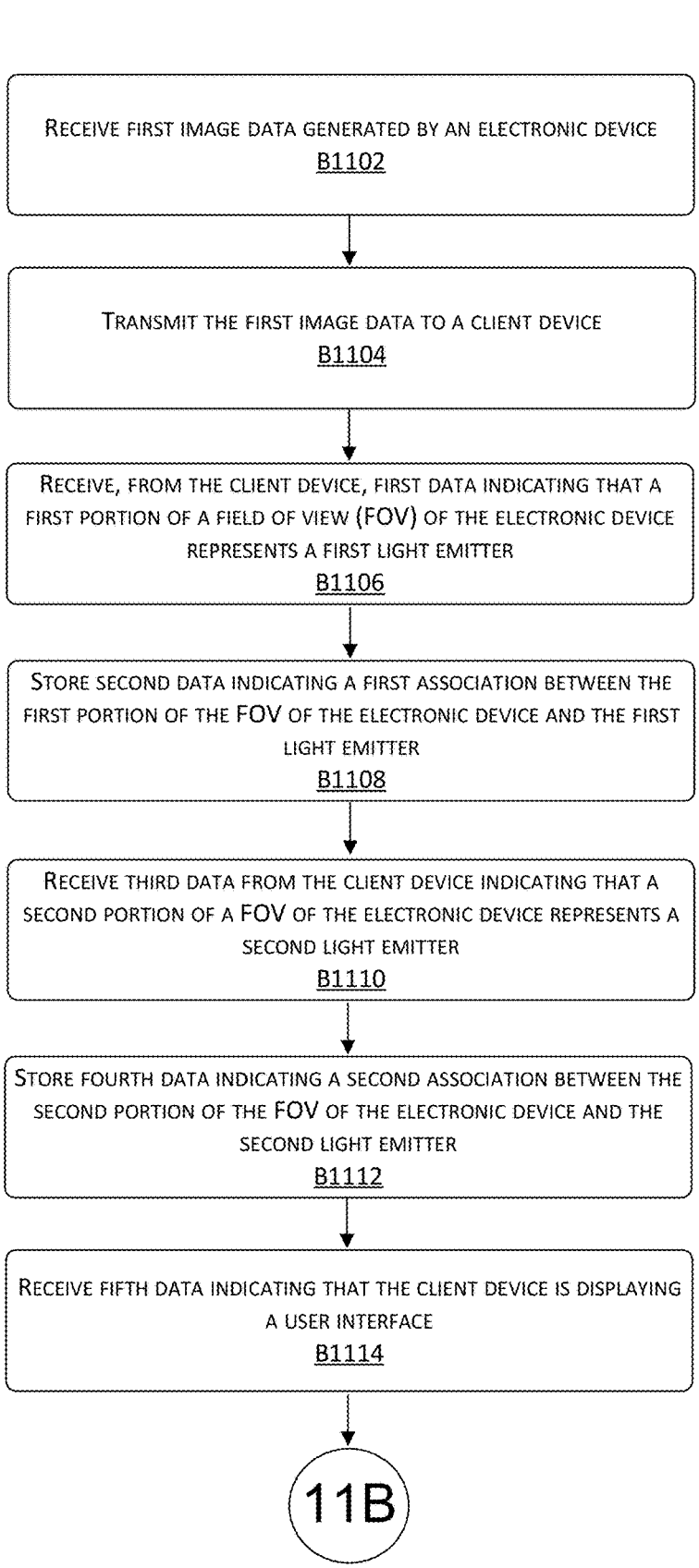
FIGS. 11A-11B are a flowchart illustrating an example process of configuring light emitters using image data generated by an A/V device, according to various aspects of the present disclosure.
Figure 11B:
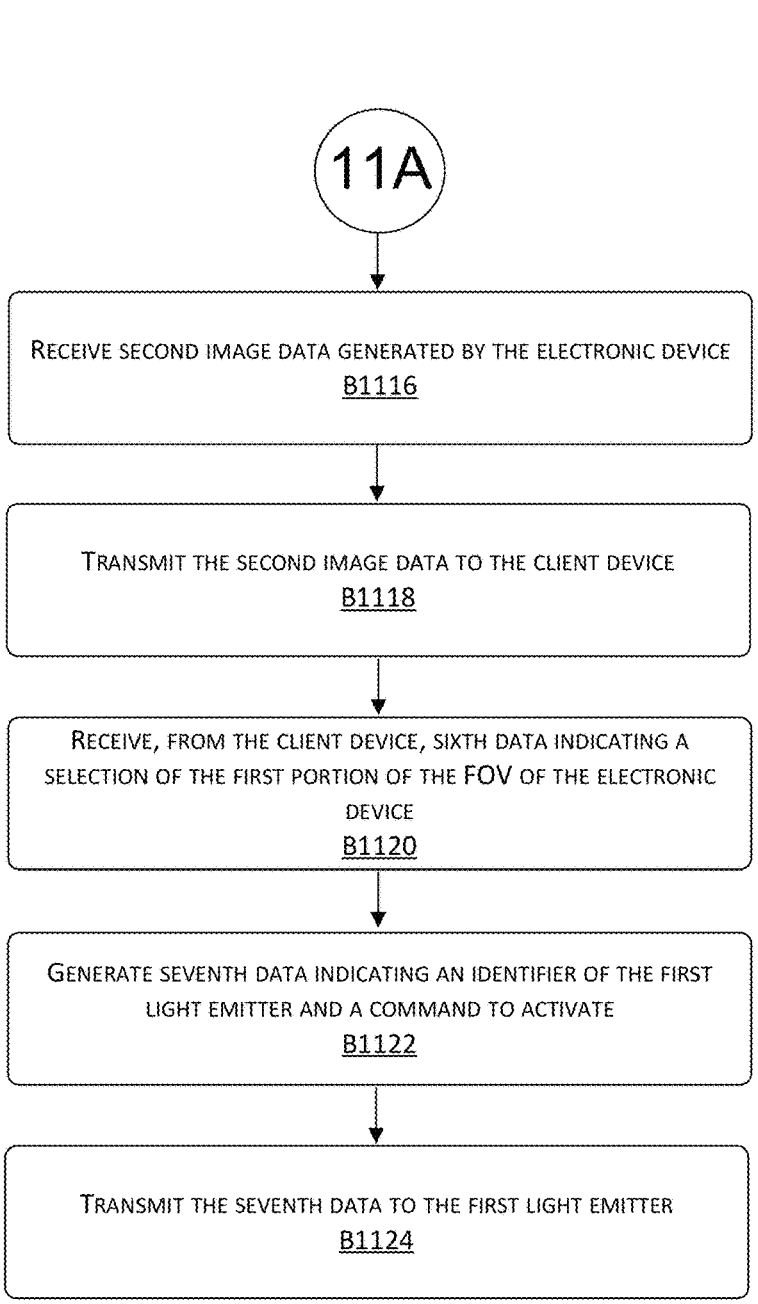

FIGS. 11A-11B are a flowchart illustrating an example process 1100 of configuring light emitters using image data generated by an A/V device, according to various aspects of the present disclosure. The process 1100, at block B1102, includes receiving first image data generated by an electronic device. For example, the network device(s) may receive first image data 406 generated by the A/V device 210. In some examples, the network device(s) receive the first image data 406 based on transmitting a control signal 420 to the A/V device 210, where the control signal 420 causes the A/V device 210 to generate and/or transmit the first image data 406. In some examples, the network device (s) may continuously receive image data 406 generated by the A/V device 210. In such examples, the network device(s) may receive (e.g., retrieve) the first image data 406 from a database.

The process 1100, at block B1104, includes transmitting the first image data to a client device. For example, the network device(s) may transmit the first image data 406 to the client device 214, 216.

The process 1100, at block B1106, includes receiving, from the client device, first data indicating that a first portion of a field of view (FOV) of the electronic device represents a first light emitter. For example, the network device(s) may receive, from the client device 214, 216, first data indicating that a first portion of the FOV of the A/V device 210 is associated with a first light emitter 232. In some examples, the first data may include association data 520 that indicates that a first portion of the first image data 406 is associated with the first light emitter 232, where the first portion of the first image data 406 corresponds to the first portion of the FOV of the A/V device 210. In some examples, the first data may include association data 520 that indicates that the first portion of the FOV of the A/V device 210 is associated with the first light emitter 232. Still, in some examples, the first data may indicate that the first portion of the FOV of the A/V device 210 is associated with a first identifier 536 of the first light emitter 232.

The process 1100, at block B1108, includes storing second data indicating a first association between the first portion of the FOV of the electronic device and the first light emitter. For example, the network device(s) may store second data indicating a first association between the first portion of the FOV of the A/V device 210 and the first light emitter 232. In some examples, the second data includes the association data 520. In some examples, the second data associates the first portion of the FOV of the A/V device 210 with the first identifier 536 of the first light emitter 232.

The process 1100, at block B1110, includes receiving, from the client device, third data indicating that a second portion of the FOV of the electronic device represents a second light emitter. For example, the network device(s) may receive, from the client device 214, 216, third data indicating that a second portion of the FOV of the A/V device 210 is associated with a second light emitter 232. In some examples, the third data may include association data 520 that indicates that a second portion of the first image data 406 is associated with the second light emitter 232, where the second portion of the first image data 406 corresponds to the second portion of the FOV of the A/V device 210. In some examples, the third data may include association data 520 that indicates that the second portion of the FOV of the A/V device 210 is associated with the second light emitter 232. Still, in some examples, the third data may indicate that the second portion of the FOV of the A/V device 210 is associated with a second identifier 536 of the second light emitter 232.

The process 1100, at block B1112, includes storing fourth data indicating a second association between the second portion of the FOV of the electronic device and the second light emitter. For example, the network device(s) may store fourth data indicating a second association between the second portion of the FOV of the A/V device 210 and the second light emitter 232. In some examples, the fourth data includes the association data 520. In some examples, the fourth data associates the second portion of the FOV of the A/V device 210 with the second identifier 536 of the second light emitter 232.

The process 1100, at block B1114, includes receiving fifth data indicating that the client device is displaying a user interface. For example, the network device(s) may receive fifth data indicating that the client device 214, 216 is displaying a GUI 618. In some examples, the fifth data may include request data 530, where the request data 530 indicates a request to operate the light emitters 232.

The process 1100, at block B1116, includes receiving second image data generated by the electronic device. For example, the network device(s) may receive second image data 406 generated by the A/V device 210. In some examples, the network device(s) receive the second image data 406 based on transmitting a control signal 420 to the A/V device 210, where the control signal 420 causes the A/V device 210 to generate and/or transmit the second image data 406. In some examples, the network device(s) may continuously receive the image data 406 generated by the A/V device 210. In such examples, the network device(s) may receive (e.g., retrieve) the second image data 406 from the database.

The process 1100, at block B1118, includes transmitting the second image data to the client device. For example, the network device(s) may transmit the second image data 406 to the client device 214, 216.

The process 1100, at block B1120, includes receiving, from the client device, sixth data indicating a selection of the first portion of the FOV of the electronic device. For example, the network device(s) may receive, from the client device 214, 216, sixth data indicating a selection of the first portion of the FOV of the A/V device 210. In some examples, the sixth data may include selection data 532 indicating that the client device 214, 216 received a selection of a portion of the second image data 406, where the portion of the second image data 406 corresponds to the first portion of the FOV of the A/V device 210 (and/or the first portion of the first image data 406). In some example, the sixth data may include selection data 532 indicating that the client device 214, 216 received a selection of an interface element associated with the first light emitter 232. Still, in some examples, the sixth data may include control data 540 indicating the first identifier 536 of the first light emitter 232 and a command 538 to activate (e.g., if the first light emitter 232 is deactivated) or a command 538 to deactivate (e.g., if the first light emitter 232 is activated).

The process 1100, at block B1122, includes generating seventh data indicating an identifier of the first light emitter and a command to activate. For example, the network device(s) may generate seventh data indicating the first identifier 536 of the first light emitter 232 and the command 538 to activate. In some examples, the seventh data corresponds to a data packet 534 that includes data representing the first identifier 536 and data representing the command 538 to activate.

The process 1100, at block B1124, includes transmitting the seventh data to the first light emitter. For example, the network device(s) may transmit the seventh data (e.g., the data packet 534) to the first light emitter 232. In some examples, the network device(s) may then transmit third image data 406 to the client device 214, 216, where the third image data 406 represents the first light emitter 232 activated.

Figure 12A:
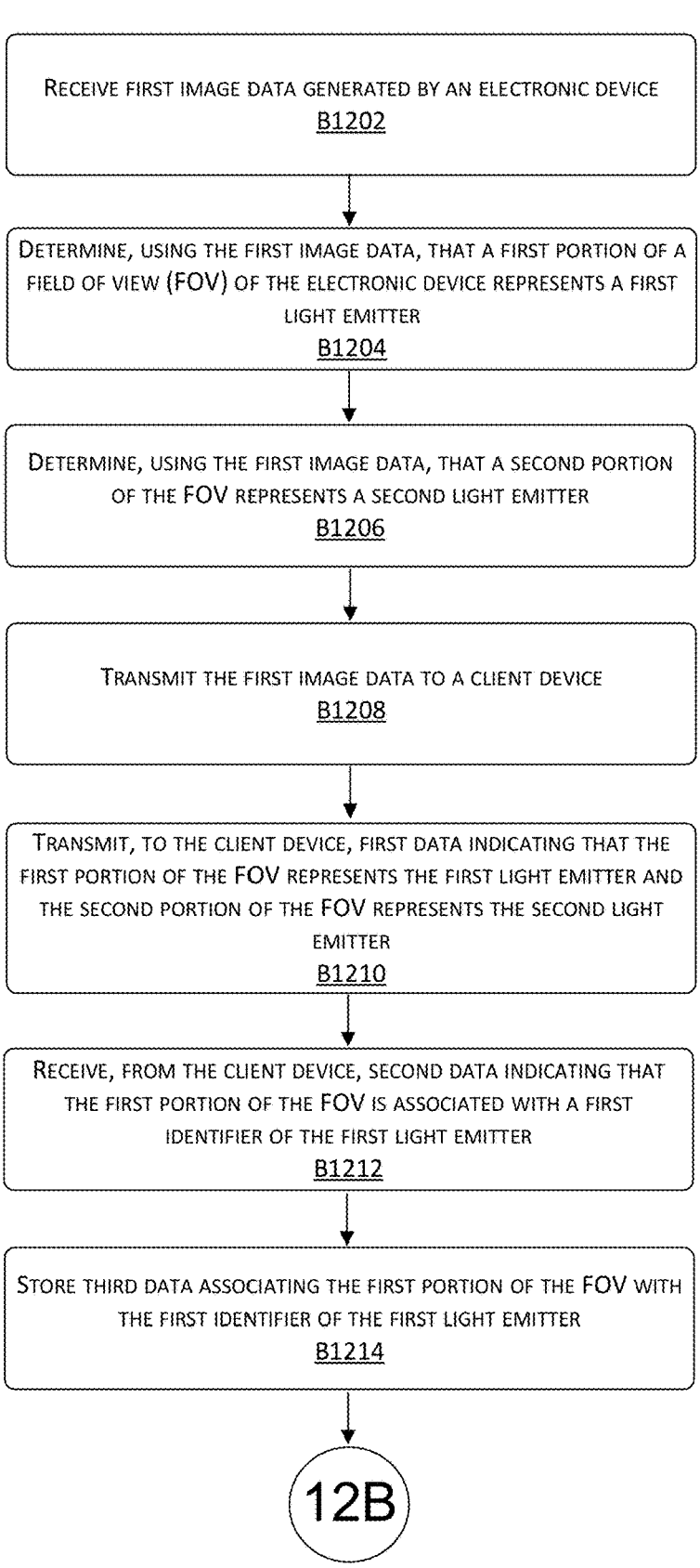
FIGS. 12A-12B are a flowchart illustrating an example process of analyzing image data generated by an A/V device in order to configure light emitters, according to various aspects of the present disclosure.
Figure 12B:
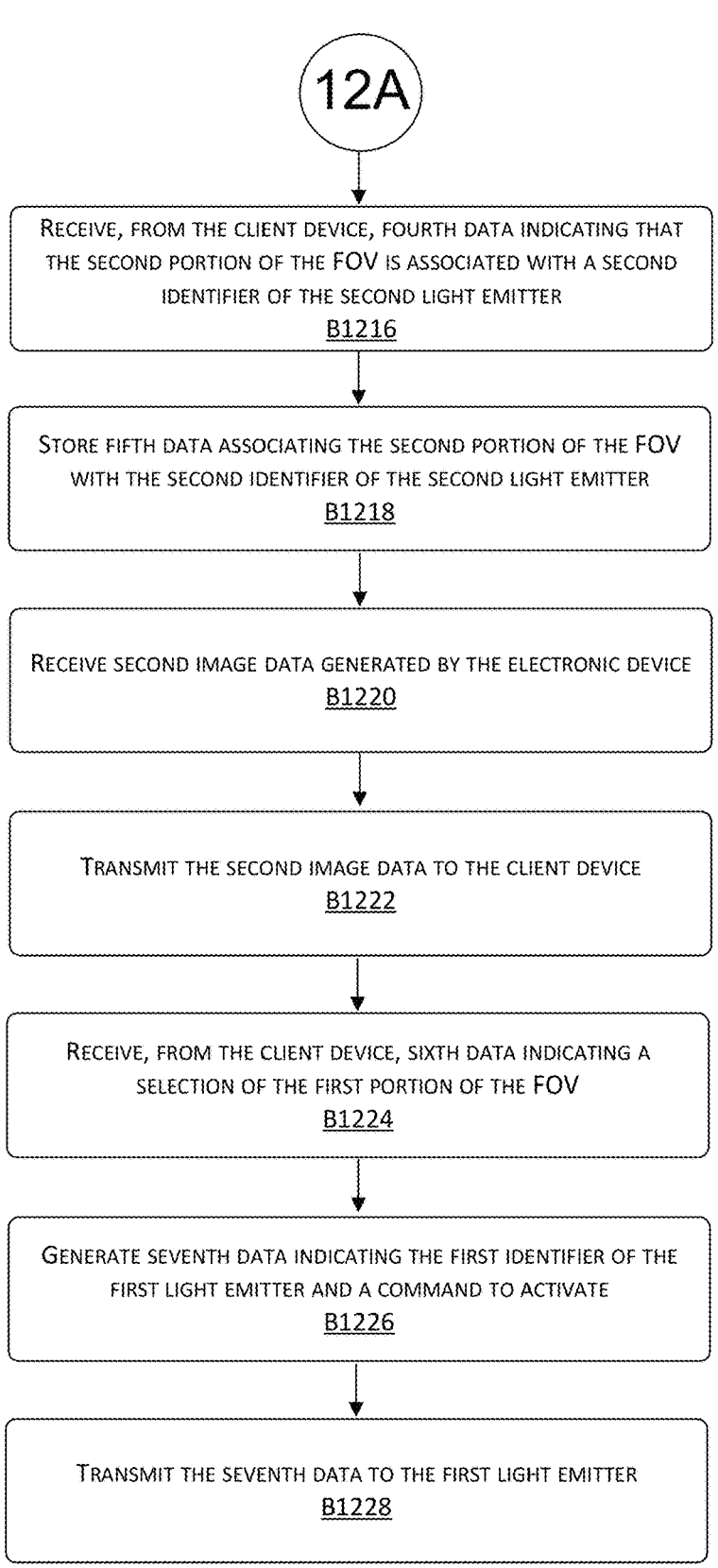

FIGS. 12A-12B are a flowchart illustrating an example process 1200 of analyzing image data generated by an A/V device to configure light emitters, according to various aspects of the present disclosure. The process 1200, at block B1202, includes receiving first image data generated by an electronic device. For example, the network device(s) may receive first image data 406 generated by the A/V device 210. In some examples, the network device(s) receive the first image data 406 based on transmitting a control signal 420 to the A/V device 210, where the control signal 420 causes the A/V device 210 to generate and/or transmit the first image data 406. In some examples, the network device(s) may continuously receive the image data 406 generated by the A/V device 210. In such examples, the network device(s) may receive (e.g., retrieve) the first image data 406 from a database.

The process 1200, at block B1204, includes determining, using the first image data, that a first portion of a field of view (FOV) of the electronic device represents a first light emitter. For example, the network device(s) may determine, using the first image data 406, that a first portion of the FOV of the A/V device 210 represents a first light emitter 232. In some examples, the network device(s) make the determination by analyzing the first image data 232 using one or more computer vision and/or image processing techniques. Based on the analysis, the network device(s) may determine that a first portion of the first image data 406 represents the first light emitter 232. The network device(s) may then determine that the first portion of the first image data 406 corresponds to the first portion of the FOV of the A/V device 210.

The process 1200, at block B1206, includes determining, using the first image data, that a second portion of the FOV represents a second light emitter. For example, the network device(s) may determine, using the first image data 406, that a second portion of the FOV of the A/V device 210 represents a second light emitter 232. In some examples, the network device(s) make the determination by analyzing the first image data 232 using one or more computer vision and/or image processing techniques. Based on the analysis, the network device(s) may determine that a second portion of the first image data 406 represents the second light emitter 232. The network device(s) may then determine that the second portion of the first image data 406 corresponds to the second portion of the FOV of the A/V device 210.

The process 1200, at block B1208, includes transmitting the first image data to a client device. For example, the network device(s) may transmit the first image data 406 to the client device 214, 216.

The process 1200, at block B1210, includes transmitting, to the client device, first data indicating that the first portion of the FOV represents the first light emitter and the second portion of the FOV represents the second light emitter. For example, the network device(s) may transmit, to the client device 214, 216, first data (e.g., indication data 518) indicating that the first portion of the FOV of the A/V device 210 (and/or the first portion of the first image data 406) represents the first light emitter 232 and the second portion of the FOV of the A/V device 210 (and/or the second portion of the first image data 406) represents the second light emitter 232.

The process 1200, at block B1212, includes receiving, from the client device, second data indicating that the first portion of the FOV is associated with a first identifier of the first light emitter. For example, the network device(s) may receive, from the client device 214, 216, second data (e.g., association data 520) indicating that the first portion of the FOV of the A/V device 210 (and/or the first portion of the first image data 406) is associated with a first identifier 536 of the first light emitter 232.

The process 1200, at block B1214, includes storing third data associating the first portion of the FOV with the first identifier of the first light emitter. For example, the network device(s) may store third data (e.g., association data 520) associating the first portion of the FOV of the A/V device 210 (and/or the first portion of the first image data 406) with the first identifier 536 of the first light emitter 232.

The process 1200, at block B1216, includes receiving, from the client device, fourth data indicating that the second portion of the FOV is associated with a second identifier of the second light emitter. For example, the network device(s) may receive, from the client device 214, 216, fourth data (e.g., association data 520) indicating that the second portion of the FOV of the A/V device 210 (and/or the second portion of the first image data 406) is associated with a second identifier 536 of the second light emitter 232.

The process 1200, at block B1218, includes storing fifth data associating the second portion of the FOV with the second identifier of the second light emitter. For example, the network device(s) may store fifth data (e.g., association data 520) associating the second portion of the FOV of the A/V device 210 (and/or the second portion of the first image data 406) with the second identifier 536 of the second light emitter 232.

The process 1200, at block B1220, includes receiving second image data generated by the electronic device. For example, the network device(s) may receive second image data 406 generated by the A/V device 210. In some examples, the network device(s) receive the second image data 406 based on transmitting a control signal 420 to the A/V device 210, where the control signal 420 causes the A/V device 210 to generate and/or transmit the second image data 406. In some examples, the network device(s) may continuously receive the image data 406 generated by the A/V device 210. In such examples, the network device(s) may receive (e.g., retrieve) the second image data 406 from the database.

The process 1200, at block B1222, includes transmitting the second image data to the client device. For example, the network device(s) may transmit the second image data 406 to the client device 214, 216.

The process 1200, at block B1224, includes receiving, from the client device, sixth data indicating a selection of the first portion of the FOV. For example, the network device(s) may receive, from the client device 214, 216, sixth data indicating a selection of the first portion of the FOV of the A/V device 210. In some examples, the sixth data may include selection data 532 indicating that the client device 214, 216 received a selection of a portion of the second image data 406, where the portion of the second image data 406 corresponds to the first portion of the FOV of the A/V device 210 (and/or the first portion of the first image data 406). In some example, the sixth data may include selection data 532 indicating that the client device 214, 216 received a selection of an interface element associated with the first light emitter 232. Still, in some examples, the sixth data may include control data 540 indicating the first identifier 536 of the first light emitter 232 and a command 538 to activate (e.g., if the first light emitter 232 is deactivated) or a command 538 to deactivate (e.g., if the first light emitter 232 is activated).

The process 1200, at block B1226, includes generating seventh data indicating the first identifier of the first light emitter and a command to activate. For example, the network device(s) may generate seventh data indicating the first identifier 536 of the first light emitter 232 and the command 538 to activate. In some examples, the seventh data corresponds to a data packet 534 that includes data representing the first identifier 536 and data representing the command 538 to activate.

The process 1200, at block B1228, includes transmitting the seventh data to the first light emitter. For example, the network device(s) may transmit the seventh data (e.g., the data packet 534) to the first light emitter 232. In some examples, the network device(s) may then transmit third image data 406 to the client device 214, 216, where the third image data 406 represents the first light emitter 232 activated.

Figure 13:
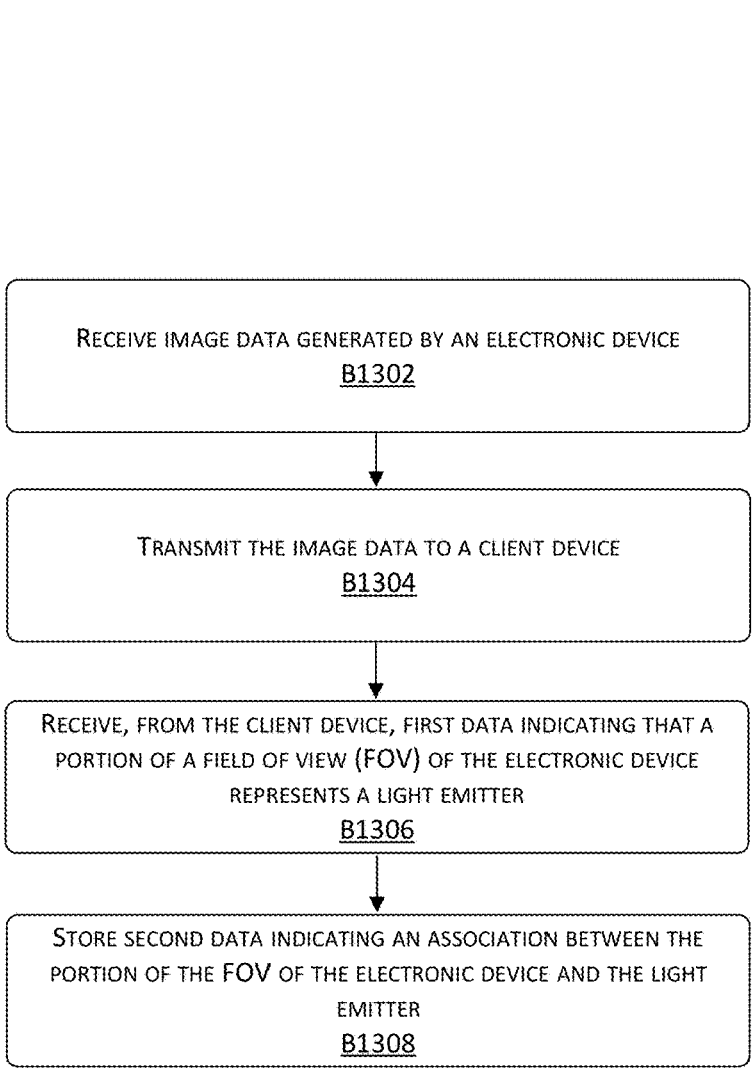
FIG. 13 is a flowchart illustrating an example process for associating a light emitter with an A/V device, according to various aspects of the present disclosure.

FIG. 13 is a flowchart illustrating an example process 1300 for associating a light emitter with an A/V device, according to various aspects of the present disclosure. The process 1300, at block B1302, includes receiving image data generated by an electronic device. For example, the network device(s) may receive image data 406 generated by the A/V device 210. In some examples, the network device(s) receive the image data 406 based on transmitting a control signal 420 to the A/V device 210, where the control signal 420 causes the A/V device 210 to generate and/or transmit the image data 406. In some examples, the network device(s) may continuously receive the image data 406 generated by the A/V device 210.

The process 1300, at block B1304, includes transmitting the image data to a client device. For example, the network device(s) may transmit the image data 406 to the client device 214, 216. In some examples, the network device(s) may further transmit indication data 518 to the client device 214, 216, where the indication data 518 indicates that a portion of image(s) represented by the image data 406 may represent a potential light emitter 232. The indication data 518 may be configured to cause the client device 214, 216 to display an interface element at the portion of the image(s).

The process 1300, at block B1306, includes receiving, from the client device, first data indicating that a portion of a field of view (FOV) of the electronic device represents a light emitter. For example, the network device(s) may receive, from the client device 214, 216, first data indicating that a portion of the FOV of the A/V device 210 is associated with a light emitter 232. In some examples, the first data may include association data 520 that indicates that a portion of the image data 406 is associated with the light emitter 232, where the portion of the image data 406 corresponds to the portion of the FOV of the A/V device 210. In some examples, the first data may include association data 520 that indicates that the portion of the FOV of the A/V device 210 is associated with the light emitter 232. Still, in some examples, the first data may indicate that the portion of the FOV of the A/V device 210 is associated with an identifier 536 of the light emitter 232.

The process 1300, at block B1308, includes storing second data indicating an association between the portion of the FOV of the electronic device and the light emitter. For example, the network device(s) may store second data indicating an association between the portion of the FOV of the A/V device 210 and the light emitter 232. In some examples, the second data includes the association data 520. In some examples, the second data associates the portion of the FOV of the A/V device 210 with the identifier 536 of the light emitter 232.

Figure 14:
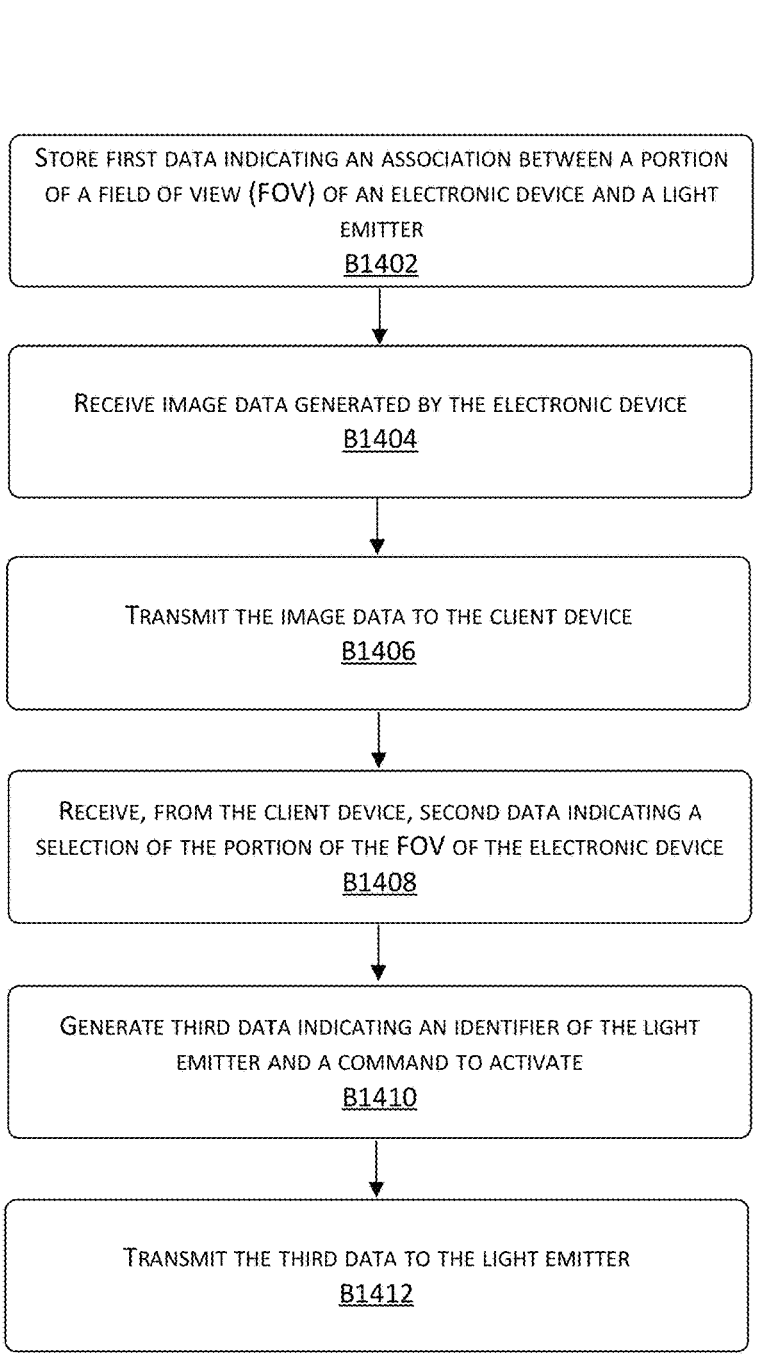
FIG. 14 is a flowchart illustrating an example process for controlling a light emitter associated with an A/V device, according to various aspects of the present disclosure.

FIG. 14 is a flowchart illustrating an example process 1400 for controlling a light emitter associated with an A/V device, according to various aspects of the present disclosure. The process 1400, at block B1402, includes storing first data indicating an association between a portion of a field of view (FOV) of an electronic device and a light emitter. For example, the network device(s) may store first data indicating an association between the portion of a FOV of the A/V device 210 and a light emitter 232. In some examples, the first data includes the association data 520. In some examples, the first data associates the portion of the FOV of the A/V device 210 with the identifier 536 of the light emitter 232.

The process 1400, at block B1404, includes receiving image data generated by the electronic device. For example, the network device(s) may receive image data 406 generated by the A/V device 210. In some examples, the network device(s) receive the image data 406 based on transmitting a control signal 420 to the A/V device 210, where the control signal 420 causes the A/V device 210 to generate and/or transmit the image data 406. In some examples, the network device(s) may continuously receive the image data 406 generated by the A/V device 210.

The process 1400, at block B1406, includes transmitting the image data to the client device. For example, the network device(s) may transmit the image data 406 to the client device 214, 216. In some examples, the network device(s) may further transmit, to the client device 214, 216, data indicating that a portion of the FOV of the A/V device 210 is associated with the light emitter 232. In some examples, the network device(s) may further transmit, to the client device 214, 216, data indicating that a portion of the image data 406 represents the light emitter 232, where the portion of the image data 406 corresponds to the portion of the FOV of the A/V device 210.

The process 1400, at block B1408, includes receiving, from the client device, second data indicating a selection of the portion of the FOV of the electronic device. For example, the network device(s) may receive, from the client device 214, 216, second data indicating a selection of the portion of the FOV of the A/V device 210. In some examples, the second data may include selection data 532 indicating that the client device 214, 216 received a selection of the portion of the image data 406, where the portion of the image data 406 corresponds to the portion of the FOV of the A/V device 210. In some example, the second data may include selection data 532 indicating that the client device 214, 216 received a selection of an interface element associated with the light emitter 232. Still, in some examples, the second data may include control data 540 indicating the identifier 536 of the light emitter 232 and a command 538 to activate (e.g., if the light emitter 232 is deactivated) or a command 538 to deactivate (e.g., if the light emitter 232 is activated).

The process 1400, at block B1410, includes generating third data indicating an identifier of the light emitter and a command to activate. For example, the network device(s) may generate third data indicating the identifier 536 of the light emitter 232 and the command 538 to activate. In some examples, the third data corresponds to a data packet 534 that includes data representing the identifier 536 and data representing the command 538 to activate.

The process 1400, at block B1412, includes transmitting the third data to the light emitter. For example, the network device(s) may transmit the third data (e.g., the data packet 534) to the light emitter 232. In some examples, the network device(s) may then transmit additional image data 406 to the client device 214, 216, where the additional image data 406 represents the light emitter 232 activated.

Figure 15A:
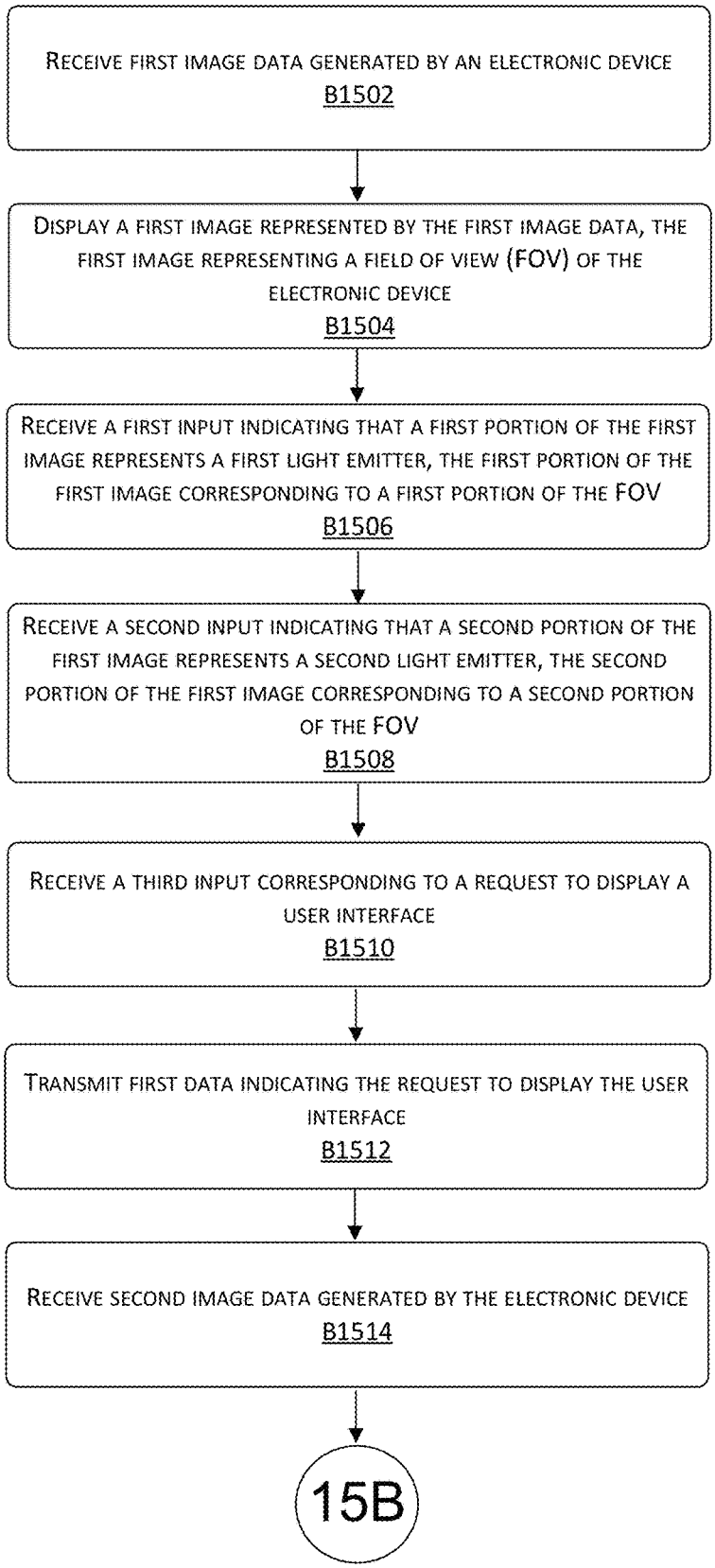
FIGS. 15A-15B are a flowchart illustrating an example process of associating light emitters with an A/V device, and then using image data to control the light emitters, according to various aspects of the present disclosure.
Figure 15B:
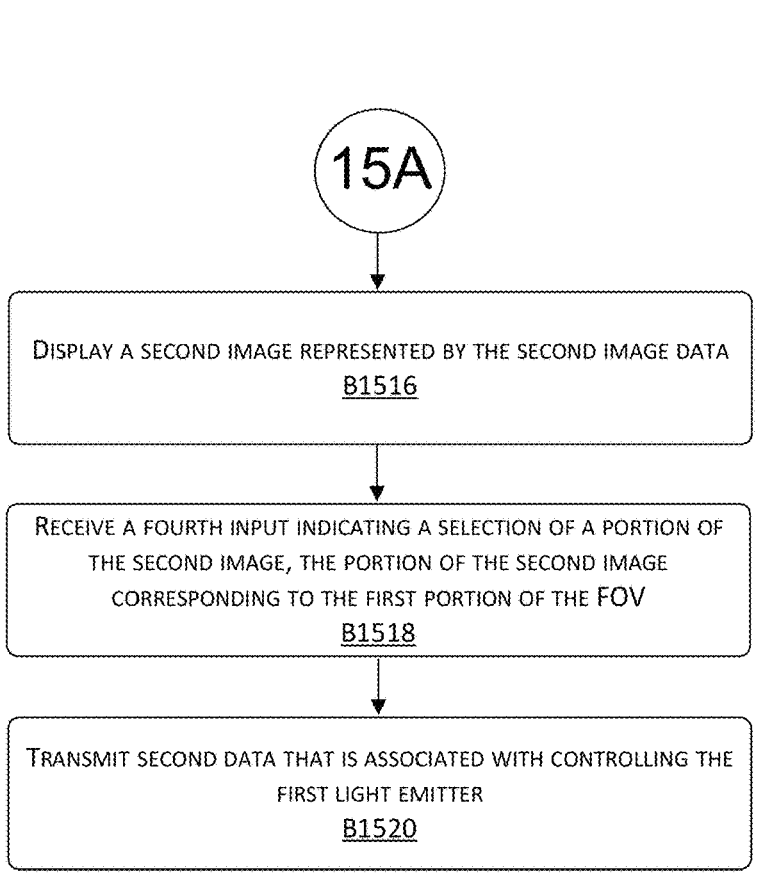

FIGS. 15A-15B are a flowchart illustrating an example process 1500 of associating light emitters with an A/V device, and then using image data to control the light emitters, according to various aspects of the present disclosure. The process 1500, at block B1502, includes receiving first image data generated by an electronic device. For example, the client device 214, 216 may receive, from the network device(s), first image data 406 generated by the A/V device 210. In some examples, the client device 214, 216 receives the first image data 406 based on transmitting configuration data 514 to the network device(s), where the configuration data 514 represents a request to configure light emitters 232.

The process 1500, at block B1504, includes displaying a first image represented by the first image data, the first image representing a field of view (FOV) of the electronic device. For example, the client device 214, 216 may display a first image represented by the first image data 406, where the first image represents the FOV of the A/V device 210.

The process 1500, at block B1506, includes receiving a first input indicating that a first portion of the first image represents a first light emitter, the first portion of the first image corresponding to a first portion of the FOV. For example, the client device 214, 216 may receive a first input indicating that a first portion of the first image represents a first light emitter 232. In some examples, the first input may further indicate that the first portion of the first image is associated with a first identifier 536 of the first light emitter 232. In some examples, based on the first input, the client device 214, 216 may store association data 520 that indicates an association between the first portion of the first image and the first identifier 536 of the first light emitter 232. In some examples, based on the first input, the client device 214, 216 may store association data 520 that indicates an association between a first portion of the FOV of the A/V device 210 and the first identifier 536 of the first light emitter 232. Still, in some examples, based on the first input, the client device 214, 216 may store association data 520 that indicates an association between a first portion of the display 616 and the first identifier 536 of the first light emitter 232.

The process 1500, at block B1508, includes receiving a second input indicating that a second portion of the first image represents a second light emitter, the second portion of the first image corresponding to a second portion of the FOV. For example, the client device 214, 216 may receive a second input indicating that a second portion of the first image represents a second light emitter 232. In some examples, the second input may further indicate that the second portion of the first image is associated with a second identifier 536 of the second light emitter 232. In some examples, based on the second input, the client device 214, 216 may store association data 520 that indicates an association between the second portion of the first image and the second identifier 536 of the second light emitter 232. In some examples, based on the second input, the client device 214, 216 may store association data 520 that indicates an association between a second portion of the FOV of the A/V device 210 and the second identifier 536 of the second light emitter 232. Still, in some examples, based on the second input, the client device 214, 216 may store association data 520 that indicates an association between a second portion of the display 616 and the second identifier 536 of the second light emitter 232.

The process 1500, at block B1510, includes receiving a third input corresponding to a request to display a user interface. For example, the client device 214, 216 may receive a third input indicating a request to display a GUI 618. In some examples, the GUI 618 is associated with controlling the light emitters 232.

The process 1500, at block B1512, includes transmitting first data indicating the request to display the user interface. For example, the client device 214, 216 may transmit, to the network device(s), first data indicating the request to display the GUI 618.

The process 1500, at block B1514, includes receiving second image data generated by the electronic device. For example, based on the first data, the client device 214, 216 may receive, from the network device(s), the second image data 406 generated by the A/V device 210.

The process 1500, at block B1516, includes displaying a second image represented by the second image data. For example, the client device 214, 216 may display a second image represented by the second image data 406. In some examples, the client device 214, 216 displays the second image within at least a portion of the GUI 618. In some examples, the client device 214, 216 may further provide a first interface element located at a first portion of the second image, where the first portion of the second image is associated with the first portion of the FOV of the A/V device 210 (and/or the first portion of the first image, and/or the first portion of the display 616). Additionally, the client device 214, 216 may provide a second interface element located at a second portion of the second image, where the second portion of the second image is associated with the second portion of the FOV of the A/V device 210 (and/or the second portion of the first image, and/or the second portion of the display 616).

The process 1500, at block B1516, includes receiving a fourth input indicating a selection of a portion of the second image, the portion of the second image corresponding to the first portion of the FOV. For example, the client device 214, 216 may receive the fourth input indicating the selection of the portion of the second image, where the portion of the second image corresponds to the first portion of the FOV of the A/V device 210. In some examples, the fourth input may include selecting the first interface element.

The process 1500, at block B1520, includes transmitting second data that is associated with controlling the first light emitter. For example, the client device 214, 216 may transmit, to the network device(s), second data that is associated with controlling (e.g., activating, deactivating, etc.) the first light emitter 232. In some examples, the second data includes selection data 532 indicating the selection of the portion of the second image. In some examples, the second data includes selection data 532 indicating the selection of the first portion of the FOV of the A/V device 210. Still, in some examples, the second data includes control data 540 that includes a command to activate or a command to deactivate the first light emitter 232. In either example, client device 214, 216 may then receive third image data 406 generated by the A/V device 210. The client device 214, 216 may then display a third image represented by the third image data 406, where the third image represents the first light emitter 232 as being activated (e.g., emitting light) or deactivated (e.g., not emitting light).

Figure 16A:
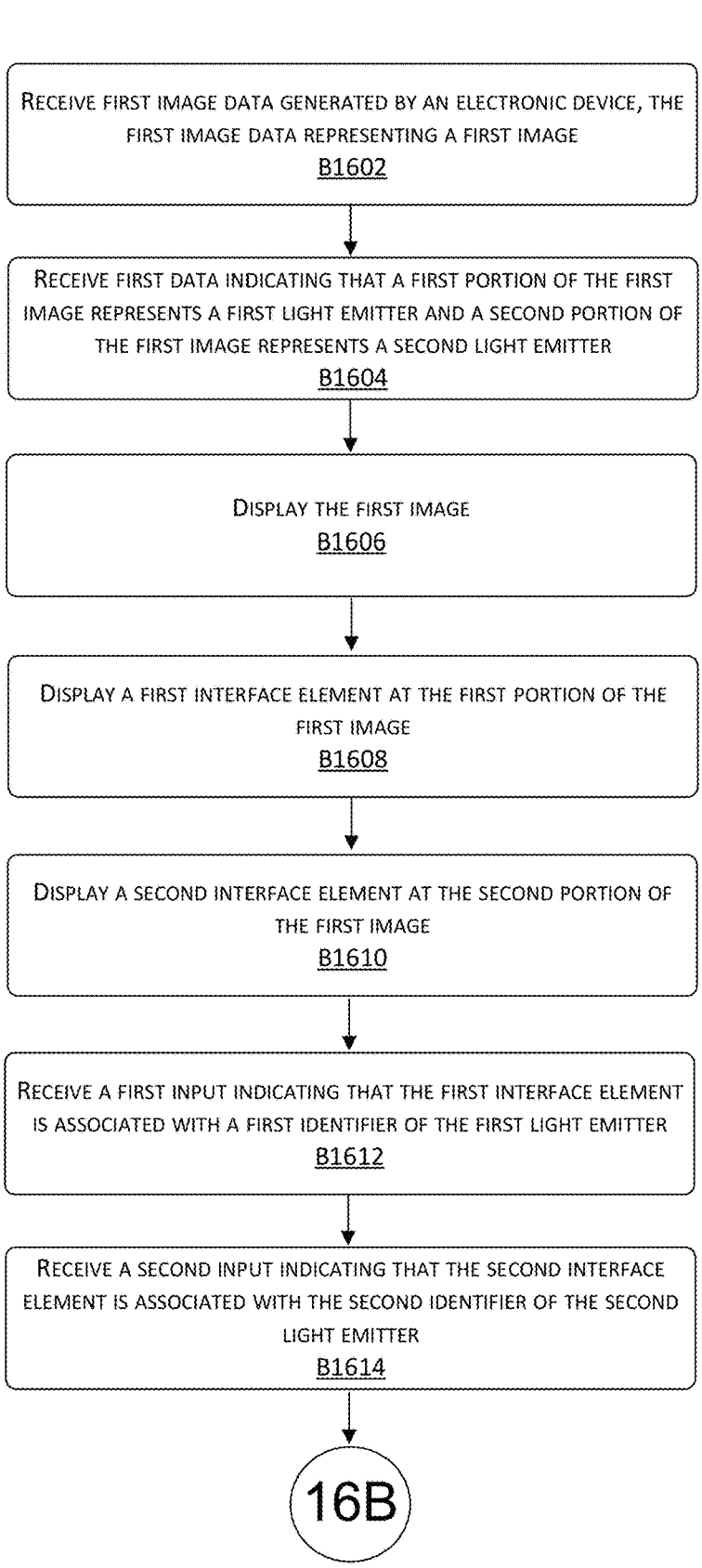
FIGS. 16A-16B are a flowchart illustrating an example process of controlling light emitters using data received from network device(s), according to various aspects of the present disclosure.
Figure 16B:
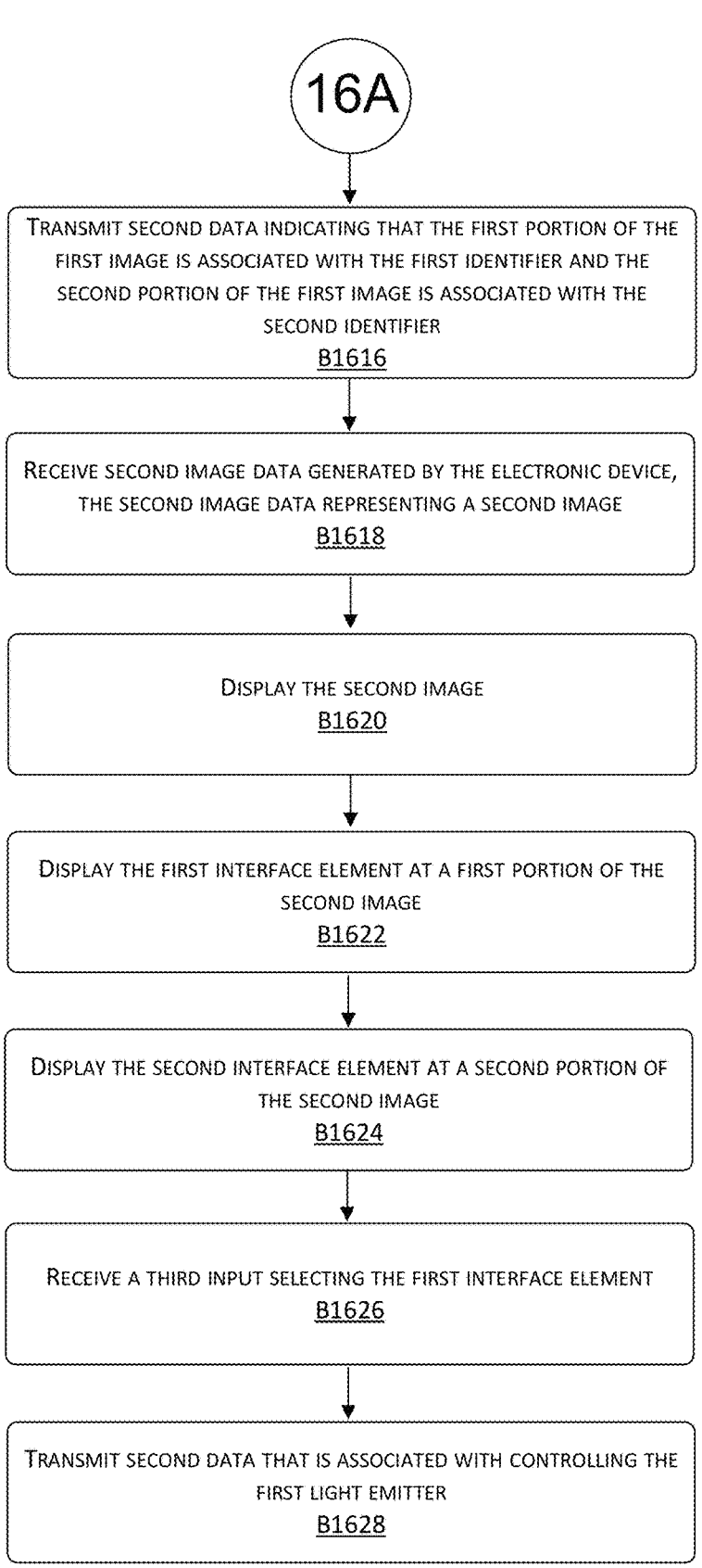

FIGS. 16A-16B are a flowchart illustrating an example process 1600 of controlling light emitters using data received from network device(s), according to various aspects of the present disclosure. The process 1600, at block B1602, includes receiving first image data generated by an electronic device, the first image data representing a first image. For example, the client device 214, 216 may receive, from the network device(s), first image data 406 generated by the A/V device 210. In some examples, the client device 214, 216 receives the first image data 406 based on transmitting configuration data 514 to the network device(s), where the configuration data 514 represents a request to configure light emitters 232.

The process 1600, at block B1604, includes receiving first data indicating that a first portion of the first image represents a first light emitter and a second portion of the first image represents a second light emitter. For example, the client device 214, 216 may receive, from the network device(s), first data (e.g., indication data 518) that indicates that a first portion of the first image represents a first light emitter 232 and a second portion of the first image represents a second light emitter 232. In some examples, the client device 214, 216 may further receive, from the network device(s), identifier data 512 indicating a first identifier 536 of the first light emitter 232 and identifier data 512 indicating a second identifier 536 of the second light emitter 232.

The process 1600, at block B1606, includes displaying the first image. For example, the client device 214, 216 may display the first image using the display 616. In some examples, the client device 214, 216 may further display a first indicator of the first identifier 536 and a second indicator of the second identifier 536.

The process 1600, at block B1608, includes displaying a first interface element at the first portion of the first image. For example, the client device 214, 216 may display a first interface element at the first portion of the first image. The client device 214, 216 may determine the first portion of the first image using the indication data 518.

The process 1600, at block B1610, includes displaying a second interface element at the second portion of the first image. For example, the client device 214, 216 may display a second interface element at the second portion of the first image. The client device 214, 216 may determine the second portion of the first image using the indication data 518.

The process 1600, at block B1612, includes receiving a first input indicating that the first interface element is associated with a first identifier of the first light emitter. For example, the client device 214, 216 may receive a first input indicating that the first interface element is associated with the first identifier 536 of the first light emitter 232.

The process 1600, at block B1614, includes receiving a second input indicating that the second interface element is associated with a second identifier of the second light emitter. For example, the client device 214, 216 may receive a second input indicating that the second interface element is associated with the second identifier 536 of the second light emitter 232.

The process 1600, at block B1616, includes transmitting second data indicating that the first portion of the first image is associated with the first identifier and the second portion of the first image is associated with the second identifier. For example, the client device 214, 216 may transmit second data (e.g., association data 520) to the network device(s), the second data indicating that the first portion of the first image is associated with the first identifier 536 and the second portion of the first image is associated with the second identifier 536.

The process 1600, at block B1618, includes receiving second image data generated by the electronic device, the second image data representing a second image. For example, the client device 214, 216 may receive second image data 406 from the network device(s), the second image data 406 representing a second image. In some examples, the client device 214, 216 may further receive, from the network device(s), indication data 518 (and/or association data 520) that indicates that a first portion of the second image is associated with the first light emitter 232 and a second portion of the second image is associated with the second light emitter 232.

The process 1600, at block B1620, includes displaying the second image. For example, the client device 214, 216 may display the second image.

The process 1600, at block B1622, includes displaying the first interface element at a first portion of the second image. For example, the client device 214, 216 may display the first interface element (and/or a third interface element) at the first portion of the second image. The client device 214, 216 may determine the first portion of the second image using the indication data 518 (and/or the association data 520).

The process 1600, at block B1624, includes displaying a second interface element at a second portion of the second image. For example, the client device 214, 216 may display a second interface element (and/or a fourth interface element) at the second portion of the second image. The client device 214, 216 may determine the second portion of the second image using the indication data 518 (and/or the association data 520).

The process 1600, at block B1626, includes receiving a third input selecting the first interface element. For example, the client device 214, 216 may receive a third input selecting the first interface element.

The process 1600, at block B1628, includes transmitting second data that is associated with controlling the first light emitter. For example, the client device 214, 216 may transmit, to the network device(s), second data that is associated with controlling (e.g., activating/deactivating) the first light emitter 232. In some examples, the second data includes selection data 532 indicating the selection of the second interface element. In some examples, the second data includes control data 540 that includes a command to activate or a command to deactivate the first light emitter 232. In either example, client device 214, 216 may then receive third image data 406 generated by the A/V device 210. The client device 214, 216 may then display a third image represented by the third image data 406, where the third image represents the first light emitter 232 as being activated (e.g., emitting light) or deactivated (e.g., not emitting light).

Figure 17:
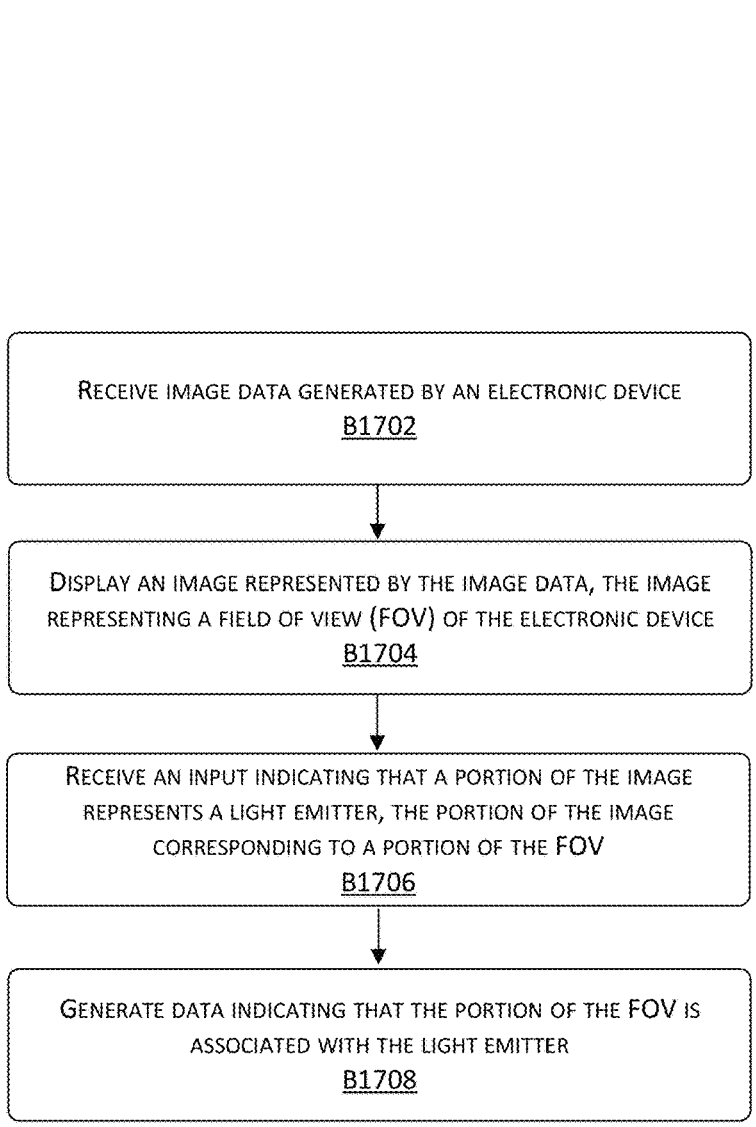
FIG. 17 is a flowchart illustrating an example process of creating an association between an A/V device and a light emitter, according to various aspects of the present disclosure.

FIG. 17 is a flowchart illustrating an example process 1700 of creating an association between an A/V device and a light emitter, according to various aspects of the present disclosure. The process 1700, at block B1702, includes receiving image data generated by an electronic device. For example, the client device 214, 216 may receive, from the network device(s), image data 406 generated by the A/V device 210. In some examples, the client device 214, 216 receives the image data 406 based on transmitting configuration data 514 to the network device(s), where the configuration data 514 represents a request to configure a light emitter 232. In some examples, the client device 214, 216 may further receive, from the network device(s), indication data 518 that indicates a portion of the image data 406 that represents the light emitter 232.

The process 1700, at block B1704, includes displaying an image represented by the image data, the image representing a field of view (FOV) of the electronic device. For example, the client device 214, 216 may display an image represented by the image data 406, where the image represents the FOV of the A/V device 210. In some examples, such as when the client device 214, 216 receives the indication data 518, the client device 214, 216 may further display an interface element located at a portion of the image that represents the light emitter 232.

The process 1700, at block B1706, includes receiving an input indicating that a portion of the image represents a light emitter, the portion of the image corresponding to a portion of the FOV. For example, the client device 214, 216 may receive an input indicating that a portion of the image represents a light emitter 232. In some examples, the input may correspond to a selection of the portion of the image and a selection of an identifier 536 associated with the light emitter 232. In some examples, the input may correspond to a selection of the interface element and a selection of the identifier 536 associated with the light emitter 232.

The process 1700, at block B1708, includes generating data indicating that the portion of the FOV is associated with the light emitter. For example, the client device 214, 216 may generate association data 520, where the association data 520 indicates that the portion of the FOV (and/or the portion of the image, and/or the portion of the display 616) is associated with the light emitter 232. In some examples, the association data 520 may further indicate that the portion of the FOV (and/or the portion of the image, and/or the portion of the display 616) is associated the identifier 536. The client device 214, 216 may then store the association data 520 and/or transmit the association data 520 to the network device(s).

Figure 18:
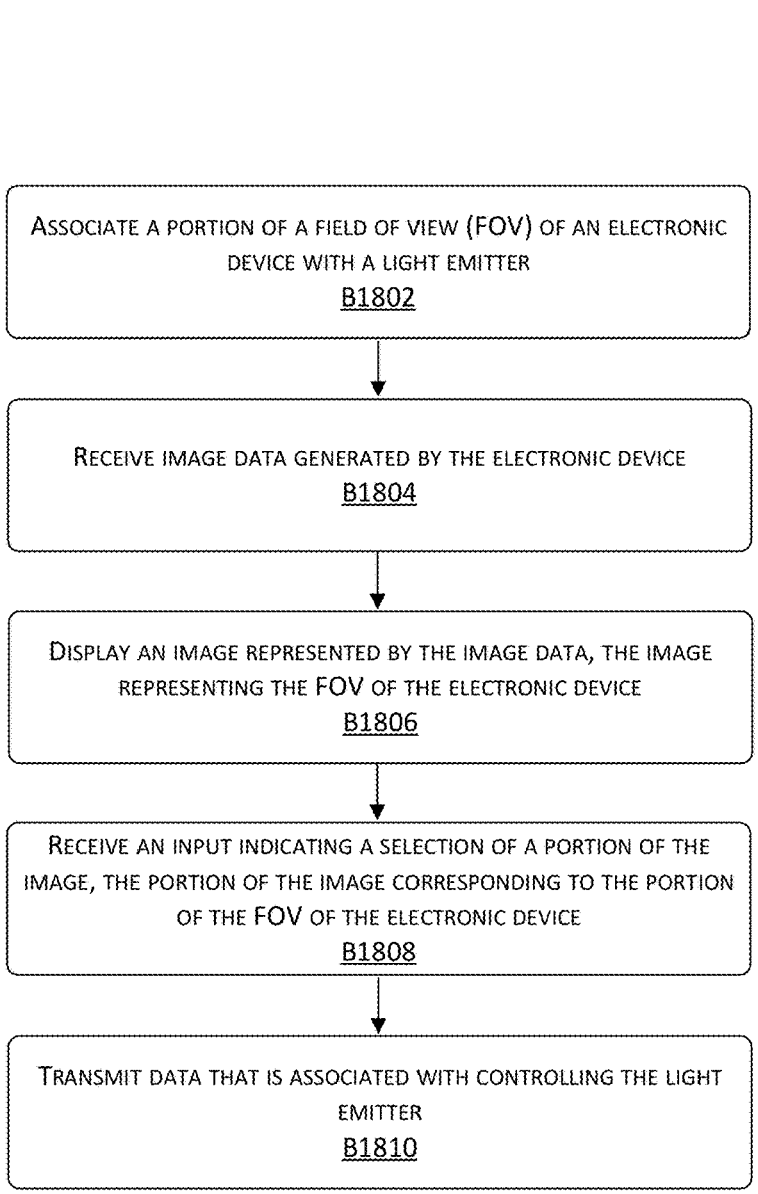
FIG. 18 is a flowchart illustrating an example process of using image data generated by an A/V device to control a light emitter, according to various aspects of the present disclosure.

FIG. 18 is a flowchart illustrating an example process 1800 of using image data generated by an A/V device to control a light emitter, according to various aspects of the present disclosure. The process 1800, at block B1802, includes associating a portion of a field of view (FOV) of an electronic device with a light emitter. For example, the client device 214, 216 (and/or the network device(s)) may generate association data 520, where the association data 520 associates a portion of the FOV of the A/V device 210 with a light emitter 232.

The process 1800, at block B1804, includes receiving image data generated by the electronic device. For example, the client device 214, 216 may receive, from the network device(s), the image data 406 generated by the A/V device 210. In some examples, the client device 214, 216 may receive the association data 520 from the network device(s).

The process 1800, at block B1806, includes displaying an image represented by the image data, the image representing the FOV of the electronic device. For example, the client device 214, 216 may display an image represented by the image data 406. In some examples, the client device 214, 216 displays the image using a GUI 618. In some examples, and using the association data 520, the client device 214, 216 may further display an interface element located at a portion of the image, where the portion of the image corresponds to the portion of the FOV of the A/V device 210.

The process 1800, at block B1808, includes receiving an input indicating a selection of a portion of the image, the portion of the image corresponding to the portion of the FOV of the electronic device. For example, the client device 214, 216 may receive an input indicating the selection of the portion of the image, where the portion of the image corresponds to the portion of the FOV of the A/V device 210. In some examples, the input may include a selection of the interface element.

The process 1800, at block B1810, includes transmitting data that is associated with controlling the light emitter. For example, the client device 214, 216 may transmit, to the network device(s), data that is associated with controlling (e.g., activating, deactivating, etc.) the light emitter 232. In some examples, the data includes selection data 532 indicating the selection of the portion of the image. In some examples, the data includes selection data 532 indicating the selection of the portion of the FOV of the A/V device 210. In some examples, the data includes selection data 532 indicating the selection of the interface element. Still, in some examples, the data includes control data 540 that includes a command to activate the light emitter 232 or a command to deactivate the light emitter 232. In either example, client device 214, 216 may then receive additional image data 406 generated by the A/V device 210. The client device 214, 216 may then display an additional image represented by the additional image data 406, where the additional image represents the light emitter 232 as being activated (e.g., emitting light) or deactivates (e.g., not emitting light).

Figure 19A:
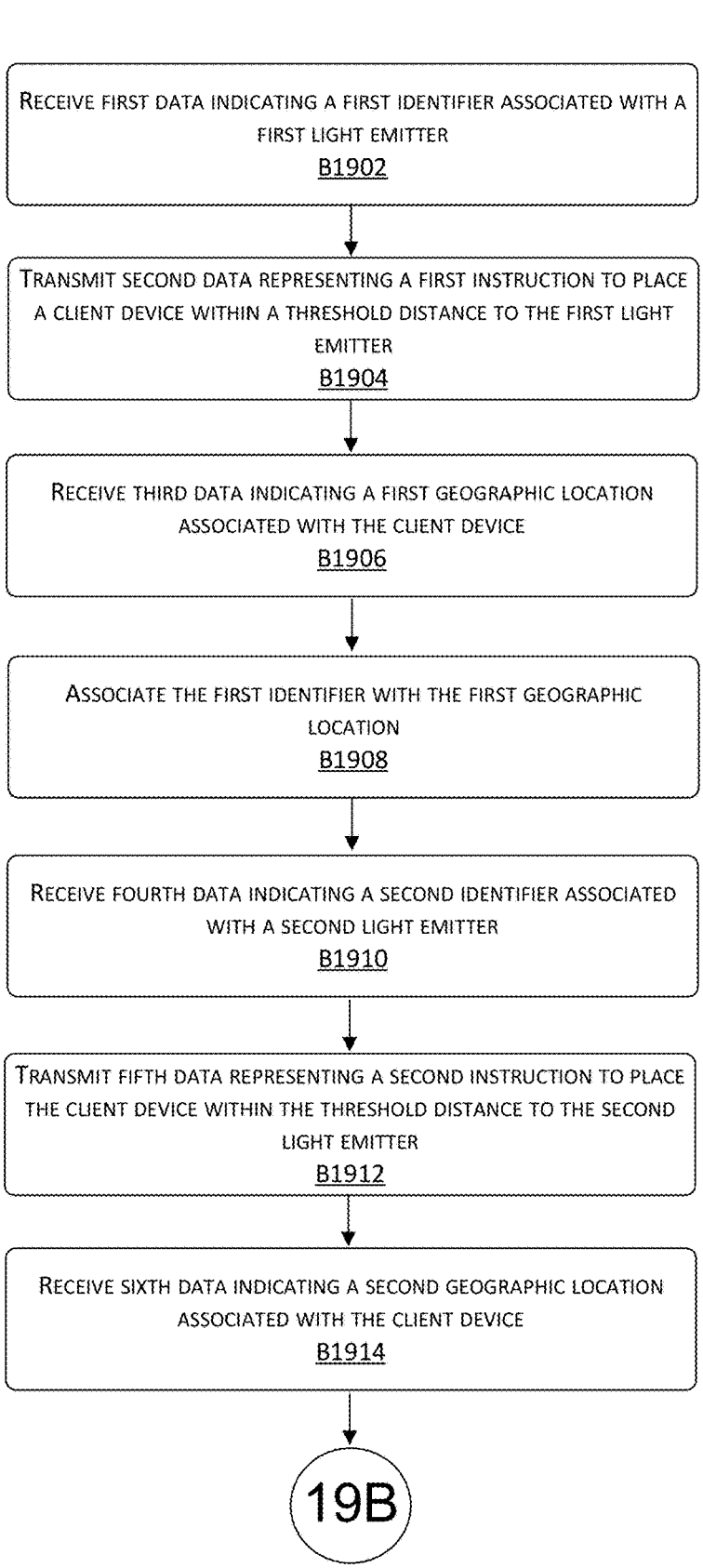
FIGS. 19A-19B are a flowchart illustrating an example process of configuring light emitters using location data received from a client device, according to various aspects of the present disclosure.
Figure 19B:
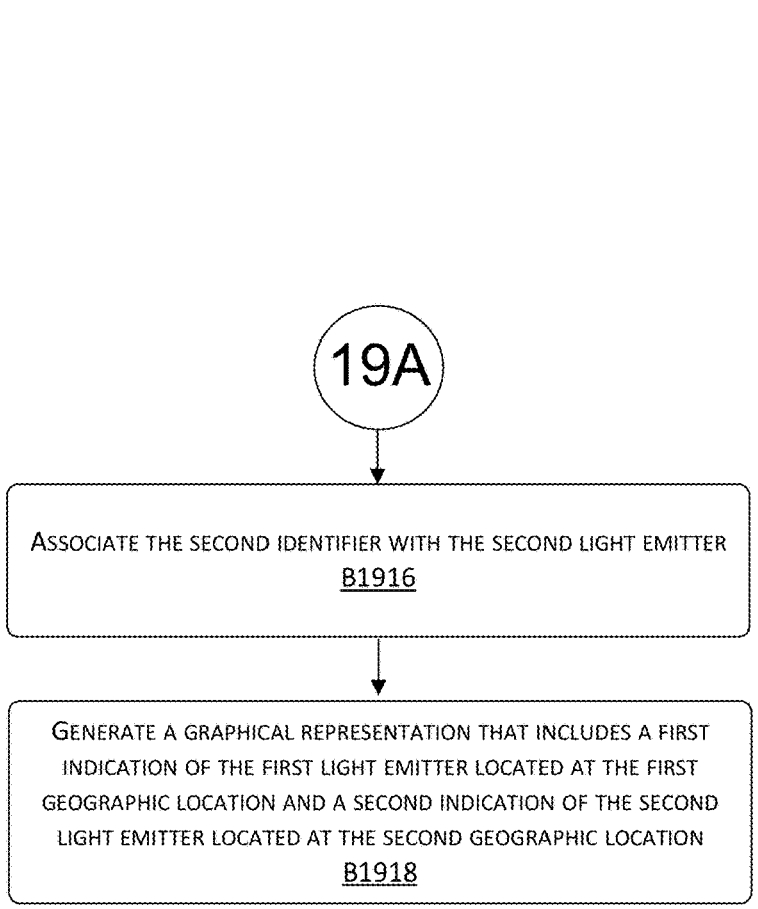

FIGS. 19A-19B are a flowchart illustrating an example process 1900 of configuring light emitters using location data received from a client device, according to various aspects of the present disclosure. The process 1900, at block B1902, includes receiving first data indicating a first identifier associated with a first light emitter. For example, the network device(s) may receive first data (e.g., identifier data 512) indicating a first identifier 536 of a first light emitter 232. The network device(s) may receive the first data from the first light emitter 232, the client device 214, 216, and/or any other device. The first identifier 536 may include, but is not limited to, an IP address, a MAC address, a numerical identifier, an alphabetic identifier, a mixed numerical and alphabetic identifier, and/or any other type of identifier that may be used to identify the first light emitter 232.

The process 1900, at block B1904, includes transmitting second data representing a first instruction to place a client device within a threshold distance to the first light emitter. For example, the network device(s) may transmit, to the client device 214, 216, second data (e.g., instruction data 526) representing a first instruction to place the client device 214, 216 within a threshold distance to the first light emitter 232. In some examples, the network device(s) transmit the second data in response to receiving configuration data 514 from the client device 214, 216, where the configuration data 514 includes a request to configure the first light emitter 232.

The process 1900, at block B1906, includes receiving third data indicating a first geographic location associated with the client device. For example, the network device(s) may receive, from the client device 214, 216, third data (e.g., location data 524) indicating a first geographic location of the client device 214, 216. The network device(s) may receive the third data when the client device 214, 216 is within the threshold distance to the first light emitter 232.

The process 1900, at block B1908, includes associating the first identifier with the first geographic location. For example, the network device(s) may generate first association data 520 that indicates an association between the first identifier 536 and the first geographic location (and/or the first location data 524). The network device(s) may then store the first association data 520.

The process 1900, at block B1910, includes receiving fourth data indicating a second identifier associated with a second light emitter. For example, the network device(s) may receive fourth data (e.g., identifier data 512) indicating a second identifier 536 of a second light emitter 232. The network device(s) may receive the fourth data from the second light emitter 232, the client device 214, 216, and/or any other device. The second identifier 536 may include, but is not limited to, an IP address, a MAC address, a numerical identifier, an alphabetic identifier, a mixed numerical and alphabetic identifier, and/or any other type of identifier that may be used to identify the second light emitter 232.

The process 1900, at block B1912, includes transmitting fifth data representing a second instruction to place the client device within the threshold distance to the second light emitter. For example, the network device(s) may transmit, to the client device 214, 216, fifth data (e.g., instruction data 526) representing a second instruction to place the client device 214, 216 within the threshold distance to the second light emitter 232. In some examples, the network device(s) transmit the fifth data in response to receiving configuration data 514 from the client device 214, 216, where the configuration data 514 includes a request to configure the second light emitter 232.

The process 1900, at block B1914, includes receiving sixth data indicating a second geographic location associated with the client device. For example, the network device(s) may receive, from the client device 214, 216, sixth data (e.g., location data 524) indicating a second geographic location of the client device 214, 216. The network device(s) may receive the sixth data when the client device 214, 216 is within the threshold distance to the second light emitter 232.

The process 1900, at block B1916, includes associating the second identifier with the second geographic location. For example, the network device(s) may generate second association data 520 that indicates an association between the second identifier 536 and the second geographic location (and/or the second location data 524). The network device(s) may then store the second association data 520.

The process 1900, at block B1918, includes generating a graphical representation that includes a first indication of the first light emitter located at the first geographic location and a second indication of the second light emitter located at the second geographic location. For example, the network device(s) may generate a schematic representation 528 that includes at least a first indication of the first light emitter 232 located at the first geographic location and a second indication of the second light emitter 232 located at the second geographic location. In some examples, the network device(s) may then transmit, to the client device 214, 216, data representing the schematic representation.

Figure 20:
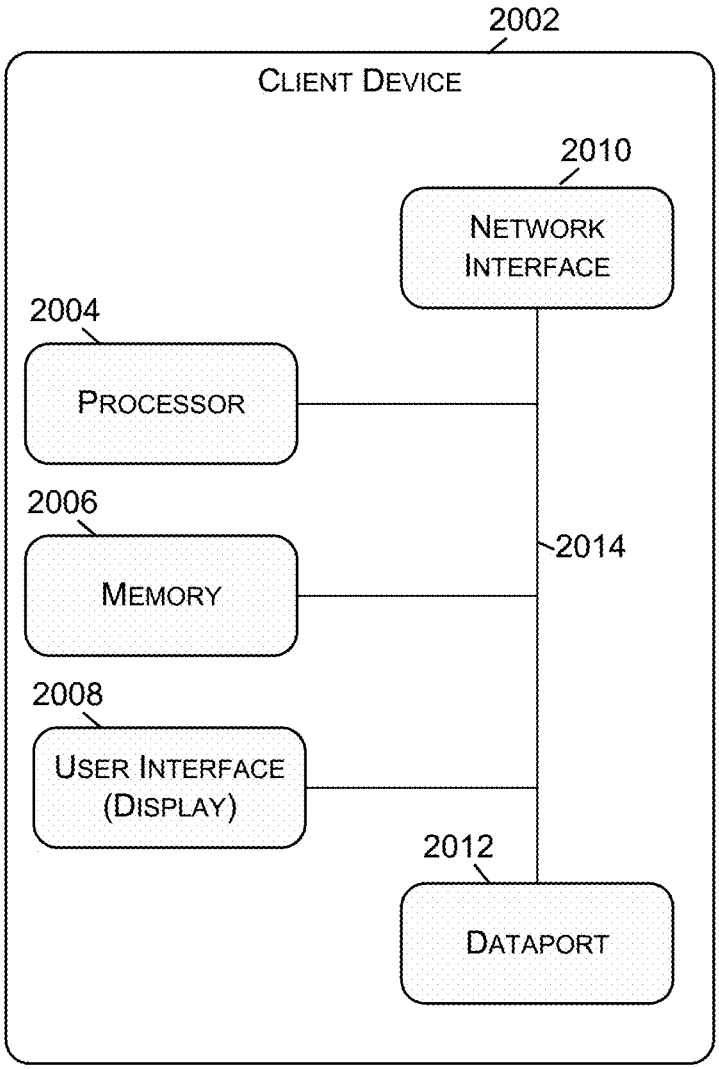
FIG. 20 is a functional block diagram of a client device on which the present embodiments may be implemented according to various aspects of the present disclosure.

FIG. 20 is a functional block diagram of a client device 2002 on which the present embodiments may be implemented according to various aspects of the present disclosure. The client device(s) 214, 216 described with reference to FIG. 2 may include some or all of the components and/or functionality of the client device 2002. The client device 2002 may comprise, for example, a smartphone.

With reference to FIG. 20, the client device 2002 includes a processor 2004, a memory 2006, a user interface 2008, a communication module 2010, and a dataport 2012. These components are communicatively coupled together by an interconnect bus 2014. The processor 2004 may include any processor used in smartphones and/or portable computing devices, such as an ARM processor (a processor based on the RISC (reduced instruction set computer) architecture developed by Advanced RISC Machines (ARM).). In some embodiments, the processor 2004 may include one or more other processors, such as one or more conventional microprocessors, and/or one or more supplementary co-processors, such as math co-processors.

The memory 2006 may include both operating memory, such as random-access memory (RAM), as well as data storage, such as read-only memory (ROM), hard drives, flash memory, or any other suitable memory/storage element. The memory 2006 may include removable memory elements, such as a CompactFlash card, a MultiMediaCard (MMC), and/or a Secure Digital (SD) card. In some embodiments, the memory 2006 may comprise a combination of magnetic, optical, and/or semiconductor memory, and may include, for example, RAM, ROM, flash drive, and/or a hard disk or drive. The processor 2004 and the memory 2006 each may be, for example, located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 2004 may be connected to the memory 2006 via the dataport 2012.

The user interface 2008 may include any user interface or presentation elements suitable for a smartphone and/or a portable computing device, such as a keypad, a display screen, a touchscreen, a microphone, and a speaker. The communication module 2010 is configured to handle communication links between the client device 2002 and other, external devices or receivers, and to route incoming/outgoing data appropriately. For example, inbound data from the dataport 2012 may be routed through the communication module 2010 before being directed to the processor 2004, and outbound data from the processor 2004 may be routed through the communication module 2010 before being directed to the dataport 2012. The communication module 2010 may include one or more transceiver modules capable of transmitting and receiving data, and using, for example, one or more protocols and/or technologies, such as GSM, UMTS (3GSM), IS-95 (CDMA one), IS-2000 (CDMA 2000), LTE, FDMA, TDMA, W-CDMA, CDMA, OFDMA, Wi-Fi, WiMAX, or any other protocol and/or technology.

The dataport 2012 may be any type of connector used for physically interfacing with a smartphone and/or a portable computing device, such as a mini-USB port or an IPHONE®/POD® 30-pin connector or LIGHTNING® connector. In other embodiments, the dataport 2012 may include multiple communication channels for simultaneous communication with, for example, other processors, servers, and/or client terminals.

The memory 2006 may store instructions for communicating with other systems, such as a computer. The memory 2006 may store, for example, a program (e.g., computer program code) adapted to direct the processor 2004 in accordance with the present embodiments. The instructions also may include program elements, such as an operating system. While execution of sequences of instructions in the program causes the processor 2004 to perform the process steps described herein, hard-wired circuitry may be used in place of, or in combination with, software/firmware instructions for implementation of the processes of the present embodiments. Thus, the present embodiments are not limited to any specific combination of hardware and software.

Figure 21:
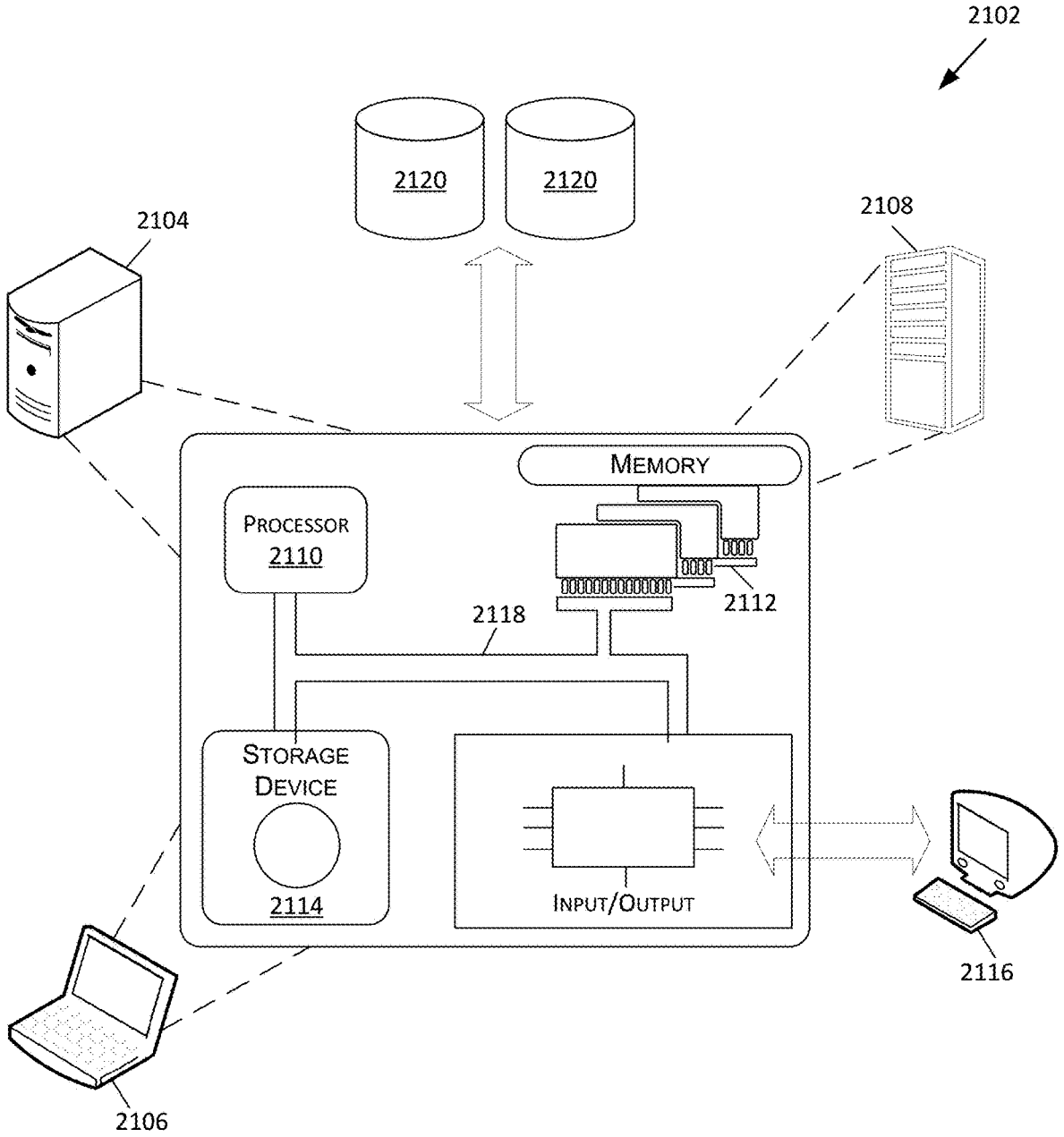
FIG. 21 is a functional block diagram of a general-purpose computing system on which the present embodiments may be implemented according to various aspects of present disclosure.

FIG. 21 is a functional block diagram of a general-purpose computing system on which the present embodiments may be implemented according to various aspects of the present disclosure. The computer system 2102 may be embodied in at least one of a personal computer (also referred to as a desktop computer) 2104, a portable computer (also referred to as a laptop or notebook computer) 2106, and/or a server 2108 is a computer program and/or a machine that waits for requests from other machines or software (clients) and responds to them. A server typically processes data. The purpose of a server is to share data and/or hardware and/or software resources among clients. This architecture is called the client-server model. The clients may run on the same computer or may connect to the server over a network. Examples of computing servers include database servers, file servers, mail servers, print servers, web servers, game servers, and application servers. The term server may be construed broadly to include any computerized process that shares a resource to one or more client processes.

The computer system 2102 may execute at least some of the operations described above. The computer system 2102 may include at least one processor 2110, memory 2112, at least one storage device 2114, and input/output (I/O) devices 2116. Some or all of the components 2110, 21 12, 2114, 2116 may be interconnected via a system bus 2118. The processor 2110 may be single- or multi-threaded and may have one or more cores. The processor 2110 execute instructions, such as those stored in the memory 2112 and/or in the storage device 2114. Information may be received and output using one or more I/O devices 2116.

The memory 2112 may store information, and may be a computer-readable medium, such as volatile or non-volatile memory. The storage device(s) 2114 may provide storage for the system 2102 and, in some embodiments, may be a computer-readable medium. In various aspects, the storage device(s) 2114 may be a flash memory device, a hard disk device, an optical disk device, a tape device, or any other type of storage device.

The I/O devices 2116 may provide input/output operations for the system 2102. The I/O devices 2116 may include a keyboard, a pointing device, and/or a microphone. The I/O devices 2116 may further include a display unit for displaying graphical user interfaces, a speaker, and/or a printer. External data may be stored in one or more accessible external databases 2120.

The features of the present embodiments described herein may be implemented in digital electronic circuitry, and/or in computer hardware, firmware, software, and/or in combinations thereof. Features of the present embodiments may be implemented in a computer program product tangibly embodied in an information carrier, such as a machine-readable storage device, and/or in a propagated signal, for execution by a programmable processor. Embodiments of the present method steps may be performed by a programmable processor executing a program of instructions to perform functions of the described implementations by operating on input data and generating output.

The features of the present embodiments described herein may be implemented in one or more computer programs that are executable on a programmable system including at least one programmable processor coupled to receive data and/or instructions from, and to transmit data and/or instructions to, a data storage system, at least one input device, and at least one output device. A computer program may include a set of instructions that may be used, directly or indirectly, in a computer to perform a certain activity or bring about a certain result. A computer program may be written in any form of programming language, including compiled or interpreted languages, and it may be deployed in any form, including as a stand-alone program or as a module, component, subroutine, or other unit suitable for use in a computing environment.

Suitable processors for the execution of a program of instructions may include, for example, both general and special purpose processors, and/or the sole processor or one of multiple processors of any kind of computer. Generally, a processor may receive instructions and/or data from a read only memory (ROM), or a random-access memory (RAM), or both. Such a computer may include a processor for executing instructions and one or more memories for storing instructions and/or data.

Generally, a computer may also include, or be operatively coupled to communicate with, one or more mass storage devices for storing data files. Such devices include magnetic disks, such as internal hard disks and/or removable disks, magneto-optical disks, and/or optical disks. Storage devices suitable for tangibly embodying computer program instructions and/or data may include all forms of non-volatile memory, including for example semiconductor memory devices, such as EPROM, EEPROM, and flash memory devices, magnetic disks such as internal hard disks and removable disks, magneto-optical disks, and CD-ROM and DVD-ROM disks. The processor and the memory may be supplemented by, or incorporated in, one or more ASICs (application-specific integrated circuits).

To provide for interaction with a user, the features of the present embodiments may be implemented on a computer having a display device, such as an LCD (liquid crystal display) monitor, for displaying information to the user. The computer may further include a keyboard, a pointing device, such as a mouse or a trackball, and/or a touchscreen by which the user may provide input to the computer.

The features of the present embodiments may be implemented in a computer system that includes a back-end component, such as a data server, and/or that includes a middleware component, such as an application server or an Internet server, and/or that includes a front-end component, such as a client computer having a graphical user interface (GUI) and/or an Internet browser, or any combination of these. The components of the system may be connected by any form or medium of digital data communication, such as a communication network. Examples of communication networks may include, for example, a LAN (local area network), a WAN (wide area network), and/or the computers and networks forming the Internet.

The computer system may include clients and servers. A client and server may be remote from each other and interact through a network, such as those described herein. The relationship of client and server may arise by virtue of computer programs running on the respective computers and having a client-server relationship to each other.

As used herein, the phrases "at least one of A, B and C," "at least one of A, B, or C," and "A, B, and/or C" are synonymous and mean logical "OR" in the computer science sense. Thus, each of the foregoing phrases should be understood to read on (A), (B), (C), (A and B), (A and C), (B and C), and (A and B and C), where A, B, and C are variables representing elements or features of the claim. Also, while these examples are described with three variables (A, B, C) for ease of understanding, the same interpretation applies to similar phrases in these formats with any number of two or more variables.

The above description presents the best mode contemplated for carrying out the present embodiments, and of the manner and process of practicing them, in such full, clear, concise, and exact terms as to enable any person skilled in the art to which they pertain to practice these embodiments. The present embodiments are, however, susceptible to modifications and alternate constructions from those discussed above that are fully equivalent. Consequently, the present invention is not limited to the particular embodiments disclosed. On the contrary, the present invention covers all modifications and alternate constructions coming within the spirit and scope of the present disclosure. For example, the steps in the processes described herein need not be performed in the same order as they have been presented, and may be performed in any order(s). Further, steps that have been presented as being performed separately may in alternative embodiments be performed concurrently. Likewise, steps that have been presented as being performed concurrently may in alternative embodiments be performed separately.

In a first aspect, a method comprises: receiving first image data generated by an audio/video (A/V) device, the first image data representing a field of view (FOV) of the A/V device that includes at least a first light emitter and a second light emitter; transmitting the first image data to a client device; receiving first data from the client device, the first data indicating that a first portion of the FOV represents the first light emitter and a second portion of the FOV represents the second light emitter; storing second data indicating a first association between the first portion of the FOV of the A/V device and the first light emitter; storing third data indicating a second association between the second portion of the FOV of the A/V device and the second light emitter; receiving fourth data indicating that the client device is displaying a user interface; based at least in part on the fourth data, receiving second image data generated by the A/V device, the second image data representing the FOV of the A/V device; transmitting the second image data to the client device; receiving fifth data indicating a selection of the first portion of the FOV of the A/V device; based at least in part on the first association and the fifth data, generating sixth data that includes an identifier associated with the first light emitter and a command to activate; and transmitting the sixth data.

In an embodiment of the first aspect, the method further comprises: receiving seventh data indicating the identifier associated with the first light emitter; and receiving eighth data indicating an additional identifier associated with the second light emitter, wherein the first association is between the first portion of the FOV of the A/V device and the identifier associated with the first light emitter, and wherein the second association is between the second portion of the FOV of the A/V device and the additional identifier associated with the second light emitter.

In another embodiment of the first aspect, wherein: the first data indicating that the first portion of the FOV represents the first light emitter and the second portion of the FOV represents the second light emitter comprises at least: data indicating that a first portion of a first image represented by the first image data represents the first light emitter; and data indicating that a second portion of the first image represents the second light emitter; and the method further comprises: determining that the first portion of the first image corresponds to the first portion of the FOV of the A/V device; and determining that the second portion of the first image corresponds to the second portion of the FOV of the A/V device.

In another embodiment of the first aspect, the method further comprises: determining that a first portion of the first image data may represent a first potential light emitter, the first portion of the first image data corresponding to the first portion of the FOV of the A/V device; determining that a second portion of the first image data may represent a second potential light emitter, the second portion of the first image data corresponding to the second portion of the FOV of the A/V device; and transmitting seventh data indicating that the first portion of the first image data may represent the first potential light emitter and the second portion of the first image data may represent the second potential light emitter.

In another embodiment of the first aspect, the method further comprises: receiving seventh data indicating that the client device is displaying the user interface or an additional user interface; based at least in part on the seventh data, receiving third image data generated by the A/V device, the third image data representing the FOV of the A/V device; transmitting the third image data to the client device; receiving eighth data indicating a selection of the first portion of the FOV of the A/V device; based at least in part on the first association and the eighth data, generating ninth data that includes the identifier associated with the first light emitter and an additional command to deactivate; and transmitting the ninth data.

In another embodiment of the first aspect, wherein the fifth data further indicates an additional selection of the second portion of the FOV of the A/V device, and wherein generating of the sixth data further includes generating the sixth data to include an additional identifier associated with the second light emitter.

In another embodiment of the first aspect, the method further comprises: receiving seventh data indicating an additional selection of the second portion of the FOV of the A/V device; based at least in part on the second association and the seventh data, generating eighth data that includes an additional identifier associated with the second light emitter and an additional command to activate; and transmitting the eighth data.

In another embodiment of the first aspect, wherein the transmitting of the sixth data comprises transmitting the sixth data to at least one of the first light emitter or an electronic device that controls the first light emitter.

In another embodiment of the first aspect, the method further comprises: determining to associate the first light emitter and the second light emitter based at least in part on the first light emitter and the second light emitter being located within the FOV of the A/V device; and storing seventh data indicating that the first light emitter is associated with the second light emitter.

In a second aspect, one or more network devices comprise: one or more network interfaces; one or more processors; and one or more computer-readable media storing instructions that, when executed by the one or more processors, cause the one or more processors to perform operations comprising: receiving, using the one or more network interfaces, first image data generated by an audio/video (A/V) device, the first image data representing a field of view (FOV) of the A/V device that includes at least a first light emitter and a second light emitter; transmitting, using the one or more network interfaces, the first image data to a client device; receiving, using the one or more network interfaces, first data from the client device, the first data indicating that a first portion of the FOV represents the first light emitter and a second portion of the FOV represents the second light emitter; storing second data indicating a first association between the first portion of the FOV of the A/V device and the first light emitter; storing third data indicating a second association between the second portion of the FOV of the A/V device and the second light emitter; receiving, using the one or more network interfaces, fourth data indicating that a client device is displaying a user interface; based at least in part on the fourth data, receiving, using the one or more network interfaces, second image data generated by the A/V device, the second image data representing the FOV of the A/V device; transmitting, using the one or more network interfaces, the second image data to the client device; receiving, using the one or more network interfaces, fifth data indicating a selection of the first portion of the FOV of the A/V device; based at least in part on the first association and the fifth data, generating sixth data that includes an identifier associated with the first light emitter and a command to activate; and transmitting, using the one or more network interfaces, the sixth data.

In a third aspect, a method comprises: receiving first image data generated by an audio/video (A/V) device, the first image data representing a field of view (FOV) of the A/V device that includes at least a first light emitter and a second light emitter; determining that a first portion of the FOV of the A/V device represents the first light emitter; determining that a second portion of the FOV of the A/V device represents the second light emitter; transmitting the first image data to a client device; transmitting, to the client device, first data indicating that the first portion of the FOV of the A/V device represents the first light emitter and the second portion of the FOV of the A/V device represents the second light emitter; receiving, from the client device, second data indicating that the first portion of the FOV of the A/V device is associated with a first identifier of the first light emitter and the second portion of the FOV of the A/V device is associated with a second identifier of the second light emitter; storing third data indicating a first association between the first portion of the FOV of the A/V device and the first identifier; storing fourth data indicating a second association between the second portion of the FOV of the A/V device and the second identifier; receiving second image data generated by the A/V device, the second image data representing the FOV of the A/V device; transmitting the second image data to the client device; based at least in part on the second image data, receiving, form the client device, sixth data indicating a selection of the first portion of the FOV of the A/V device; based at least in part on the first association and the selection of the first portion of the FOV of the A/V device, generating seventh data that includes the first identifier and a command to activate; and transmitting the seventh data.

In an embodiment of the third aspect, the method further comprises: determining that a first portion of the first image data represents the first light emitter; and determining that a second portion of the first image data represents the second light emitter, wherein: the determining that the first portion of the FOV of the A/V device represents the first light emitter comprises determining that the first portion of the first image data corresponds to the first portion of the FOV of the A/V device; and the determining that the second portion of the FOV of the A/V device represents the second light emitter comprises determining that the second portion of the first image data corresponds to the second portion of the FOV of the A/V device.

In another embodiment of the third aspect, wherein: the determining that the first portion of the first image data represents the first light emitter comprises determining that the first portion of the first image data switches from representing the first light emitter is a first state to representing the first light emitter in a second state; and the determining that the second portion of the first image data represents the second light emitter comprises determining that the second portion of the first image data switches from representing the second light emitter in the first state to representing the second light emitter in the second state.

In another embodiment of the third aspect, the method further comprises: analyzing the first image data with respect to third image data that represents a third light emitter, wherein: the determining that the first portion of the first image data represents the first light emitter comprises determining that the first portion of the first image data corresponds to the third image data representing the third light emitter; and the determining that the second portion of the first image data represents the second light emitter comprises determining that the second portion of the first image data corresponds to the third image data representing the third light emitter.

In another embodiment of the third aspect, the method further comprises: receiving third image data generated by the A/V device, the third image data representing the FOV of the A/V device; transmitting the third image data to the client device; receiving, form the client device, eighth data indicating an additional selection the first portion of the FOV of the A/V device; based at least in part on the additional selection of the first portion of the FOV of the A/V device, generating ninth data that includes the first identifier and an additional command to deactivate; and transmitting the ninth data.

In another embodiment of the third aspect, wherein the sixth data further indicates an additional selection of the second portion of the FOV of the A/V device, and wherein the generating seventh data that includes the first identifier and the command to activate further comprises generating the seventh data to include the second identifier.

In another embodiment of the third aspect, the method further comprises: receiving, from the client device, eighth data indicating an additional selection of the second portion of the FOV of the A/V device; based at least in part on the second association and the additional selection of the second portion of the FOV of the A/V device; generating ninth data that includes the second identifier and an additional command to activate; and transmitting the ninth data.

In another embodiment of the third aspect, the method further comprises: receiving, from the client device, eighth data indicating that the client device is displaying a user interface, wherein the transmitting of the second image data to the client device is based at least in part on the eighth data.

In another embodiment of the third aspect, the method further comprises: receiving, from the client device, eighth data indicating that the client device received an input associated with activating light emitters, wherein the transmitting of the second image data to the client device is based at least in part on the eighth data.

In another embodiment of the third aspect, wherein the transmitting of the seventh data comprises transmitting the seventh data to at least one of the first light emitter or an electronic device that controls the first light emitter.

In a fourth aspect, a method comprises: receiving first data indicating a first identifier associated with a first light emitter located at an environment; transmitting, to a client device, second data indicating a first instruction to place the client device within a threshold distance to the first light emitter; receiving, from the client device, third data indicating a first geographic location associated with the client device; associating the first identifier with the first geographic location; receiving fourth data indicating a second identifier associated with a second light emitter located at the environment; transmitting, to the client device, fifth data indicating a second instruction to place the client device within the threshold distance to the second light emitter; receiving, from the client device, sixth data indicating a second geographic location associated with the client device; and associating the second identifier with the second geographic location; and generating a schematic representation of the environment, the schematic representing including at least a first indication that the first light emitter is located at the first geographic location and a second indication that the second light emitter is located at the second geographic location.

In an embodiment of the fourth aspect, the method further comprises: receiving seventh data indicating that the first light emitter detected an object; receiving eighth data indicating that the second light emitter detected the object; determining, based at least in part on the seventh data and the eighth data, that the second light emitter detected the object within a threshold period of time to the first light emitter; and associating the second light emitter with the first light emitter based at least in part on the second light emitter detecting the object within the threshold period of time to the first light emitter.

In another embodiment of the fourth aspect, the method further comprises: receiving ninth data indicating that an audio/video (A/V) device detected the object; determining, based at least in part on the eighth data and the ninth data, that the A/V device detected the object within the threshold period of time to the second light emitter; and associating the A/V device with the first light emitter and the second light emitter based at least in part on the A/V device detecting the object within the threshold period of time to the second light emitter.

In another embodiment of the fourth aspect, the method further comprises: transmitting, to the client device, seventh data representing the schematic representation; receiving, from the client device, eighth data indicating that the client device received a selection associated with the first light emitter; based at least in part on the eighth data, generating ninth data that includes the first identifier and a command to activate; and transmitting the ninth data.

In a fifth aspect, a method comprises: receiving first data from a client device, the first data indicating a request to associate a light emitter with an electronic device; receiving image data generated by the electronic device, the image data representing a field of view (FOV) of the electronic device that includes at least the light emitter; transmitting the image data to the client device; receiving second data from the client device, the second data indicating that a portion of the image data represents the light emitter; determining an identifier associated with the light emitter; and storing third data indicating an association between the portion of the image data and the identifier associated with the light emitter.

In an embodiment of the fifth aspect, the method further comprises: determining that the portion of the image data corresponds to a portion of the FOV of the A/V device, wherein the association between the portion of the image data and the identifier associated with the light emitter includes an association between the portion of the FOV of the electronic device and the identifier associated with the light emitter.

In another embodiment of the fifth aspect, the method further comprises: determining that the portion of the image data may represent a potential light emitter; and transmitting, to the client device, fourth data indicating that the portion of the image data may represent the portion light emitter.

In another embodiment of the fifth aspect, the method further comprises: generating fourth data that includes the identifier associated with the light emitter and a command to activate; and transmitting the fourth data, wherein the image data represents the light emitter witching from a first state to a second state.

In another embodiment of the fifth aspect, wherein the image data is first image data, and wherein the method further comprises: receiving second image data generated by the electronic device, the second image data representing the FOV of the electronic device; transmitting the second image data to the client device; receiving fourth data indicating that the client device received a selection of a portion of the second image data; determining that the portion of the first image data corresponds to the portion of the second image data; based at least in part on the association and the portion of the first image data corresponding to the portion of the second image data, generating fifth data that includes the identifier associated with the light emitter and a command to activate; and transmitting the fifth data.

In another embodiment of the fifth aspect, wherein the client device is a first client device and the image data is first image data, and wherein the method further comprises: receiving second image data generated by the electronic device, the second image data representing the FOV of the electronic device; transmitting the second image data to a second client device; receiving fourth data indicating that the second client device received a selection of a portion of the second image data; determining that the portion of the first image data corresponds to the portion of the second image data; based at least in part on the association and the portion of the first image data corresponding to the portion of the second image data, generating fifth data that includes the identifier associated with the light emitter and a command to activate; and transmitting the fifth data.

In another embodiment of the fifth aspect, wherein the light emitter is a first light emitter, the portion is a first portion, and the identifier is a first identifier, and wherein the method further comprises: receiving fourth data from the client device, the fourth data indicating that a second portion of the image data represents a second light emitter; determining a second identifier associated with the second light emitter; and storing fifth data indicating an association between the second portion of the image data and the second identifier associated with the second light emitter.

In a sixth aspect, a method comprises: receiving first data from a client device, the first data indicating a request to associate a light emitter with an electronic device; receiving image data generated by the electronic device, the image data representing a field of view (FOV) of the electronic device that includes at least the light emitter; determining that a portion of the image data represents the light emitter; transmitting the image data to a client device; transmitting, to the client device, second data indicating that the portion of the image data represents the light emitter; receiving, from the client device, third data indicating that the portion of the image data is associated with an identifier of the light emitter; and storing fourth data indicating an association between the portion of the image data and the identifier of the light emitter.

In an embodiment of the sixth aspect, the method further comprises: determining that the portion of the image data corresponds to a portion of the FOV of the A/V device, wherein the association between the portion of the image data and the identifier of the light emitter includes an association between the portion of the FOV of the electronic device and the identifier of the light emitter.

In another embodiment of the sixth aspect, the method further comprises: generating fifth data that includes the identifier of the light emitter and a command to activate; and transmitting the fifth data, wherein the determining that the portion of the image data represents the light emitter comprises determining that the portion of the image data represents the light emitter switching from a first state to a second state.

In another embodiment of the sixth aspect, wherein the image data is first image data and the light emitter is a first light emitter, and wherein the method further comprises: analyzing the first image data with respect to second image data that represents a second light emitter, wherein the determining that the portion of the image data represents the first light emitter comprises determining that the portion of the first image data corresponds to the second image data representing the second light emitter.

In another embodiment of the sixth aspect, wherein the image data is first image data, and wherein the method further comprises: receiving second image data generated by the electronic device, the second image data representing the FOV of the electronic device; transmitting the second image data to the client device; receiving fifth data indicating that the client device received a selection of a portion of the second image data; determining that the portion of the first image data corresponds to the portion of the second image data; based at least in part on the association and the portion of the first image data corresponding to the portion of the second image data, generating fourth data that includes the identifier of the light emitter and a command to activate; and transmitting the fourth data.

In another embodiment of the sixth aspect, wherein the client device is a first client device and image data is first image data, and wherein the method further comprises: receiving second image data generated by the electronic device, the second image data representing the FOV of the electronic device; transmitting the second image data to a second client device; receiving fifth data indicating that the second client device received a selection of a portion of the second image data; determining that the portion of the first image data corresponds to the portion of the second image data; based at least in part on the association and the portion of the first image data corresponding to the portion of the second image data, generating fourth data that includes the identifier of the light emitter and a command to activate; and transmitting the fourth data.

In another embodiment of the sixth aspect, wherein the light emitter is a first light emitter, the portion is a first portion, the identifier is a first identifier, and the association is a first association, and wherein the method further comprises: determining that a second portion of the image data represents a second light emitter; transmitting, to the client device, fifth data indicating that the second portion of the image data represents the second light emitter; receiving, from the client device, sixth data indicating that the second portion of the image data is associated with a second identifier of the second light emitter; and storing seventh data indicating a second association between the second portion of the image data and the second identifier of the second light emitter.

In a seventh aspect, a method comprises: storing first data indicating an identifier associated with a light emitter that is located within a field of view (FOV) of an electronic device; receiving image data generated by the electronic device, the image data representing the FOV of the electronic device transmitting the image data to a client device; receiving second data from the client device, the second data indicating a selection of a portion of an image represented by the image data, the portion of the image representing the light emitter; based at least in part on the selection of the portion of the image that represents the light emitter, generating third data that includes the identifier associated with the light emitter and a command to activate; and transmitting the third data to the light emitter.

In an embodiment of the seventh aspect, the method further comprises: determining that the portion of the image represents the light emitter; and transmitting fourth data to the client device, the fourth data including an additional command to display an interface element over the portion of the image, wherein the selection of the portion of the image representing by the image data includes a selection of the interface element.

In another embodiment of the seventh aspect, the method further comprises: storing fourth data indicating an association between the light emitter and a portion of the FOV of the electronic device; and determining that the portion of the image corresponds to the portion of the FOV of the electronic device, wherein the generating of the third data is based at least in part on the determining that the portion of the image corresponds to the portion of the FOV of the electronic device.

In another embodiment of the seventh aspect, wherein the image data is first image data, the image is a first image, and the command is a first command, and wherein the method further comprises: receiving second image data generated by the electronic device, the second image data representing the FOV of the electronic device; transmitting the second image data to the client device; receiving fourth data from the client device, fourth data indicating a selection of a portion of a second image represented by the second image data, the portion of the second image representing the light emitter; based at least in part on the selection of the portion of the second image that represents the light emitter, generating fifth data that includes the identifier associated with the light emitter and a second command to deactivate; and transmitting the fifth data to the light emitter.

In another embodiment of the seventh aspect, wherein the identifier is a first identifier, the light emitter is a first light emitter, the selection is a first selection, the portion of the image is a first portion of the image, and the command is a first command, and wherein the method further comprises: storing fourth data indicating a second identifier associated with a second light emitter that is located within the FOV of the electronic device; receiving fifth data from the client device, the fifth data indicating a second selection of a second portion of the image, the second portion of the image representing the second light emitter; based at least in part on the second selection of the second portion of the second image that represents the second light emitter, generating sixth data that includes the second identifier associated with the second light emitter and a second command to activate; and transmitting the sixth data to the second light emitter.

In another embodiment of the seventh aspect, wherein the identifier is a first identifier, the light emitter is a first light emitter, the selection is a first selection, and the portion of the image is a first portion of the image, and wherein the method further comprises: storing fourth data indicating a second identifier associated with a second light emitter that is located within the FOV of the electronic device; and receiving fifth data from the client device, the fifth data indicating a second selection of a second portion of the image, the second portion of the image representing the second light emitter, wherein the third data further includes the second identifier associated with the second light emitter.

In another embodiment of the seventh aspect, wherein the identifier is a first identifier and the light emitter is a first light emitter, and wherein the method further comprises: storing fourth data indicating an association between the first identifier associated with the first light emitter and a second identifier associated with a second light emitter, wherein the third data further includes the second identifier associated with the second light emitter.

In another embodiment of the seventh aspect, wherein the image data is first image data and the image is a first image, and wherein the method further comprises: receiving second image data generated by the electronic device, the second image data representing the FOV of the electronic device; transmitting the second image data to the client device; receiving fourth data from the client device, the fourth data indicating: a selection of a portion of a second image represented by the second image data, the portion of the second image representing a portion of the FOV of the electronic device; and the portion of the second image represents the light emitter; and based at least in part on the fourth data, storing fifth data indicating an association between the portion of the FOV of the electronic device and the identifier associated with the light emitter; and determining that the portion of the image corresponds to the portion of the FOV of the electronic device, wherein the generating of the third data that includes the identifier associated with the light emitter and the command to activate is based at least in part on the determining that the portion of the image corresponds to the portion of the FOV of the electronic device.

In another embodiment of the seventh aspect, wherein the image data is first image data, the client device is a first client device, and the image is a first image, and wherein the method further comprises: receiving second image data generated by the electronic device, the second image data representing the FOV of the electronic device; transmitting the second image data to a second client device; receiving fourth data from the second client device, the fourth data indicating: a selection of a portion of a second image represented by the second image data; and the portion of the second image represents the light emitter; determining that the portion of the second image corresponds to a portion of the FOV of the electronic device; and transmitting fifth data to the first client device, the fifth data indicating an association between the portion of the FOV of the electronic device and the identifier associated with the light emitter.

In an eighth aspect, a method comprises: receiving first image data generated by an audio/video (A/V) device; causing a first image represented by the first image data to be displayed on a display, the first image representing a field of view (FOV) of the A/V device; receiving a first input indicating that a first portion of the first image represents a first light emitter; receiving a second input indicating that a second portion of the first image represents a second light emitter; receiving a third input corresponding to a request to display a user interface; transmitting first data to the network device, the first data indicating the request to display the user interface; based at least in part on the second data, receiving second image data generated by the A/V device; causing a second image represented by the second image data to be displayed on the display, the second image representing the FOV of the A/V device; receiving a fourth input indicating a selection of a portion of the second image, the portion of the second image corresponding to the first portion of the first image; and based at least in part on the fourth input, transmitting second data to the network device, the second data representing at least one of: an indication of the selection of the portion of the second image; or a command to activate the first light emitter.

In an embodiment of the eighth aspect, the method further comprises transmitting third data to the network device, the third data indicating that the first portion of the first image data corresponds to the first light emitter and the second portion of the second image data corresponds to the second light emitter.

In another embodiment of the eighth aspect, the method further comprises: causing a first interface element to be located at the portion of the second image, the first interface element being associated with controlling the first light emitter; and causing a second interface element to be located at an additional portion of the second image, the second interface element being associated with controlling the second light emitter, wherein the selection of the portion of the second image includes a selection of the first interface element.

In another embodiment of the eighth aspect, the method further comprises: determining that the first portion of the first image corresponds to a first portion of the FOV of the A/V device; storing third data indicating a first association between the first portion of the FOV of the A/V device and the first light emitter; determining that the second portion of the first image corresponds to a second portion of the FOV of the A/V device; and storing fourth data indicating a second association between the second portion of the FOV of the A/V device and the second light emitter.

In another embodiment of the eighth aspect, the method further comprises: based at least in part on the first association, causing a first interface element to be located at the portion of the second image, the first interface element being associated with controlling the first light emitter; and based at least in part on the second association, causing a second interface element to be located at an additional portion of the second image, the second interface element being associated with controlling the second light emitter, wherein the selection of the portion of the second image includes a selection of the first interface element.

In another embodiment of the eighth aspect, the method further comprises: determining that the first input is associated with a first portion of the display; storing third data indicating a first association between the first portion of the display and the first light emitter; determining that the second input is associated with a second portion of the display; and storing fourth data indicating a second association between the second portion of the display and the second light emitter.

In another embodiment of the eighth aspect, the method further comprises: based at least in part on the first association, causing a first interface element to be located at the portion of the second image, the first interface element being associated with controlling the first light emitter; and based at least in part on the second association, causing a second interface element to be located at an additional portion of the second image, the second interface element being associated with controlling the second light emitter, wherein the selection of the portion of the second image includes a selection of the first interface element.

In another embodiment of the eighth aspect, wherein the second image represents the first light emitter in an off state, and wherein the method further comprises: receiving third image data generated by the A/V device; and causing a third image represented by the third image data to be displayed on the display, wherein, based at least in part on the transmitting of the third data, the third image represents the first light emitter in an on state.

In another embodiment of the eighth aspect, the method further comprises: receiving a fifth input indicating that the first light emitter is associated with a first identifier; receiving a second input indicating that the second light emitter is associated with a second identifier; and transmitting third image data to the network device, the third image data indicating that the first portion of the first image is associated with the first identifier and the second portion of the first image is associated with the second identifier.

In another embodiment of the eighth aspect, wherein the selection is a first selection, the portion of the second image is a first portion of the second image, the indication is a first indication, and the command is a first command, and wherein the method further comprises: receiving a fifth input indicating a second selection of a second portion of the second image, the second portion of the second image corresponding to the second portion of the first image; and based at least in part on the fifth input, transmitting third data to the network device, the third data representing at least one of: a second indication of the second selection of the second portion of the second image; or a second command to activate the second light emitter.

In another embodiment of the eighth aspect, wherein the request is a first request, the user interface is a first user interface, the selection is a first selection, the indication is a first indication, and the command is a first command, and wherein the method further comprises: receiving a fifth input corresponding to a second request to display the first user interface or a second user interface; transmitting third data to the network device, the third data indicating the second request to display the first user interface or the second user interface; based at least in part on the third data, receiving third image data generated by the A/V device; causing a third image representing the third image data to be displayed on the display, the third image representing the FOV of the A/V device; receiving a sixth input indicating a second selection of a portion of the third image, the portion of the third image corresponding to the first portion of the first image; and based at least in part on the sixth input, transmitting fourth data to the network device, the fourth data representing at least one of: a second indication of the second selection of the portion of the third image; or a second command to deactivate the first light emitter.

In another embodiment of the eighth aspect, wherein, before the receiving of the first image data, the method further comprises: receiving third image data generated by the A/V device; causing a third image represented by the third image data to be displayed on the display, the third image representing at least the first light emitter in an off state; receiving a fifth input associated with causing the first light emitter to switch to an on state; and transmitting third data to the network device, the third data indicating the fifth input associated with causing the first light emitter to switch to the on state, wherein, based at least in part on the third data, the first image represents the first light emitter in the on state.

In a ninth aspect, a method comprises: receiving first image data generated by an audio/video (A/V) device, the first image data representing a first image; receiving first data from a remote system, the first data indicating a first portion of the first image that represents a first light emitter and a second portion of the first image that represents a second light emitter; causing the first image to be displayed on a display; causing a first interface element to be displayed at the first portion of the first image; causing a second interface element to be displayed at the second portion of the first image; receiving a first input indicating that the first interface element is associated with a first identifier for the first light emitter; receiving a second input indicating that a second interface element is associated with a second identifier of the second light emitter; transmitting second data to a network device, the second data indicating that the first portion of the first image is associated with the first identifier and the second portion of the first image is associated with the second identifier; receiving second image data generated by the A/V device, the second image data representing a second image; causing the second image to be displayed on the display; causing the first interface element to be displayed over the second image; causing the second interface element to be displayed over the second image; receiving a third input indicating a selection of the first interface element; and based at least in part on the third input, transmitting third data to the network device, the third data representing at least one of: an indication of the selection of the first interface element; or a first command to activate the first light emitter.

In an embodiment of the ninth aspect, the method further comprises: receiving a fourth input associated with displaying a user interface associated with activating light emitters; and transmitting fourth data to the network device, the fourth data indicating the fourth input, wherein the receiving of the second image data is based at least in part on the fourth data.

In another embodiment of the ninth aspect, wherein the second image represents the first light emitter in an off state, and wherein the method further comprises: receiving third image data generated by the A/V device; and causing a third image represented by the third image data to be displayed on the display, wherein, based at least in part on the transmitting of the third data, the third image represents the first light emitter in an on state.

In another embodiment of the ninth aspect, the method further comprises: receiving fourth data from the remote system, the fourth data indicating a first portion of the second image that represents the first light emitter and a second portion of the second image that represents a second light emitter, wherein: the causing of the first interface element to be displayed over the second image comprises causing the first interface element to be displayed at the first portion of the second image; and the causing of the second interface element to be displayed over the second image comprises causing the second interface element to be displayed at the second portion of the second image.

In another embodiment of the ninth aspect, the method further comprises: receiving a fifth input indicating an additional selection of the second interface element; and based at least in part on the fifth input, transmitting fourth data to the network device, the fourth data representing at least one of: an indication of the additional selection of the second interface element; or a command to activate the second light emitter.

In another embodiment of the ninth aspect, the method further comprises: receiving third image data generated by the A/V device, the third image data representing a third image; causing the third image to be displayed on the display; causing the first interface element to be displayed over the third image; causing the second interface element to be displayed over the third image; receiving a fifth input indicating an additional selection of the first interface element; and based at least in part on the fifth input, transmitting fourth data to the network device, the fourth data representing at least one of: an indication of the additional selection of the first interface element; or a command to deactivate the first light emitter.

In another embodiment of the ninth aspect, wherein, before the receiving of the first image data, the method further comprises: receiving third image data generated by the A/V device, the third image data representing a third image, the third image representing the first light emitter in an off state; causing a third image to be displayed on the display; causing the first interface element to be displayed over the third image; causing a second interface element to be displayed over the third image; receiving a fifth input associated with causing the first light emitter to switch to an on state; and transmitting fourth data to the network device, the fourth data indicating the fifth input associated with causing the first light emitter to switch to an on state, wherein, based at least in part on the fifth data, the first image represents the first light emitter in the on state.

In a tenth aspect, a method comprises receiving a first input indicating a request to associate a light emitter with an electronic device; based at least in part on the first input, receiving image data generated by the electronic device; causing an image represented by the image data to be displayed on a display, the image representing a field of view (FOV) of the electronic device; receiving a second input indicating that a portion of the image represents a light emitter, the portion of the image corresponding to a portion of the FOV of the electronic device; generating data indicating an association between the portion of the FOV of the electronic device and the light emitter; and performing at least one of: storing the data; or transmitting the data to a network device.

In an embodiment of the tenth aspect, the method further comprises: receiving third data from the network device, the third data indicating that the portion of the image represents a potential light emitter; and causing an interface element to be displayed at the portion of the image, wherein the second input indicating that the portion of the image represents the light emitter comprises an input selecting the interface element.

In another embodiment of the tenth aspect, the method further comprises: determining that the second input is associated with a portion of the display, the portion of the display corresponding to the portion of the FOV of the electronic device, wherein the association between the portion of the FOV of the electronic device and the light emitter includes an association between the portion of the display and the light emitter.

In another embodiment of the tenth aspect, the method further comprises: receiving a third input indicating that the light emitter is associated with an identifier, the association is between the portion of the FOV of the electronic device and the light emitter includes an association between the portion of the FOV of the electronic device and the identifier.

In another embodiment of the tenth aspect, wherein the image data is first image data, the image is a first image, and the data is first data, and wherein, before the receiving of the first image data, the method further comprises: receiving second image data generated by the electronic device; causing a second image represented by the second image data to be displayed on the display, the second image representing the light emitter in an off state; receiving a third input associated with causing the light emitter to switch to an on state; and transmitting second data to the network device, the second data indicating the third input associated with causing the light emitter to switch to the on state, wherein, based at least in part on the third data, the first image represents the light emitter in the on state.

In another embodiment of the tenth aspect, wherein the image data is first image data and the data is first data, and wherein the method further comprises: receiving second image data generated by the electronic device; causing a second image representing the second image data to be displayed on the display, the second image representing the FOV of the electronic device; receiving a third input indicating a portion of the second image, the portion of the second image corresponding to the portion of the FOV of the electronic device; and based at least in part on the third input, transmitting second data to the network device, the second data representing at least one of: an indication that the client device received the third input associated with the portion of the FOV of the electronic device; or a command to activate the light emitter.

In another embodiment of the tenth aspect, wherein the image data is first image data and the data is first data, and wherein the method further comprises: receiving second image data generated by the electronic device; causing a second image representing the second image data to be displayed on the display, the second image representing the FOV of the electronic device; causing an interface element to be displayed at a portion of the second image, the portion of the second image corresponding to the portion of the FOV of the electronic device, wherein the interface element is associated with activating the light emitter; receiving a third input indicating a selection of the interface element; and based at least in part on the third input, transmitting second data to the network device, the second data representing at least one of: an indication of the selection of the interface element; or a command to activate the light emitter. \

In an eleventh aspect, a method comprises: receiving a first input associated with displaying a graphical user interface (GUI); transmitting first data indicating a request for image data generated by the electronic device; receiving the image data generated by the electronic device; causing an image represented by the image data to be displayed on a display, the image representing a light emitter; receiving a second input indicating a selection of a portion of the image, the portion of the image representing the light emitter; and based at least in part on the second input, transmitting second data to a network device, the second data representing at least one of: an indication of the portion of the image; or a command to activate the light emitter.

In an embodiment of the eleventh aspect, the method further comprises: storing third data indicating an association between a portion of a field of view (FOV) of the electronic device and the light emitter; and based at least in part on the third data, causing an interface element to be located at the portion of the image, the portion of the image corresponding to the portion of the FOV of the electronic device, wherein the selection of the portion of the image includes a selection of the interface element.

In another embodiment of the eleventh aspect, the method further comprises: storing third data indicating an association between a portion of a field of view (FOV) of the electronic device and the light emitter; and determining that the portion of the image corresponds to the portion of the FOV of the electronic device, wherein the transmitting of the second data is further based at least in part on the portion of the image corresponding to the portion of the FOV of the electronic device.

In another embodiment of the eleventh aspect, the method further comprises: storing third data indicating an association between a portion of the display and the light emitter; and based at least in part on the third data, causing an interface element to be located at the portion of the image, the portion of the image corresponding to the portion of the display, wherein the selection of the portion of the image includes a selection of the interface element.

In another embodiment of the eleventh aspect, the method further comprises: storing third data indicating an association between a portion of the display and the light emitter; and determining that the second input is associated with the portion of the display, wherein the transmitting of the second data is further based at least in part on the input being associated with the portion of the display.

In another embodiment of the eleventh aspect, wherein the image is a first image, and wherein the method further comprising: receiving third data from the network device, the third data indicating that a portion of a second image is associated with the light emitter; and based at least in part on the third data, causing an interface element to be located at the portion of the first image, the portion of the first image corresponding to the portion of the second image, wherein the selection of the portion of the image includes a selection of the interface element.

In another embodiment of the eleventh aspect, wherein the image data is first image data, the image is a first image, and the first image represents the light emitter in an off state, and wherein the method further comprises: receiving second image data generated by the electronic device; and causing a second image represented by the second image data to be displayed on the display, wherein, based at least in part on the transmitting of the second data, the second image represents the first light emitter in an on state.

In another embodiment of the eleventh aspect, wherein the image data is first image data, the image is a first image, the selection is a first selection, the indication is a first indication, and the command is a first command, and wherein the method further comprises: receiving second image data generated by the electronic device; causing a second image represented by the second image data to be displayed on the display, the second image representing the light emitter; receiving a third input indicating a second selection of a portion of the second image, the portion of the second image representing the light emitter; and based at least in part on the third input, transmitting third data to the network device, the second data representing at least one of: a second indication of the portion of the second image; or a second command to deactivate the light emitter.

What is claimed is:

1. A method comprising:

receiving first image data generated by an audio/video (A/V) device, the first image data representing a field of view (FOV) of the A/V device that includes at least a first light emitter and a second light emitter;

transmitting the first image data to a client device;

receiving first data from the client device, the first data indicating that a first portion of the FOV represents the first light emitter and a second portion of the FOV represents the second light emitter;

storing second data indicating a first association between the first portion of the FOV of the A/V device and the first light emitter;

storing third data indicating a second association between the second portion of the FOV of the A/V device and the second light emitter;

receiving fourth data indicating that the client device is displaying a user interface;

based at least in part on the fourth data, receiving second image data generated by the A/V device, the second image data representing the FOV of the A/V device;

transmitting the second image data to the client device;

receiving fifth data indicating a selection of the first portion of the FOV of the A/V device;

based at least in part on the first association and the fifth data, generating sixth data that includes an identifier associated with the first light emitter and a command to activate; and transmitting the sixth data.

2. The method as recited in claim 1, further comprising:

receiving seventh data indicating the identifier associated with the first light emitter; and receiving eighth data indicating an additional identifier associated with the second light emitter, wherein the first association is between the first portion of the FOV of the A/V device and the identifier associated with the first light emitter, and wherein the second association is between the second portion of the FOV of the A/V device and the additional identifier associated with the second light emitter.

3. The method as recited in claim 1, wherein:

the first data indicating that the first portion of the FOV represents the first light emitter and the second portion of the FOV represents the second light emitter comprises at least:

data indicating that a first portion of a first image represented by the first image data represents the first light emitter; and data indicating that a second portion of the first image represents the second light emitter; and the method further comprises:

determining that the first portion of the first image corresponds to the first portion of the FOV of the A/V device; and determining that the second portion of the first image corresponds to the second portion of the FOV of the A/V device.

4. The method as recited in claim 1, further comprising:

determining that a first portion of the first image data may represent a first potential light emitter, the first portion of the first image data corresponding to the first portion of the FOV of the A/V device;

determining that a second portion of the first image data may represent a second potential light emitter, the second portion of the first image data corresponding to the second portion of the FOV of the A/V device; and transmitting seventh data indicating that the first portion of the first image data may represent the first potential light emitter and the second portion of the first image data may represent the second potential light emitter.

5. A method comprising:

receiving first data from a client device, the first data indicating a request to associate a light emitter with an electronic device;

receiving image data generated by the electronic device, the image data representing a field of view (FOV) of the electronic device that includes at least the light emitter;

determining that a portion of the image data represents the light emitter;

transmitting the image data to the client device;

transmitting, to the client device, second data indicating that the portion of the image data represents the light emitter;

receiving, from the client device, third data indicating that the portion of the image data is associated with an identifier of the light emitter; and storing fourth data indicating an association between the portion of the image data and the identifier of the light emitter.

6. The method as recited in claim 5, further comprising:

determining that the portion of the image data corresponds to a portion of the FOV of the electronic device, wherein the association between the portion of the image data and the identifier of the light emitter includes an association between the portion of the FOV of the electronic device and the identifier of the light emitter.

7. The method as recited in claim 5, further comprising:

generating fifth data that includes the identifier of the light emitter and a command to activate; and transmitting the fifth data, wherein the determining that the portion of the image data represents the light emitter comprises determining that the portion of the image data represents the light emitter switching from a first state to a second state.

8. The method as recited in in claim 5, wherein the image data is first image data and the light emitter is a first light emitter, and wherein the method further comprises:

analyzing the first image data with respect to second image data that represents a second light emitter, wherein the determining that the portion of the image data represents the first light emitter comprises determining that the portion of the first image data corresponds to the second image data representing the second light emitter.

9. The method as recited in in claim 5, wherein the image data is first image data, and wherein the method further comprises:

receiving second image data generated by the electronic device, the second image data representing the FOV of the electronic device;

transmitting the second image data to the client device;

receiving fifth data indicating that the client device received a selection of a portion of the second image data;

determining that the portion of the first image data corresponds to the portion of the second image data;

based at least in part on the association and the portion of the first image data corresponding to the portion of the second image data, generating fourth data that includes the identifier of the light emitter and a command to activate; and transmitting the fourth data.

10. The method as recited in in claim 5, wherein the client device is a first client device and image data is first image data, and wherein the method further comprises:

receiving second image data generated by the electronic device, the second image data representing the FOV of the electronic device;

transmitting the second image data to a second client device;

receiving fifth data indicating that the second client device received a selection of a portion of the second image data;

determining that the portion of the first image data corresponds to the portion of the second image data;

based at least in part on the association and the portion of the first image data corresponding to the portion of the second image data, generating fourth data that includes the identifier of the light emitter and a command to activate; and transmitting the fourth data.

11. The method as recited in in claim 5, wherein the light emitter is a first light emitter, the portion is a first portion, the identifier is a first identifier, and the association is a first association, and wherein the method further comprises:

determining that a second portion of the image data represents a second light emitter;

transmitting, to the client device, fifth data indicating that the second portion of the image data represents the second light emitter;

receiving, from the client device, sixth data indicating that the second portion of the image data is associated with a second identifier of the second light emitter; and storing seventh data indicating a second association between the second portion of the image data and the second identifier of the second light emitter.

12. A method comprising:

storing first data indicating an identifier associated with a light emitter that is located within a field of view (FOV) of an electronic device;

receiving image data generated by the electronic device, the image data representing the FOV of the electronic device transmitting the image data to a client device;

receiving second data from the client device, the second data indicating a selection of a portion of an image represented by the image data, the portion of the image representing the light emitter;

after the receiving of the second data, generating third data that includes the identifier associated with the light emitter and a command to activate; and transmitting the third data to the light emitter.

13. The method as recited in claim 12, further comprising:

determining that the portion of the image represents the light emitter; and transmitting fourth data to the client device, the fourth data including an additional command to display an interface element over the portion of the image, wherein the selection of the portion of the image representing by the image data includes a selection of the interface element.

14. The method as recited in claim 12, further comprising:

storing fourth data indicating an association between the light emitter and a portion of the FOV of the electronic device; and determining that the portion of the image corresponds to the portion of the FOV of the electronic device, wherein the generating of the third data is based at least in part on the determining that the portion of the image corresponds to the portion of the FOV of the electronic device.

15. The method as recited in claim 12, wherein the image data is first image data, the selection is a first selection, the image is a first image, and the command is a first command, and wherein the method further comprises:

receiving second image data generated by the electronic device, the second image data representing the FOV of the electronic device;

transmitting the second image data to the client device;

receiving fourth data from the client device, the fourth data indicating a second selection of a portion of a second image represented by the second image data, the portion of the second image representing the light emitter;

based at least in part on the second selection of the portion of the second image that represents the light emitter, generating fifth data that includes the identifier associated with the light emitter and a second command to deactivate; and transmitting the fifth data to the light emitter.

16. The method as recited in claim 12, wherein the identifier is a first identifier, the light emitter is a first light emitter, the selection is a first selection, the portion of the image is a first portion of the image, and the command is a first command, and wherein the method further comprises:

storing fourth data indicating a second identifier associated with a second light emitter that is located within the FOV of the electronic device;

receiving fifth data from the client device, the fifth data indicating a second selection of a second portion of the image, the second portion of the image representing the second light emitter;

based at least in part on the second selection of the second portion of the second image that represents the second light emitter, generating sixth data that includes the second identifier associated with the second light emitter and a second command to activate; and transmitting the sixth data to the second light emitter.

17. The method as recited in claim 12, wherein the identifier is a first identifier, the light emitter is a first light emitter, the selection is a first selection, and the portion of the image is a first portion of the image, and wherein the method further comprises:

storing fourth data indicating a second identifier associated with a second light emitter that is located within the FOV of the electronic device; and receiving fifth data from the client device, the fifth data indicating a second selection of a second portion of the image, the second portion of the image representing the second light emitter, wherein the third data further includes the second identifier associated with the second light emitter.

18. The method as recited in claim 12, wherein the identifier is a first identifier and the light emitter is a first light emitter, and wherein the method further comprises:

storing fourth data indicating an association between the first identifier associated with the first light emitter and a second identifier associated with a second light emitter, wherein the third data further includes the second identifier associated with the second light emitter.

19. The method as recited in claim 12, wherein the image data is first image data, the selection is a first selection, and the image is a first image, and wherein the method further comprises:

receiving second image data generated by the electronic device, the second image data representing the FOV of the electronic device;

transmitting the second image data to the client device;

receiving fourth data from the client device, the fourth data indicating:

a second selection of a portion of a second image represented by the second image data, the portion of the second image representing a portion of the FOV of the electronic device; and the portion of the second image represents the light emitter; and based at least in part on the fourth data, storing fifth data indicating an association between the portion of the FOV of the electronic device and the identifier associated with the light emitter; and determining that the portion of the image corresponds to the portion of the FOV of the electronic device, wherein the generating of the third data that includes the identifier associated with the light emitter and the command to activate is based at least in part on the determining that the portion of the image corresponds to the portion of the FOV of the electronic device.

20. The method as recited in claim 12, wherein the image data is first image data, the selection is a first selection, the client device is a first client device, and the image is a first image, and wherein the method further comprises:

receiving second image data generated by the electronic device, the second image data representing the FOV of the electronic device;

transmitting the second image data to a second client device;

receiving fourth data from the second client device, the fourth data indicating:

a second selection of a portion of a second image represented by the second image data; and the portion of the second image represents the light emitter;

determining that the portion of the second image corresponds to a portion of the FOV of the electronic device; and transmitting fifth data to the first client device, the fifth data indicating an association between the portion of the FOV of the electronic device and the identifier associated with the light emitter.

* * * * *